US005684523A

United States Patent [19]

Satoh et al.

[11] Patent Number: 5,684,523

[45] Date of Patent: Nov. 4, 1997

[54] OPTICAL LINE PRINTHEAD AND AN LED CHIP USED THEREFOR

[75] Inventors: Shunichi Satoh, Miyagi-Ken; Takashi Takahashi, Tsukuba; Hiroyuki Iechi, Sendai; Tomoaki Yoshida, deceased, late of Natori; Chizuru Yoshida, legal representative, Yokohama; Hirokazu Iwata, Sendai; Takaaki Miyashita, Yokohama, all of Japan

[73] Assignees: Ricoh Company, Ltd., Tokyo; Ricoh Research Institute of General Electronics Co., Ltd., Miyagi-ken, both of Japan

[21] Appl. No.: 468,351

[22] Filed: Jun. 6, 1995

Related U.S. Application Data

[60] Division of Ser. No. 158,198, Nov. 24, 1993, abandoned, which is a continuation-in-part of Ser. No. 790,667, Nov. 8, 1991, abandoned.

[30] Foreign Application Priority Data

Nov. 15, 1990 [JP] Japan ..... 2-309973
Jul. 23, 1991 [JP] Japan ..... 3-182570

[51] Int. Cl.[6] ..... B41J 2/47

[52] U.S. Cl. ..... 347/247; 372/45; 372/46

[58] Field of Search ..... 347/246, 247, 347/236, 237; 372/45, 46, 44, 43

[56] References Cited

U.S. PATENT DOCUMENTS

| | | | |
|---|---|---|---|
| 4,159,452 | 6/1979 | Logan et al. | 372/45 |
| 4,408,331 | 10/1983 | Hartman et al. | 372/46 |
| 4,661,961 | 4/1987 | Nelson et al. | 372/46 |

*Primary Examiner*—Mark J. Reinhart
*Attorney, Agent, or Firm*—Cooper & Dunham LLP

[57] ABSTRACT

A light emitting diode chip includes a substrate carrying thereon a number of light emitting diodes aligned in a row to form an array for producing a number of optical beams parallel to each other in a first direction, and monitoring element provided monolithically on the substrate for detecting the power of the optical beams produced by the light emitting diodes, wherein the monitoring element includes: a reference light emitting diode having a structure identical to the light emitting diodes in the array for producing an optical beam in a second direction perpendicular to the first direction; and a photodiode having a structure identical to the light emitting diodes in the array and separated from the reference light emitting diode by an isolation groove for detecting the optical beam produced by the reference light emitting diode.

46 Claims, 30 Drawing Sheets

OPTICAL LINE PRINTHEAD AND AN LED CHIP USED THEREFOR

CROSS REFERENCE TO RELATED APPLICATION

This is a division of application Ser. No. 08/158,198 filed Nov. 24, 1993 now abandoned which in turn is a continuation-in-part of application Ser. No. 07/790,667 filed Nov. 8, 1991, now abandoned.

BACKGROUND OF THE INVENTION

The present invention generally relates to optical beam sources used for optical printheads of printers and copiers, and more particularly to a light emitting diode array used in such an optical printer head and a method for controlling the same.

In xerographic printers, an image is recorded on a sheet by means of optical beam. More specifically, an image to be recorded is formed on a photosensitive body such as a photosensitive drum or a photosensitive belt in the form of an electrostatic latent image, by irradiating the photosensitive body with an optical beam, which optical beam being produced by an optical source in accordance with the image to be recorded. The electrostatic latent image thus recorded on the photosensitive body by the optical beam is developed by applying toners in the form of a toner image, and the toner image thus formed on the photosensitive body is transferred to a recording sheet by pressing the recording sheet against the photosensitive body.

In such xerographic printers, therefore, it is necessary to provide a powerful and reliable optical source for producing the optical beam. In order to produce the optical beam in accordance with the image to be recorded with high resolution and high speed, the optical source is generally formed of semiconductor optical source devices arranged to form an array, each of the semiconductor optical source devices producing an optical beam, such that a plurality of optical beams are produced simultaneously. Typically, a laser diode or a light emitting diode referred to hereinafter as LED is used for such a semiconductor optical source device, wherein the LEDs can be constructed with a reduced cost as compared with laser diodes. Generally, a plurality of LEDs are included in a single, monolithic LED chip in the form of an LED array, and a plurality of optical beams produced by the LED array are deflected by a rotary polygonal mirror to scan the surface of the photosensitive drum. Alternatively, such LED chips are assembled in a row to form a optical line printhead, wherein optical beams are produced substantially simultaneously in correspondence to one horizontal scanning line. In the latter construction, one can eliminate the mechanical deflectors such as a rotary polygonal mirror as well as a drive mechanism for driving the same, and the size of the printer is reduced substantially.

FIG. 1 shows the construction of a conventional optical line printhead 101.

Referring to FIG. 1, the optical line printhead 101 includes a heat sink 102 acting as a support substrate on which an elongate ceramic substrate 103 is provided, wherein the ceramic substrate 103 carries thereon a plurality of LED chips $\mathbf{108}_{-1}$–$\mathbf{108}_{-n}$, each including an array of LEDs. The LEDs $\mathbf{108}_{-1}$–$\mathbf{108}_{-n}$ are aligned to form a row on the ceramic substrate 103, and a pair of grooves 104 and 105 are formed on the substrate 103 so as to extend along the row of the LEDs for accommodating driver circuits $\mathbf{109}_{-1}$–$\mathbf{109}_{-n}$ as well as driver circuits $\mathbf{110}_{-1}$–$\mathbf{110}_{n}$, respectively. The driver circuits $\mathbf{109}_{-1}$–$\mathbf{109}_{-n}$ correspond to the LED chips $\mathbf{108}_{-1}$–$\mathbf{108}_{-n}$ respectively and are connected to a cable 106 that transmits therethrough image signals. Similarly, the driver circuits $\mathbf{110}_{-1}$–$\mathbf{110}_{-n}$ correspond to the LED chips $\mathbf{108}_{-1}$–$\mathbf{108}_{-n}$ respectively, wherein the driver circuits $\mathbf{110}_{-1}$–$\mathbf{110}_{-n}$ are connected to a cable 107 that transmits also therethrough the image signals.

In operation, a time-sequential image signal is supplied to the driver circuits $\mathbf{109}_{-1}$–$\mathbf{109}_{-n}$ and further to the driver circuits $\mathbf{110}_{-1}$–$\mathbf{110}_{-n}$, wherein the image signal thus supplied is converted to a parallel signal in a serial-to-parallel converter that is provided in each of the driver circuits $\mathbf{109}_{-1}$–$\mathbf{109}_{-n}$ and $\mathbf{110}_{-1}$–$\mathbf{110}_{-n}$. In response to the parallel image signals thus produced, the LEDs forming an array in the LED chips $\mathbf{108}_{-1}$–$\mathbf{108}_{-n}$ are turned on and turned off.

FIG. 2 shows a part of a xerographic printer that uses the line printhead 101.

Referring to FIG. 2, the line printhead 101 cooperates with a photosensitive drum 203 and includes a number of LED chips such as the LED chip $\mathbf{108}_{-m}$. The LED chip $\mathbf{108}_{-m}$ includes an LED $\mathbf{108}_{-m-p}$ forming an array together with other LEDs, wherein the LED $\mathbf{108}_{-m-p}$ produces an optical beam and irradiates the surface of a photosensitive drum 1 with the optical beam thus formed via an optical system 2. Typically, the optical system 2 forms a unity magnification imaging system. Thereby, an image corresponding to one horizontal scanning line is recorded on the surface of the photosensitive drum 1 substantially simultaneously.

So far, various optical line printheads have been proposed. For example, Hart et al. discloses in the U.S. Pat. No. 4,857,944, which is incorporated herein as reference, the use of a number of surface emission type LEDs arranged in a row in correspondence to a horizontal scanning line, wherein the optical beams produced by the LEDs are focused upon a photosensitive drum via corresponding lens array.

FIG. 3 shows the printer head proposed by Hart et al.

Referring to FIG. 3, the printhead of Hart et al. is constructed on a heat sink 201 acting as a support substrate and includes a semiconductor substrate 202 that carries thereon an array 203 of surface emission type LEDs 203*a*. Further, the substrate 202 carries a number of driver circuits in the form of integrated circuits 205, and the LEDs 203*a* produce optical beams under control of the driver integrated circuits 205 in a direction generally perpendicular to the principal surface of the substrate 202. The optical beams thus emitted are received by a lens array 206 disposed above the substrate 202 and focused by the same upon the surface of a photosensitive drum not illustrated.

FIG. 4 shows another example of the LED chip used in the optical line printer 101, wherein the LED chip includes a number of edge emission type LEDs formed on a common semiconductor substrate. The LED chip of FIG. 4 is described in the Japanese Laid-open Patent Publication 60-32373 and in Yoshida, U.S. Pat. No. 5,091,757, which are incorporated herein as reference.

Referring to FIG. 4, the LED chip is constructed on a heat sink 300 and includes a layered semiconductor structure 301 provided on the heat sink 300 via a bottom electrode layer 302, wherein the layered semiconductor structure 301 includes various epitaxial layers grown on a substrate of a compound semiconductor material as usually practiced in the art. The semiconductor structure 301 is defined by a pair of mutually opposing, front and rear edge surfaces $f_1$ and $f_2$, and the LEDs 303 are separated from each other in the lateral direction by an isolation groove 304. Further, in correspondence to each of the LEDs 303, there is provided a top electrode layer 305. The layered semiconductor structure 301 includes an active layer of undoped compound semiconductor material typically having a band structure of the direct transition type, and thus, each of the LEDs 303 produces an optical beam in the active layer in response to the energization applied across the electrodes 302 and 305, wherein it will be noted that the electrode 302 is used commonly by a plurality of the LEDs 303. Thereby, the optical beam thus produced is emitted at the edge surface $f_1$ as indicated by an arrow in FIG. 4. In the LED chip of FIG. 4, one can form the LEDs easily with a mutual separation of less than 23 μm, and the LED chip of FIG. 4 is particularly suited for constructing a high density optical line printhead exceeding a dot pitch of 600 dpi.

In the optical line printhead as shown in FIG. 1 or FIG. 2, it is essential to maintain a uniform luminance for each of the LEDs included in the optical line printhead such that the dot size of the recording image is maintained uniform over the entire horizontal scanning line when the LED is turned on. In the LED chip of FIG. 4, a uniform operational characteristic is achieved easily for those LEDs formed on a common chip, as one can grow the epitaxial layers forming the layered semiconductor structure 301 substantially uniformly. Typically, one can suppress the variation in the intensity of the optical beam to within about 5% for those LEDs formed on a common chip. On the other hand, the current fabrication process of semiconductor substrate cannot provide a large semiconductor chip that can provide the full length of the optical line printhead. Thus, when constructing an optical line printhead, one has to assemble a number of LED chips as already explained with reference to FIG. 1. As different LED chips may be formed on different substrates, there is a substantial risk that the intensity of the optical beams varies from chip to chip. Further, the mounting condition of the individual LED chip may affect the intensity of the optical beams. In fact, a variation reaching as much as 50% is encountered. Further, apart from the foregoing chip-to-chip variation of the optical beam intensity, there may exist an environmental or time-dependent variation of the optical beam intensity in the LEDs, which has to be compensated for in the optical line printhead.

In order to compensate for such a variability in the intensities of the optical beams, conventional optical line printheads employ a feedback control system.

FIG. 5 shows an example of such a feedback control system used in the optical line printhead of Hart et al., op cit.

Referring to FIG. 5, the feedback control system of Hart uses a photodetector array 207 disposed adjacent to the lens array 206 (see FIG. 3), and the output signals of the photodetector array 207 indicative of the intensity of the detected optical beams are supplied to a microprocessor 208 forming a part of the integrated circuit 205, via an analog amplifier **207*a* and a D/A converter 207*b*. The microprocessor 208 cooperates with a non-volatile read only memory 209 such as an E'PROM and further with a random access memory 210 that are provided on the substrate 202 similarly to the integrated circuit 205, and controls a driver circuit 211 that drives the individual LEDs in the LED array 204, such that the deviation between the intensity of the LEDs in the array 204 and the programmed intensity stored in the read only memory 209 is minimized. Further, there may be provided an interface circuit 212 on the substrate 202 for external control signals. In the system of Hart, the programmed optical power of the LED is stored in the E'PROM 209 for each of the LEDs 203*a* shown in FIG. 3 at the time when the optical line printhead is assembled, assuming a substantial device-to-device variation in the operational characteristic of the LEDs, and the feedback control is achieved with respect to the programmed optical power stored in the memory 209**.

In operation, the optical beams produced by the LEDs **203*a* are detected by the photodetector array 207 with respect to intensity, and the intensity of the optical beams is then subjected to the foregoing feedback control process under control of the microprocessor 208 in view of the programmed optical power stored in the E'PROM 209**. Thus, the system of Hart et al. can detect and compensate for the device-to-device variation of intensity of the output optical beams of the LEDs used for recording the images.

In the device and the control system of Hart et al. shown in FIG. 3 and FIG. 5, it should further be noted that the environmental or time-dependent variation of the LED optical beam power is compensated for by monitoring the output of one or more special, reference LEDs shown in FIG. 3 as LED 204. The reference LED 204 is not activated in the normal operational mode of the optical line printhead for recording images but is activated upon every starting up of the printer. In response to the power of the output optical beam of the reference LED 204 detected by a corresponding photodetector in the photodetector array 207, the energization of the LED 204 is corrected such that the power of the optical beam emitted therefrom coincides with a predetermined optical power, and in response to such correction of the energization of the LED 204, the energization of the LEDs **203*a* is corrected while maintaining mutual ratios of optical power according to the values stored in the E'PROM 209**.

In the feedback control system of FIG. 5, it should be noted that one has to store the programmed optical power values in the form of energization values, such as the drive current of the individual LEDs **203*a* forming the LED array 203, in the E'PROM 209 at the time when the optical line printhead is assembled. Thereby, the system of Hart et al. has a drawback in that a complex calibration process is required. In such a calibration process, it should be noted that each of the LEDs 203*a*** is energized individually for detection of the output optical power.

In addition, the system of Hart has a drawback in that it occupies a substantial space because of the use of the additional photodetector array 207, in addition to the drawback in the difficulty, pertinent to the surface emission type LED arrays, of increasing the dot pitch.

In the edge emission type LED array as shown in FIG. 4, one may use a construction, used conventionally in laser diodes, for monitoring the output optical power of the LEDs.

FIG. 6 shows a laser diode disclosed in Yoshida et al., European Patent Application EP 0 208 527, wherein the laser diode has the construction for detecting the output optical power of the laser diode.

Referring to FIG. 6 showing a laser diode 400 of the foregoing reference, the laser diode 400 includes a semiconductor substrate 401 of a compound semiconductor material such as InP doped to the n-type, and a cladding layer 402 of InP doped to the n-type is grown epitaxially on the substrate 401. Further, an undoped active layer 403 of InGaAsP is formed epitaxially on the InP cladding layer 402, and another cladding layer 404 of p-type InP is formed epitaxially on the active layer 403. Further, a bottom electrode 405 is provided on the lower principal surface of the substrate 401, while a top electrode 406 is provided as a stripe on the upper principal surface of the InP cladding layer 404 to extend in the longitudinal direction of the laser diode.

In the laser diode of FIG. 6, the layered structure described above is divided into a laser oscillation region 410 and a photodetection region 411 by a groove 409 such that the laser oscillation region 410 and the photodetection region 411 are separated from each other in the longitudinal direction. Thereby, a cleaved surface 410*a* at the front end of the laser oscillation region 410 serves for a front mirror of the laser diode while and end surface 410*b* at the rear end of the laser oscillation region 410 serves for a rear mirror. It should be noted that the end surface 410*b* coincides with the side wall or the groove 409.

In such a structure, the laser beam emitted at the mirror surface 410*b* in the backward direction enters into an active layer 403*b* of the photodetection region 411, and the detection region 411, acting as a photodiode, produces an output signal indicative of the optical power of the detected laser beam. Thus, by providing a feedback control system similar to the one shown in FIG. 5, it is possible to maintain the optical power of the laser beam substantially constant. In the structure of FIG. 6, it should be noted that the active layer 403 is divided by the groove 409 into a layer 403*a* of the laser oscillation region 410 and the layer 403*b* of the photodetection region 411. Similarly, the top electrode stripe 406 is also divided by the groove 409 into a top electrode 406*a* for the laser oscillation region 410 and a top electrode 406*b* for the photodetection region 411.

In view of the teaching of the laser diode 400 of FIG. 6, one may provide a groove corresponding to the groove 409 in each of the LED elements 303 of FIG. 4, such that the LED element includes an emission region located at a front end defined by the front edge $f_1$ for emitting the optical beam as indicated by the arrow in FIG. 4 and a corresponding photodetection region located at a rear end. However, such a structure needs the detection and control of the optical beams of the individual LED elements and hence requires a complex control system including a large storage capacity memory device similar to the E'PROM 209 of FIG. 5 as well as a complex interconnection pattern. In view of the cost, such a structure of the LED chip is not a realistic solution for the optical line printheads targeting small size, low cost printers and copiers.

Further, one may use a special, reference LED corresponding to the LED 204 of FIG. 3 in the edge emission type LED array shown in FIG. 4, in accordance with the teaching of Hart et al, for calibrating the operational characteristics of the LEDs upon starting up of the printer. As such a reference LED 204 is not used during the normal operation of the optical line printhead, it is desired to provide such a reference LED separately to the LEDs on the LED ships in the optical line printhead to effect the feedback control according to the system of FIG. 5. However, such a separate construction of the reference LED does not provide any simplification to the feedback control system that cooperates with each of the LEDs forming the LED array on an LED chip.

SUMMARY OF THE INVENTION

Accordingly, it is a general object of the present invention to provide a novel and useful optical line printhead as well as an LED chip used therein, wherein the foregoing problems are eliminated.

Another and more specific object of the present invention is to provide a light emitting diode chip that carries thereon a light emitting diode array and a monitoring fixture for monitoring the power of the optical beams produced by the light emitting diode array.

Another object of the present invention is to provide an optical line printhead that includes a plurality of LED chips each carrying thereon an LED array, and a feedback control system for controlling the optical power of each LED on the LED chips, wherein the construction of the optical line printhead is substantially simplified.

Another object of the present invention is to provide a method for controlling the power of optical beams produced from an optical line printhead that includes thereon a plurality of LED chips each in turn including an LED array, such that each of the optical beams produced from the LEDs forming the LED array has a predetermined, mutually identical optical power, irrespective of the LED chip in the optical line printhead.

Another object of the present invention is to provide a light emitting diode chip, comprising:

a substrate of a single crystal semiconductor material doped to a first conductivity type and having upper and lower principal surfaces;

a bottom electrode covering said lower principal surface of said substrate;

a plurality of light emitting diodes disposed on said upper principal surface of said substrate so as to be aligned in a row, said plurality of light emitting diodes thereby forming a light emitting diode array;

each of said light emitting diodes having an identical construction and comprising: a first cladding layer doped to said first conductivity type and provided on said substrate epitaxially with respect to said substrate, said first cladding layer having a first bandgap; an active layer of undoped semiconductor material provided on said first cladding layer epitaxially with respect to said first cladding layer, said active layer having a second bandgap smaller than said first bandgap; a second cladding layer doped to a second, opposite conductivity type and provided on said active layer epitaxially with respect to said active layer, said second cladding layer having a third bandgap larger than said second bandgap; and a top electrode provided on said second cladding layer for injecting carriers of a first polarity thereto;

each of said light emitting diodes having a front edge facing a common, first direction perpendicular to a direction of a hypothetical normal drawn to said upper principal surface of said substrate and a rear edge opposing said front edge, each of said light emitting diodes emitting an optical beam at said front edge in said first direction, in response to electric energization applied across said top electrode and said bottom electrode; and monitoring means provided on said upper principal surface of said substrate for monitoring the optical power of said optical beams produced by said light emitting diodes forming said light emitting diode array, said monitoring means comprising: a monitoring-purpose light emitting diode having a construction substantially identical with the construction of said light emitting diodes that form said light emitting diode array, said monitoring-purpose light emitting diode having a front edge for emitting an optical beam therethrough, said monitoring-purpose light emitting diode being disposed on said upper principal surface of said substrate such that said front edge of said monitoring-purpose light emitting diode faces a second direction perpendicular to said first direction so that said optical beam produced by said monitoring-purpose light emitting diode is emitted in said second direction through said front edge of said monitoring-purpose light emitting diode; and a photodiode having a construction substantially identical with the construction of said light emitting diodes forming said light emitting diode array, said photodiode having a front edge facing said front edge of said monitoring-purpose light emitting diode for receiving said optical beam emitted from said monitoring-purpose light emitting diode, said photodiode producing an output signal indicative of the optical power of said optical beam produced by said monitoring-purpose light emitting diode, said output signal being produced across said top electrode of said photodiode and said bottom electrode; said monitoring means being disposed behind said rear edges of said light emitting diodes forming said light emitting diode array.

According to the present invention, one can detect the power of the optical beam produced by the light emitting diodes forming the array by detecting the power of the optical beam produced by the monitoring-purpose light emitting diode forming the monitoring means, by means of the photodiode also forming said monitoring means. It should be noted that the monitoring-purpose light emitting diode is constructed on the substrate monolithically and has exactly the same construction as the light emitting diodes forming the diode array. As the monitoring-purpose light emitting diode produces the optical beam in the second direction perpendicular to the first direction in which the light emitting diodes forming the array produces the optical beams, and as the monitoring-purpose light emitting diode is disposed behind the rear edges of the light emitting diodes forming the light emitting diode array on the substrate, there occurs no interference between the optical beams produced by the light emitting diode array and the optical beam produced by the monitoring-purpose light emitting diode. Further, as the photodiode has a construction substantially identical with other light emitting diodes on the same substrate, one can form the photodiode and the light emitting diodes simultaneously. Thereby, the fabrication cost of the light emitting diode chip is substantially reduced. By applying a feedback control to the energization of the light emitting diodes forming the light emitting diode array, based upon the output signal produced by the photodiode, one can set the power of the optical beams produced by the light emitting diodes in the array at a predetermined, constant level. In other words, the light emitting diode chip having such a construction is capable of producing the optical beam with a predetermined power irrespective of the variation of the characteristics of the individual chips. By arranging a number of such light emitting diode chips in a row, one can construct an optical line printhead wherein the variation in the dot size of the images recorded on the sheet by the chip is substantially eliminated.

In a preferred embodiment of the present invention, said substrate has a front edge and an opposing rear edge, said light emitting diodes forming said light emitting diode array being disposed along said front edge of said substrate, said monitoring means being disposed in the vicinity of said rear edge, such that said front edges of said light emitting diodes forming said light emitting diode array and said front edge of said substrate face said first direction.

In a preferred embodiment of the present invention, each of said light emitting diodes forming said light emitting diode array are isolated, spatially and electrically, from each other by an isolation groove.

In another preferred embodiment of the present invention, said monitoring means comprises: a plurality of monitoring-purpose light emitting diodes each having a construction substantially identical with the construction of said light emitting diodes that form said light emitting diode array and disposed at respective, different locations on said upper principal surface of said substrate, each of said monitoring-purpose light emitting diodes having a front edge for emitting an optical beam therethrough, each of said monitoring-purpose light emitting diodes being disposed on said upper principal surface of said substrate such that said front edge faces said second direction such that said optical beam produced by said monitoring-purpose light emitting diode is emitted in said second direction through said front edge of said monitoring-purpose light emitting diode; and a plurality of photodiodes each having a construction substantially identical with the construction of said light emitting diodes forming said light emitting diode array and disposed in correspondence to said plurality of monitoring-purpose light emitting diodes, each of said photodiodes having a front edge facing said front edge of a respective one of said monitoring-purpose light emitting diodes for receiving said optical beam emitted from said monitoring-purpose light emitting diode, each of said photodiodes producing an output signal indicative of the optical power of said optical beam produced by the corresponding one of said monitoring-purpose light emitting diodes, said output signal being produced across said top electrode of said monitoring-purpose light emitting diode and said bottom electrode; said monitoring means being disposed behind said rear edges of said light emitting diodes forming said light emitting diode array.

In another preferred embodiment of the present invention, said substrate carries, on said upper principal surface thereof, an optical shielding wall extending generally in an upward direction from said upper principal surface, said optical shielding wall being surrounded by a side wall and comprising semiconductor epitaxial layers, said optical shielding wall being provided on said upper principal surface of said substrate between said light emitting diodes that form said light emitting diode array and said monitoring means, such that said optical shielding wall shields said monitoring means from said optical beams produced by said light emitting diodes in said light emitting diode array.

In another preferred embodiment of the present invention, said substrate carries, on said upper principal surface thereof; a first conductor pattern having a first end connected to a top electrode of said photodiode forming said monitoring means, for carrying said output signal of said photodiode therethrough; a first bonding pad provided on said upper principal surface of said substrate in electrical connection to a second, opposite end of said first conductor pattern for outputting said output signal of said photodiode; a second bonding pad provided on said upper principal surface of said substrate for receiving a drive current for energizing said monitoring-purpose light emitting diode; a second conductor pattern provided on said upper principal surface of said substrate and having a first end in electrical connection to said second bonding pad for conducting said drive current from said second boding pad to said monitoring-purpose light emitting diode, said second conductor pattern having a second opposite end in electrical connection to a top electrode of said monitoring-purpose light emitting diode; a plurality of third bonding pads each provided on said upper principal surface of said substrate for receiving a drive current for energizing a corresponding one of said light emitting diodes forming said light emitting diode array; a plurality of third conductor patterns each provided on said upper principal surface of said substrate and having a first end connected to the corresponding one of said third bonding pads, for conducting said drive current supplied to said third bonding pad, each of said third conductor patterns having a second, opposite end connected to said top electrode of the corresponding one of said light emitting diodes that form said light emitting diode array.

In another preferred embodiment of the present invention, said light emitting diode chip comprises a material layer having upper and lower major surfaces provided on said upper principal surface of said substrate behind said light emitting diode array, said material layer carrying, on said upper major surface thereof, said first through third bonding pads and said first through third conductor patterns.

In still another preferred embodiment of the present invention, said material layer comprises semiconductor epitaxial layers provided epitaxially on said upper principal surface of said substrate, said material layer from said light emitting diodes in said light emitting diode array, said material layer having a thickness such that said upper principal surface of said material layer has a level generally identical with the level of said top electrode of said light emitting diodes in said light emitting diode array; said groove being filled by an insulating material having a top surface at a level substantially identical with said upper principal surface of said material layer.

In still another embodiment of the present invention, said material layer has a layered structure substantially identical to the layered structure of said monitoring-purpose light emitting diode and the layered structure of said photodiode forming said monitoring means, said monitoring-purpose light emitting diode and said photodiode being isolated from said material layer by a surrounding groove that surrounds said monitoring means, said surrounding groove being filled by with insulating material.

Another object of the present invention is to provide an optical beam source for producing a plurality of optical beams, comprising:

a support substrate having an upper major surface;

a plurality of light emitting diode chips provided on said upper major surface of said support substrate so as to be aligned in a row, each of said light emitting diode chips comprising:

a substrate of a single crystal semiconductor material doped to a first conductivity type and having upper and lower principal surfaces;

a bottom electrode covering said lower principal surface of said substrate;

a plurality of light emitting diodes disposed on said upper principal surface of said substrate so as to be aligned in a row, said plurality of light emitting diodes thereby forming a light emitting diode array;

each of said light emitting diodes having an identical construction and comprising: a first cladding layer doped to said first conductivity type and provided on said substrate epitaxially with respect to said substrate, said first cladding layer having a first bandgap; an active layer of undoped semiconductor material provided on said first cladding layer epitaxially with respect to said first cladding layer, said active layer having a second bandgap smaller than said first bandgap; a second cladding layer doped to a second, opposite conductivity type and provided on said active layer epitaxially with respect to said active layer, said second cladding layer having a third bandgap larger than said second bandgap; and a top electrode provided on said second cladding layer for injecting carriers of a first polarity thereto;

each of said light emitting diodes having a front edge facing a common, first direction perpendicular to a direction of a hypothetical normal drawn to said upper principal surface of said substrate and a rear edge opposing said front edge, each of said light emitting diodes emitting an optical beam at said front edge in said first direction, in response to electric energization applied across said top electrode and said bottom electrode; and monitoring means provided on said upper principal surface of said substrate for monitoring the optical power of said optical beams produced by said light emitting diodes forming said light emitting diode array, said monitoring means comprising: a monitoring-purpose light emitting diode having a construction substantially identical with the construction of said light emitting diodes that form said light emitting diode array, said monitoring-purpose light emitting diode having a front edge for emitting an optical beam therethrough, said monitoring-purpose light emitting diode being disposed on said upper principal surface of said substrate such that said front edge faces a second direction perpendicular to said first direction and perpendicular to the direction of the hypothetical normal drawn to said upper principal surface of said substrate, such that said optical beam produced by said monitoring-purpose light emitting diode is emitted in said second direction through said front edge of said monitoring-purpose light emitting diode; and a photodiode having a construction substantially identical to the construction of said light emitting diodes forming said light emitting diode array, said photodiode having a front edge facing said front edge of said monitoring-purpose light emitting diode for receiving said optical beam emitted from said monitoring-purpose light emitting diode, said photodiode producing an output signal indicative of the optical power of said optical beam produced by said monitoring-purpose light emitting diode, said output signal being produced across said top electrode of said photodiode and said bottom electrode; said monitoring means being disposed behind said rear edges of said light emitting diodes forming said light emitting diode array;

said plurality of light emitting diode chips being disposed on said support substrate so as to produce said optical beams in a common direction; and a plurality of feedback control circuits provided in a one-to-one correspondence with said plurality of light emitting diode chips, said feedback control circuit drives, in each of said plurality of light emitting diode chips, said monitoring-purpose light emitting diode with energization determined in response to said output signal of said photodiode, such that said optical beam produced by said monitoring-purpose light emitting diode has a predetermined optical power, said feedback control circuit driving said light emitting diodes forming said light emitting diode array on said light emitting diode chip by energization corresponding to the energization of said monitoring-purpose light emitting diode.

According to the present invention, one can construct an optical line printhead that provides a uniform dot size throughout the horizontal scanning line that is recorded by the optical line printhead, by controlling the power of the optical beam produced by the light emitting diode chip such that it is at a predetermined, constant level irrespective of the chip. By increasing the number of the chips in the head, one can extend the length of the line that is recorded by the optical line printhead as desired, since the power of the optical beam produced by the light emitting diode chip is set to the foregoing predetermined, constant level.

In a preferred embodiment of the present invention, each of said feedback control circuits comprises: non-volatile memory means for storing a value of desired power of the optical beams produced by said light emitting diodes; comparator means supplied with an output signal from said non-volatile memory means indicative of said desired power of said optical beam stored therein and further with said output signal of said photodiode indicative of the power of the optical beam produced by the monitoring-purpose light emitting diode, for producing an output signal in response to the difference between said output signal of said comparator means and said output signal of said photodiode, such that said difference is reduced; and driver means supplied with said output signal of said comparator means for producing a drive current, said comparator means energizing said monitoring-purpose light emitting diode by said drive current, said comparator means further energizing said light emitting diode forming said light emitting diode array by said drive current.

In another preferred embodiment of the present invention, said optical beam source further includes an optical system for focusing said optical beams on a recording surface, said optical system comprising: first reflection means for deflecting said optical beams produced by said light emitting diodes on said light emitting diode chips in a direction generally perpendicular to said upper major surface of said support substrate; second reflection means for causing first and second successive reflections of said optical beams that have been deflected by said first reflection means, such that said optical beams are deflected first in a direction generally parallel to said upper major surface of said support substrate in correspondence to said first reflection and next in a direction generally perpendicular to said upper major surface of said support substrate in correspondence to said second reflection such that said optical beams travel toward said support substrate after said second reflection; third reflection means for deflecting said optical beams having undergone said first and second reflections in said second reflection means toward said recording surface; and a plurality of lenses aligned, with a predetermined pitch, in a direction in which said light emitting diode chips are aligned to form a lens array, said plurality of lenses being disposed in a path of said optical beams traveling from said first reflection means to said third reflection means via said second reflection means. According to the present invention as set forth above, the tolerance with respect to the alignment between the light emitting diodes and the lenses forming the optical system is substantially increased over that of conventional systems that employ the SELFOC lens array. Thereby, one can achieve the desired high precision focusing of optical beams on said recording surface without a complicated adjustment process, and the efficiency of fabrication of the optical line printhead increases substantially.

In another preferred embodiment of the present invention, said optical system includes another lens array including a plurality of lenses each being disposed coaxially with respect to the lenses forming said first mentioned lens array.

In another preferred embodiment of the present invention, said third reflection means comprises a plurality of roof mirrors each having a pair of mutually inclined mirror surfaces that cause first and second reflections of said optical beams, said roof mirrors being disposed with a pitch corresponding to said predetermined pitch of said plurality of lenses.

In another preferred embodiment of the present invention, said optical system includes optical louver means including a plurality of apertures each forming a passage for said optical beams, said apertures being aligned with a pitch corresponding to the pitch of said lenses.

In another preferred embodiment of the present invention, said support substrate has a lower major surface on which a cooling fin fixture including a plurality of cooling fins is provided for radiating heat.

In another preferred embodiment of the present invention, said third reflection means deflects said optical beam in a direction that is inclined with respect to said upper major surface of said support substrate.

In another preferred embodiment of the present invention, said optical beam source further includes an optical system for focusing said optical beams on a recording surface, said optical system comprising: first reflection means for deflecting said optical beam produced by said light emitting diodes on said light emitting diode chips, in a direction generally perpendicular to said upper principal surface of said substrate; second reflection means for deflecting said optical beams deflected by said first reflection means in a direction generally parallel to said upper major surface of said support substrate such that said optical beams travel away from said recording surface; third reflection means for causing first and second successive reflections in said optical beams that have been deflected by said second reflection means, such that said optical beams are deflected by substantially 90 degrees generally along a plane parallel to said upper major surface of said support substrate in each of said first and second reflections, such that said optical beams travel toward said recording surface after said second reflection; and a plurality of lenses aligned, with a predetermined pitch, in a direction in which said light emitting diode chips are aligned to form a lens array, said plurality of lenses being disposed in a path of said optical beams traveling from said third reflection means to said recording surface.

Another object of the present invention is to provide a method for controlling an optical beam source including therein a plurality of light emitting diode chips, each of said plurality of light emitting diode chips carrying thereon a plurality of light emitting diodes forming a light emitting diode array, such that the chip-by-chip variation in the power of optical beams produced by said light emitting diodes is eliminated, said light emitting diodes forming said light emitting diode array on each of said light emitting diode array chips; said method comprising the steps of:

(a) detecting, in each of said plurality of light emitting diode chips, the power of said optical beams produced by said light emitting diodes after said optical beams have passed through a focusing system, said focusing system focusing said optical beams upon a photosensitive recording medium;

(b) comparing, in each of said plurality of light emitting diode chips, said power of said optical beams with a reference optical power to produce a first correction signal indicative of the difference between said power of said optical beams and said reference optical power;

(c) detecting, in each of said plurality of light emitting diode chips, the power of a reference light emitting diode, said reference light emitting diode being provided on said light emitting diode chip together with said plurality of light emitting diodes forming said light emitting diode array, to form a second correction signal;

(d) comparing, in each of said plurality of light emitting diode chips, said first correction signal and said second correction signal, in each of said plurality of light emitting diode chips, to produce a driving signal for energizing said light emitting diodes forming said light emitting diode array and said reference light emitting diode, such that the difference between said first correction signal and said second correction signal is minimized;

(e) repeating, in each of said plurality of light emitting diode chips, said steps (a)–(d) until the power of the optical beams produced by said light emitting diodes forming said light emitting diode array substantially coincides with the power of said optical beam produced by said reference light emitting diode; and (f) storing, each of said plurality of light emitting diode chips, the value of said first correction signal corresponding to a condition wherein the power of said optical beams produced by said light emitting diodes coincides with the power of said optical beam produced by said reference light emitting diode, in a non-volatile memory.

According to the present invention, the light emitting diodes forming the light emitting diode array produce the output optical beams with an optical power substantially identical to the power of the optical beam produced by the reference light emitting diode. Thereby, it is possible to detect and monitor the power of the optical beams produced by the light emitting diodes on the light emitting diode chip by monitoring the power of the optical beam that is produced by the reference light emitting diode.

In a preferred embodiment of the present invention, said driving signal produced in said step (d) controls one of a pulse width, a pulse number and a pulse amplitude of a driving current supplied to said light emitting diodes forming said light emitting diode array and to said reference light emitting diode for energizing the same.

Another object of the present invention is to provide a method for controlling an optical beam source including therein a plurality of light emitting diode chips, each of said plurality of light emitting diode chips carrying thereon a plurality of light emitting diodes forming a light emitting diode array, such that the time-dependent variation of the power of optical beams produced by said light emitting diodes is eliminated, said light emitting diodes forming said light emitting diode array on each of said light emitting diode array chips; said method comprising the steps of:

(a) detecting, in each of said plurality of light emitting diode chips, the power of a reference light emitting diode, said reference light emitting diode being produced on said light emitting diode chip together with said plurality of light emitting diodes forming said light emitting diode array and producing an optical beam with a power corresponding to the power of said optical beams produced by said plurality of light emitting diodes that form said light emitting diode array, to form a monitoring signal;

(b) comparing, in each of said plurality of light emitting diode chips, the power of said optical beam of said reference light emitting diode detected in said step (a), with a reference optical power level stored in a non-volatile memory, to obtain the difference between the power of said optical beam of said reference light emitting diode and said reference optical power level; and (c) controlling, in each of said plurality of light emitting diode chips, a drive current supplied to said light emitting diodes forming said light emitting diode array and said reference light emitting diode, such that said difference is minimized.

According to the present invention, it is possible to set the power of the optical beams produced by the light emitting diodes forming the light emitting diode array at a constant, predetermined level irrespective of the chip. Thereby, it is possible to construct an optical line printhead that forms an optical line image of an arbitrary horizontal scanning line length with a uniform intensity, by simply arranging an arbitrary number of the chips in a row.

In a preferred embodiment of the present invention, said reference light emitting diode is provided on each chip in a plural number in correspondence to a plurality of regions defined on said chip, said light emitting diode array being provided on each region of said chip, wherein said steps (a)–(c) are conducted in each of said regions on said chip.

In another preferred embodiment of the present invention, said reference light emitting diode is provided on said chip in a plural number, wherein said method further includes the steps of: (d) examining whether or not said drive current obtained in said step (c) has exceeded a predetermined threshold; and (e) selecting the next reference length emitting diode when said drive current has exceeded said predetermined threshold in said step (d).

Another object of the present invention is to provide an optical beam source for producing a plurality of optical beams, comprising:

a substrate having upper and lower major surfaces;

a plurality of light emitting diodes provided on said upper major surface of said substrate so as to align in a row in a first direction, each of said plurality of light emitting diodes having an edge surface facing a common, second direction substantially perpendicular to said first direction for emitting a first optical beam generally in said second direction, each of said light emitting diodes further having an upper principal surface for emitting a second optical beam therethrough generally in a third direction perpendicular to said upper principal surface of said light emitting diode;

an optical system for focusing said optical beams on a recording surface, said optical system comprising:

first reflection means for deflecting said first optical beams produced by said light emitting diodes in a fourth direction which is different from said second direction and which is generally perpendicular to said first direction;

second reflection means for deflecting said first optical beams deflected by said first reflection means in a fifth direction which is generally perpendicular to said first direction and which is generally opposite to said second direction, said second reflection means further deflecting said second optical beams in a sixth direction which is generally perpendicular to said first direction and which is generally opposite to said second direction;

third reflection means for causing first and second successive reflections in said first optical beams that have been deflected by said second reflection means, such that said first optical beams are deflected by substantially 90 degrees in each of said first and second reflections, such that said first optical beams travel in a seventh direction generally perpendicular to said first direction and generally opposite to said fifth direction, said third reflection means further causing third and fourth successive reflections in said second optical beams that have been deflected by said second reflection means, such that said second optical beams are deflected by substantially 90 degrees in each of said third and fourth reflections, such that said second optical beams travel in an eighth direction generally perpendicular to said first direction and generally opposite to said sixth direction;

a plurality of lenses aligned, with a predetermined pitch, in said first direction to form a lens array, said plurality of lenses being disposed in a path of said first and second optical beams traveling away from said third reflection means for focusing the same on an image plane; and fourth reflection means disposed in a path of said first optical beams passed through said lens array after reflection by said third reflection means, for deflecting said first optical beams in a ninth direction that is generally perpendicular to said first direction and pointing towards said image plane, such that said first optical beams are focused at respective, corresponding focal points of said second optical beam.

According to the present invention, one can use not only the optical beams emitted at the edge surfaces of the light emitting diodes but also the optical beams emitted at the upper principal surface of the light emitting diodes. Thereby, the efficiency of utilization of the optical power is substantially improved.

In a preferred embodiment of the present invention, said first reflection means and said fourth reflection means have respective mechanisms for adjusting a reflection angle of said first optical beams. Thereby, one can set the optical beam spots formed by the first optical beams to coincide exactly with the corresponding optical beam spots of the second optical beams.

In a preferred embodiment of the present invention, each of said light emitting diodes carries a beam shaping mask on said edge surface, for reducing a width of said first optical beam emitted therefrom, such that each of said first optical beams produced by said light emitting diodes has a reduced width in said first direction. According to the present invention, a spreading in the first optical beam spot at said image plane, caused as a result of deviation in the focal point between the first optical beams and the second optical beams, is effectively compensated for.

In another preferred embodiment of the present invention, each of said light emitting diodes carries a beam shaping mask on said upper principal surface, for reducing a width of said second optical beam emitted therefrom, such that each of said second optical beams produced by said light emitting diodes has a reduced width in said first direction. According to the present invention, a spreading in the second optical beam spot at said image plane, caused as a result of deviation in the focal point between the first optical beams and the second optical beams, is effectively compensated for.

In a preferred embodiment of the present invention, said optical system comprises optical path modification means provided in the path of said first optical beams for modifying the optical path length. By providing the optical path modification means in the optical path of the first optical beams, one can set the effective path length of the first optical beams to be substantially identical with the path length of the second optical beams.

In another preferred embodiment of the present invention, said optical path modification means comprises a cylindrical surface provided on said first reflection means for reflecting said first optical beams with a negative power.

In another preferred embodiment of the present invention, said optical path modification means comprises a convex lens provided on a path of said second optical beams for reducing the path length of said second optical beams.

In another preferred embodiment of the present invention, said optical system includes a moving mechanism for moving said optical path modification means for changing the optical path of said first optical beams with respect to the optical path of said second optical beams.

In another preferred embodiment of the present invention, said optical system includes optical shielding means for separating said first optical beams and said second optical beams from each other.

In another preferred embodiment of the present invention, said light emitting diodes are disposed on said substrate such that said upper principal surface of said light emitting diodes is oriented substantially perpendicularly to a path of said second optical beams passed through said lens array and traveling toward said image plane.

In another preferred embodiment of the present invention, each of said light emitting diodes carries a transparent electrode on said upper principal surface for injecting carriers therein.

In another preferred embodiment of the present invention, said optical system includes shutter means for selectively interrupting one of said first and second optical beams. By selecting the first optical beams having a flat beam cross section with a reduced height, one can increase the dot density in the vertical scanning direction when the optical beam source is applied to an optical printer, as compared with the case wherein the second optical beams are used.

In a still other preferred embodiment of the present invention, said shutter means includes a concave lens such that said concave lens is inserted into the path of said first optical beams when said shutter means is activated to interrupt said second optical beams.

Another object of the present invention is to provide a light emitting diode for emitting optical beams in mutually different directions, comprising:

a substrate of a semiconductor material having upper and lower major surfaces and doped to a first conductivity type;

first cladding layer of a semiconductor material doped to said first conductivity type and having a first bandgap, said first cladding layer having upper and lower major surfaces and provided on said upper major surface of said substrate;

an active layer of an undoped semiconductor material having a second bandgap smaller than said first bandgap, said active layer having upper and lower major surfaces and provided on said upper major surface of said first cladding layer, said active layer producing optical radiation as a result of recombination of carriers taking place in said active layer;

second cladding layer of a semiconductor material doped to a second, opposite conductivity type and having a third bandgap larger than said second bandgap, said second cladding layer having upper and lower major surfaces and provided on said upper major surface of said active layer;

said first cladding layer and said second cladding layer forming, together with said active layer, a layered structure having an upper major surface and an edge surface extending substantially perpendicularly to said upper major surface of said substrate, said layered structure outputting a first optical beam from said active layer at said edge surface as a result of said optical radiation produced in said active layer;

lower electrode means provided on said lower major surface of said substrate for injecting carriers of a first polarity into said active layer; and upper electrode means provided on said upper major surface of said layered structure for injecting carriers of a second, opposite polarity into said active layer, said upper electrode means being substantially transparent to said optical radiation produced in said active layer for emitting a second optical beam therethrough in a direction generally perpendicular to said upper major surface of said layered structure.

According to the present invention, one can obtain two, different optical beams emitting in two, different directions, wherein the first optical beam emitted from the edge surface of the layered structure has a smaller beam size suitable for high density recording, while the second optical beam emitted from the upper electrode means has a large beam size suitable for a coarse pitch recording. By employing the first and second optical beams simultaneously, one can increase the efficiency of use of the optical radiation produced in the active layer of the light emitting diode as a result of the recombination of carriers.

Other objects and further features of the present invention will become apparent from the following detailed description when read in conjunction with the attached drawings.

DETAILED DESCRIPTION OF PREFERRED EMBODIMENTS

Figure 7:
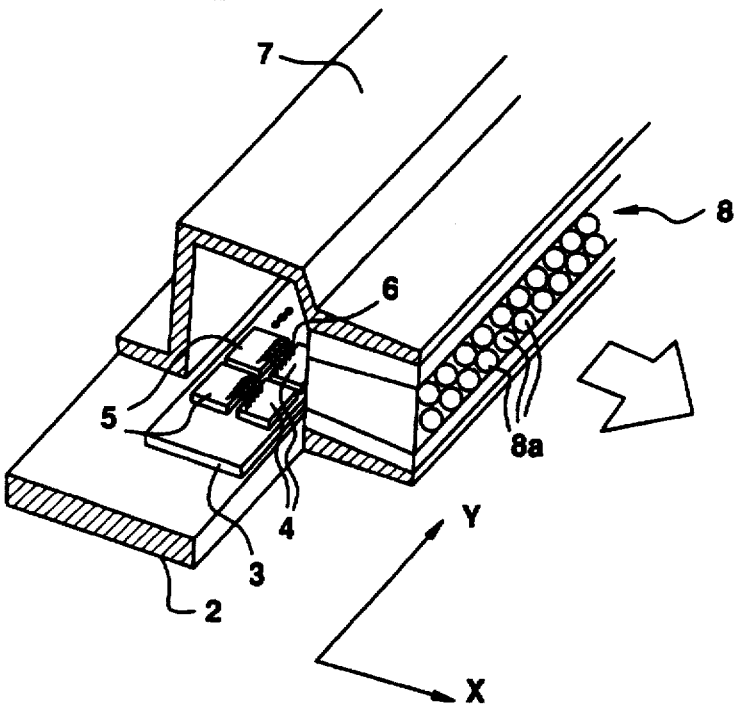
FIG. 7 is a diagram showing the construction of an optical line printhead according to a first embodiment of the present invention.

FIG. 7 shows the overall construction of an optical line printhead 1 according a first embodiment of the present invention.

Referring to FIG. 7, the optical line printhead 1 is constructed on an aluminum plate 2 acting as a heat sink, wherein the aluminum plate 2 carries thereon a ceramic substrate 3 typically of alumina or AlN extending in a Y-direction coincident to the horizontal scanning direction of a xerographic printer that uses the optical line printhead 1. The ceramic substrate carries thereon a number of LED chips 4 aligned in the Y-direction and corresponding driver integrated circuits 5 also aligned in the Y-direction, wherein the LED chips 4 and the corresponding driver integrated circuits 5 are connected with each other by bonding wires 6. Each of the LED chips 4 includes a plurality of LEDs aligned in the Y-direction as will be described later, and each LED on the LED chip 4 produces an optical beam in the X-direction in response to the electric energization supplied to the LED chip 4 from the driver integrated circuit 5.

The LED chips 4 and the driver integrated circuits 5 are covered by a cover member 7 also of aluminum, wherein the cover member 7 carries on a part thereof a SELFOC lens array 8 including a plurality of lenses 8*a* aligned in the X-direction for emitting the optical beams in the X-direction. It should be noted that the LED chips 4 are aligned in the Y-direction with a number corresponding to the length of the horizontal scanning line of the xerographic printer. Thereby, the printer that uses the optical line printhead 1 of FIG. 7 does not need a complicated scanning mechanism such as a rotary polygonal mirror for deflecting the optical beam along the horizontal scanning line. The optical beams thus radiated in the X-direction are focused upon a rotary photosensitive drum forming a part of the xerographic printer.

Figure 8:
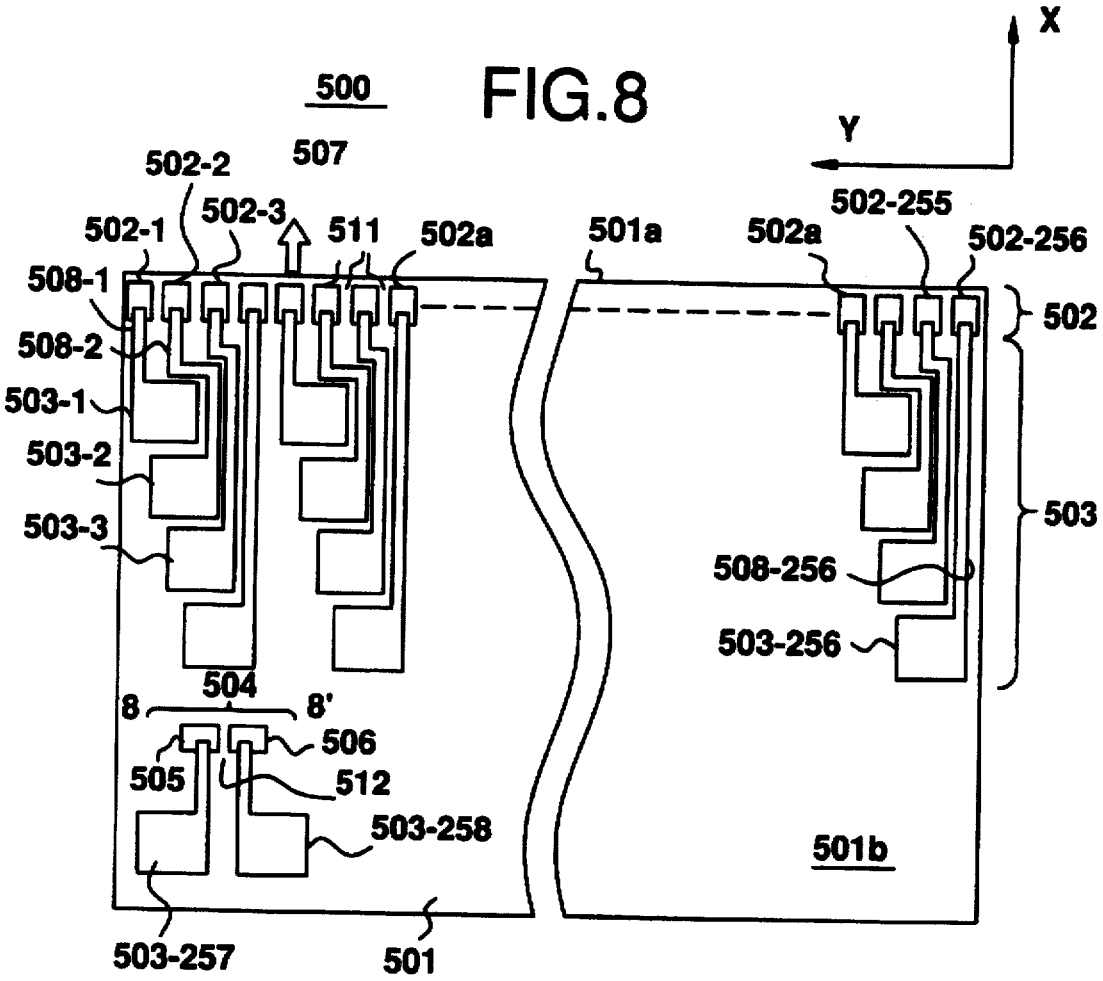
FIG. 8 is a diagram showing the construction of an LED chip used in the optical line printhead of FIG. 7 in a plan view.

FIG. 8 shows an LED chip 500 corresponding to the chip 4 of FIG. 7 in a plan view.

Figure 1:
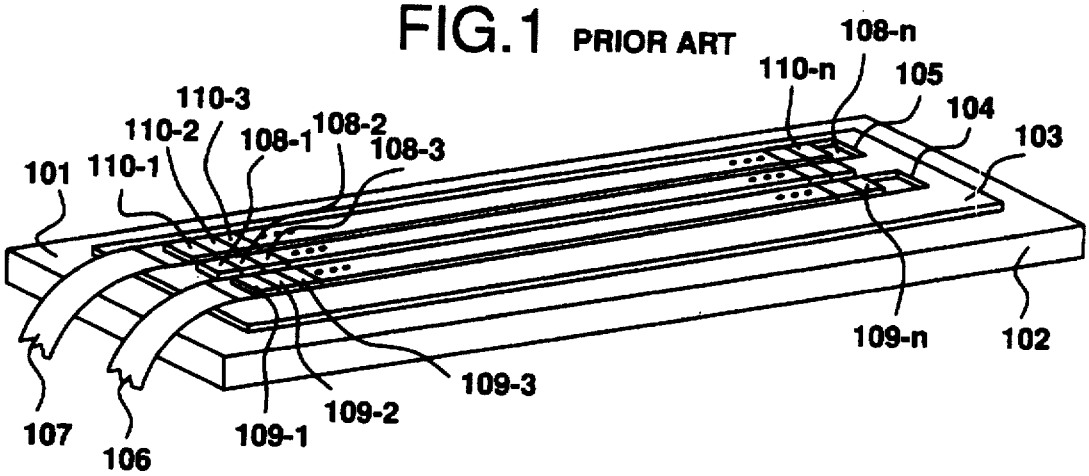
FIG.1 PRIOR ART
FIG. 1 is a diagram showing the construction of a conventional LED chip array used in a conventional optical line printhead.
Figure 2:
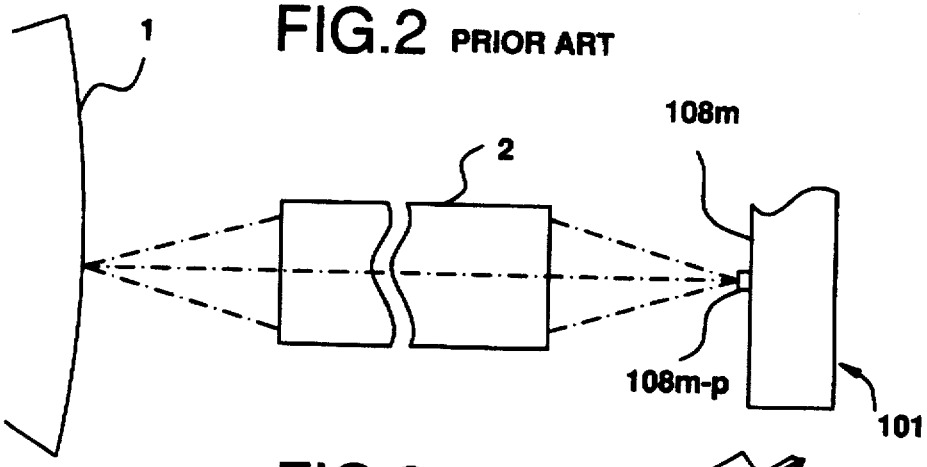
FIG.2 PRIOR ART
FIG. 2 is a diagram showing the construction of the conventional optical line printhead that uses the LED chip array of FIG. 1.
Figure 3:
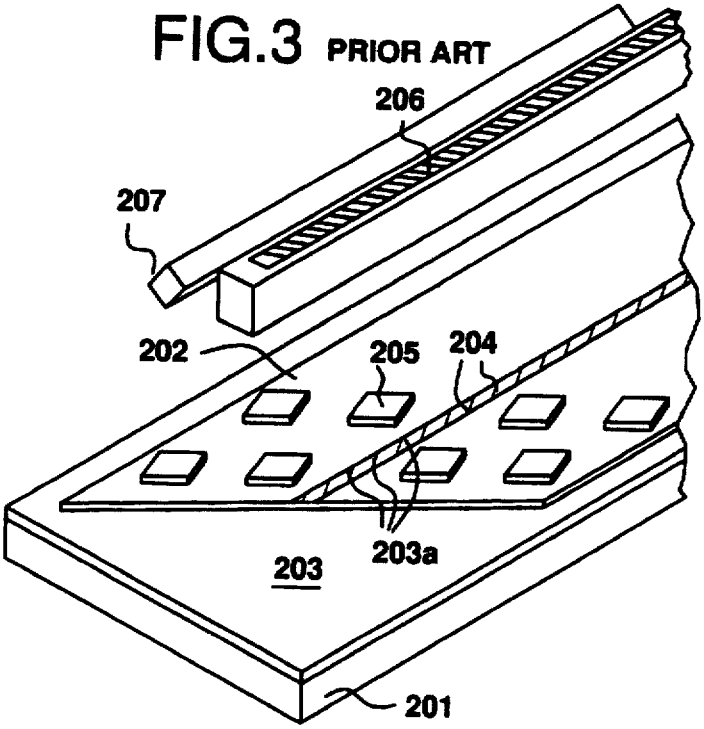
FIG.3 PRIOR ART
FIG. 3 is a diagram showing the construction of another conventional optical line printhead that uses an array of surface emission type LED chips.
Figure 4:
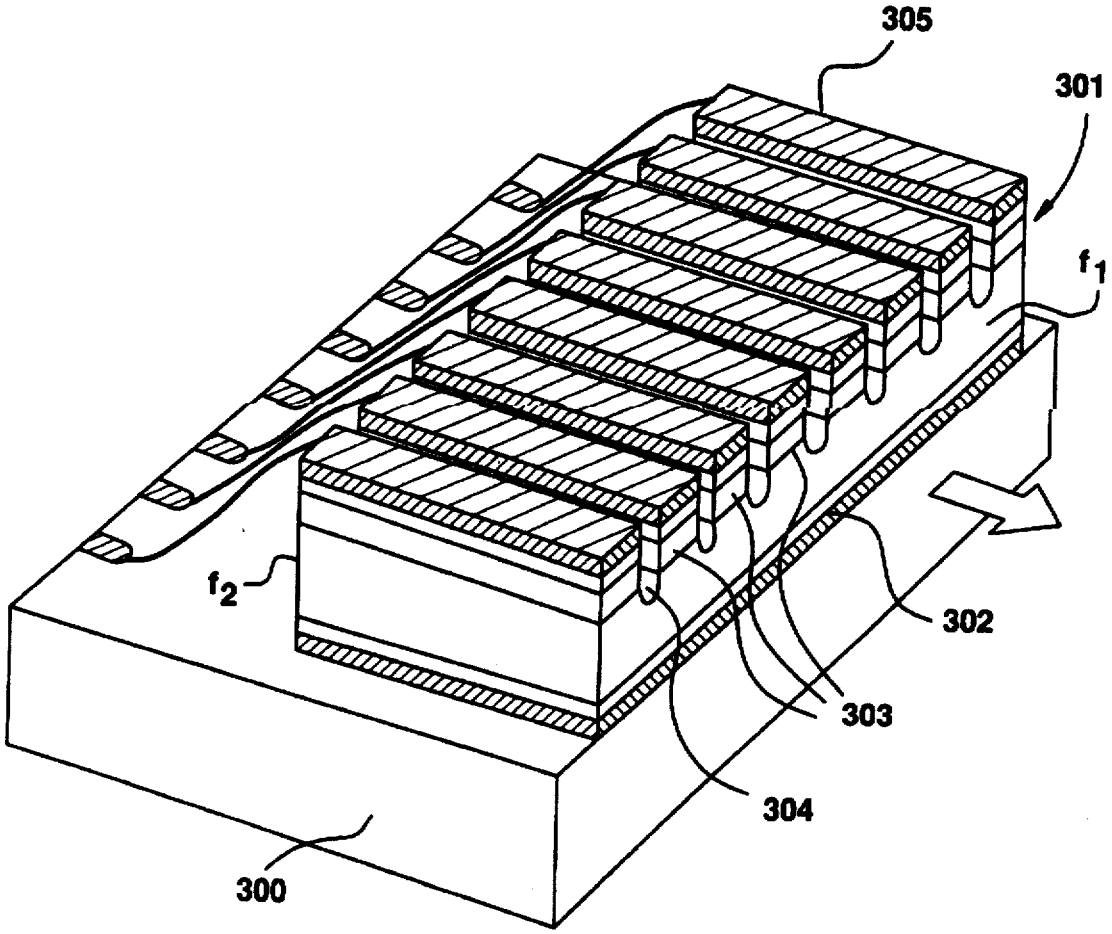
FIG.4 PRIOR ART
FIG. 4 is a diagram showing the construction of a conventional edge emission type LED chip.
Figure 5:
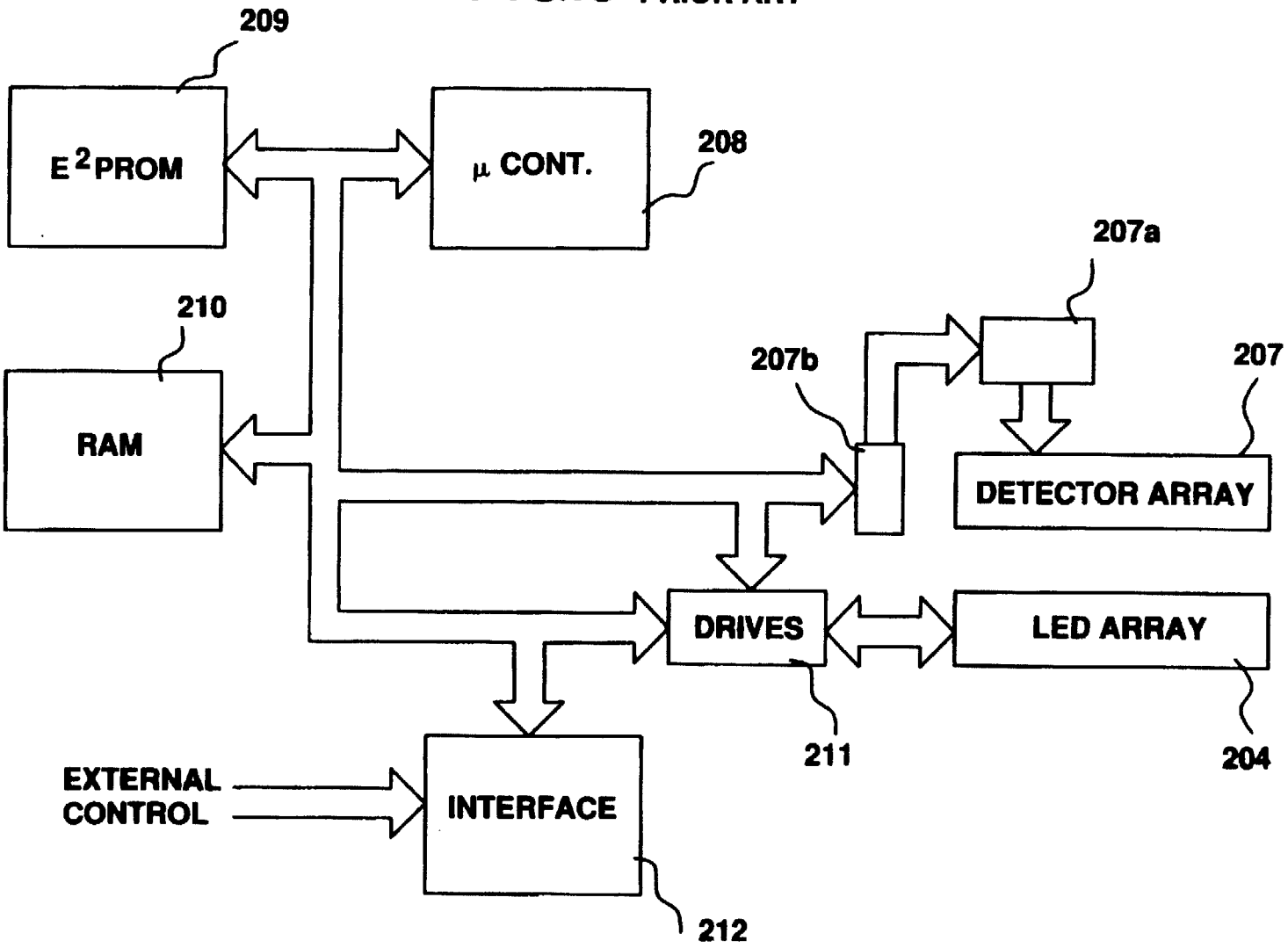
FIG.5 PRIOR ART
FIG. 5 is a block diagram showing the construction of a feedback control system used in the optical line printhead of FIG. 3.
Figure 6:
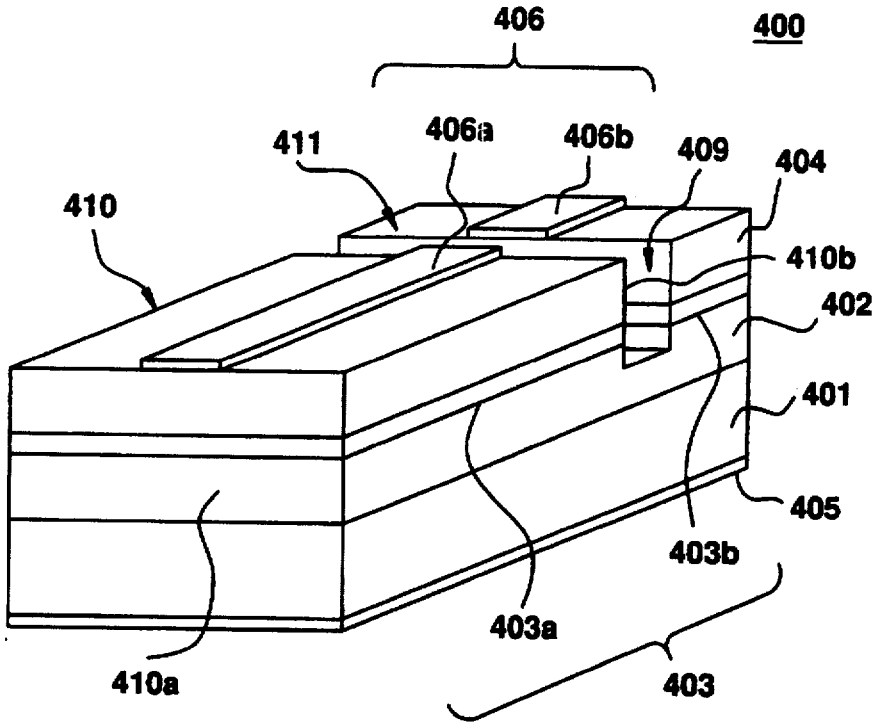
FIG.6 PRIOR ART
FIG. 6 is a diagram showing the construction of a conventional laser diode that includes a photodiode formed unitarily thereto.

Referring to FIG. 8, the LED chip 500 has an edge-emission type construction similar to the LED chip of FIG. 4 and includes a GaAs substrate 501 doped to the n-type. The GaAs substrate 501 has a front edge 501*a* and an upper major surface 501*b*, wherein a number of LEDs $502_{-1}$–$503_{-256}$ designated collectively as 502 are provided on the upper major surface 501*b* of the substrate 501 in the vicinity of the front edge 501*a* in alignment thereto. Each of the LEDs 502 has a front edge 502*a* facing commonly in the X-direction for emitting an optical beam 507 as indicated by the arrow. Further, a plurality of bonding pads $503_{-1}$–$503_{-256}$ collectively designated as 503 are provided on the upper major surface 501*b* of the substrate 501, together with corresponding interconnection patterns $508_{-1}$–$508_{-256}$ that connect the bonding pads 503 to the corresponding LEDs 502. The LEDs 502 have the same construction as those of the LED chip of FIG. 4 and are separated from each other in the Y-direction by an isolation groove 511.

In the LED chip 500 of FIG. 8, it should be noted that there is provided another LED 505 on the upper major surface 511 of the substrate 501 in the vicinity of a rear edge opposite to the front edge 501*a*, with a construction identical to the LEDs 502 except for the orientation, for emitting an optical beam in the Y-direction. In correspondence to the LED 505, a photodiode 506 having a construction identical to the LED 505 is provided on the upper major surface 501*b* of the substrate 501 so as to face the LED 505 in the Y-direction, for detecting the optical beam emitted from the LED 505. In order to energize the LED 505, a bonding pad $503_{-257}$ is provided on the upper major surface 501*b* of the substrate 501 in electrical connection with the LED 505. Similarly, a bonding pad $503_{-258}$ is provided on the upper major surface 501*b* of the substrate 501, wherein the bonding pad $503_{-258}$ is connected electrically to the photodiode 506 by an interconnection pattern and an output voltage of the photodiode 506 appears on the bonding pad $503_{-258}$.

Figure 9:
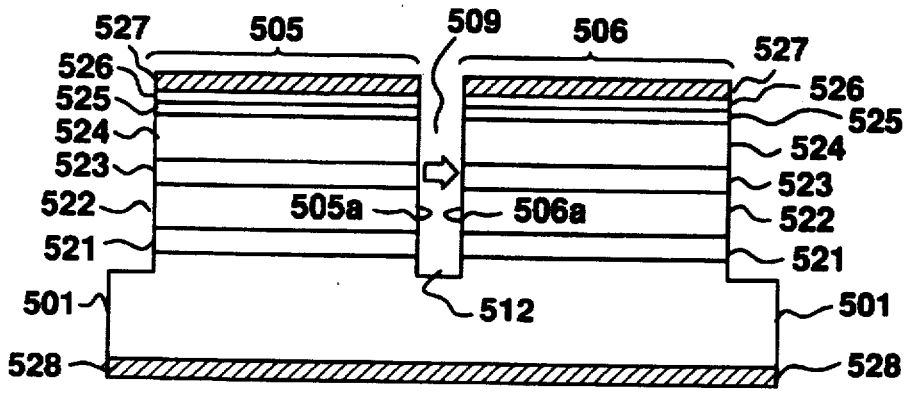
FIG. 9 is a diagram showing the construction of a monitoring element provided on the LED chip of FIG. 8 in a cross sectional view.

Next, the layered structure of the LED chip 500 will be described with reference to FIG. 9 showing a cross sectional view taken along a line 8—8' of FIG. 8. As the structure of the LEDs 502 is identical with the structure of the LED 505, only the LED 505 and the corresponding photodiode 506 will be described.

Referring to FIG. 9, the LED chip 500 includes a buffer layer 521 of n-type GaAs deposited on the GaAs substrate 501 by an MOVPE process with a thickness of 500 nm, and a cladding layer 522 of n-type AlGaAs having a composition of $Al_{0.4}Ga_{0.6}As$ is deposited on the buffer layer 521 also by an MOVPE process with a thickness of 1200 nm. Further, an active layer 523 of undoped AlGaAs having a composition of $Al_{0.2}Ga_{0.2}As$ is deposited on the cladding layer 522 by an MOVPE process with a thickness of 50 nm.

On the active layer 523, another cladding layer 524 of p-type AlGaAs having a composition of $Al_{0.4}Ga_{0.6}As$ is deposited also by an MOVPE process with a thickness of 1200 nm, and a cap layer 525 of p-type GaAs is deposited further on the cladding layer 524 by an MOCVD process with a thickness of about 200 nm. Further, a contact layer 526 of $p^+$-type GaAs is deposited on the cap layer 525 by an MOCVD process with a thickness of 100 nm.

The layered structure thus formed on the substrate 501 is then subjected to an etching process to form the individual LEDs 502 and 505 as well as the photodiode 506, and a p-type electrode 527 having an Au-Zn/Au structure is provided on the upper major surface of the contact layer 526 of the LEDs 502 and 505 as well as of the photodiode 506 thus formed. Further, an n-type electrode having an Au-Ge/Ni/Au structure is provided on the entirely of the lower major surface of the substrate 501. See the cross sectional view of FIG. 9.

In the LEDs 502 or 505 thus formed as well as in the photodiode 506, it should be noted that the cladding layers 522 and 524 have a bandgap substantially larger than the bandgap of the active layer 523, and there is formed a double-hetero structure suitable for carrier confinement in the active layer 523. Thereby, efficient emission of light is obtained in the active layer 523 as a result of recombination of the carriers. In order to obtain the operation of LED rather than laser diode, it is preferable to set the composition of the cladding layers 522 and 524 such that the bandgap of the cladding layers does not exceed 0.3 eV. The AlGaAs layer forming the active layer 523 preferably contains Al with a mole ratio of 0.45 or less with respect to Ga.

In the LED chip 500 of FIG. 8, it should be noted that the LED 505 and the corresponding photodiode 506 are used for monitoring the optical output of the LEDs 502 forming the LED array. It should be noted that the LED 505, being formed simultaneously with the LEDs 502 by etching of a common layered structure on the substrate 501, has the same construction as the LEDs 502. Accordingly, the output power of the optical beam 509 produced by the LED 505 represents the output power of the optical beams produced by the LEDs 502 forming the LED array. By monitoring the output power of the optical beam 509, therefore, it is possible to monitor the output power of the optical beams 507 produced by the LEDs 502. Thus, the LED 505 and the photodiode 506 form a monitoring element 504 formed monolithically on the substrate 501. Since the LED 505 radiates the output optical beam in the direction in the Y-direction that is substantially perpendicular to the X-direction in which the optical beams are radiated from the LEDs 502, the detection of the optical power by the photodiode 506 does not affect the optical beams produced by the LEDs 502 and a reliable monitoring of the optical power becomes possible.

When forming the structure of FIG. 8 and FIG. 9, it is essential that the LEDs 502 and 505 as well as the photodiode 506 have an edge surface such as the surface 502*a* shown in FIG. 8 and the surface 505*a* and 506*a* shown in FIG. 9 extending perpendicularly to the upper major surface 501*b* of the GaAs substrate 501. By forming the edge surfaces 502*a* to be perpendicular to the upper major surface 501*b* of the substrate 501, the optical beams produced from the LEDs 502 travel in the X-direction along a plane parallel to the upper major surface 501*b* of the substrate 501. Further, it is essential that the edge surfaces 505*a* of the LED 505 and 506*a* of the photodiode, facing with each other across an isolation groove 512 that reaches the substrate 501, extend perpendicularly to the upper major surface 501*b* of the substrate 501. When the surfaces 505*a* and 506*a* are not parallel to each other, the optical beam produced in the active layer 523 of the LED 505 does not enter the active layer 523 of the photodiode 506, and the proper detection of the optical power of the optical beam is no longer achieved. Similarly, even when the surfaces 505*a* and 506*a* are parallel to each other, the optical beam produced in the active layer 523 of the LED 505 and emitted perpendicularly to the edge surface 505*a*, which forms an oblique angle with respect to the upper major surface 501*b* of the substrate 501, would miss the active layer 523 of the corresponding photodiode 506. In this case, too, one cannot obtain the proper detection of the optical beam power of the LED 505.

Figure 10:
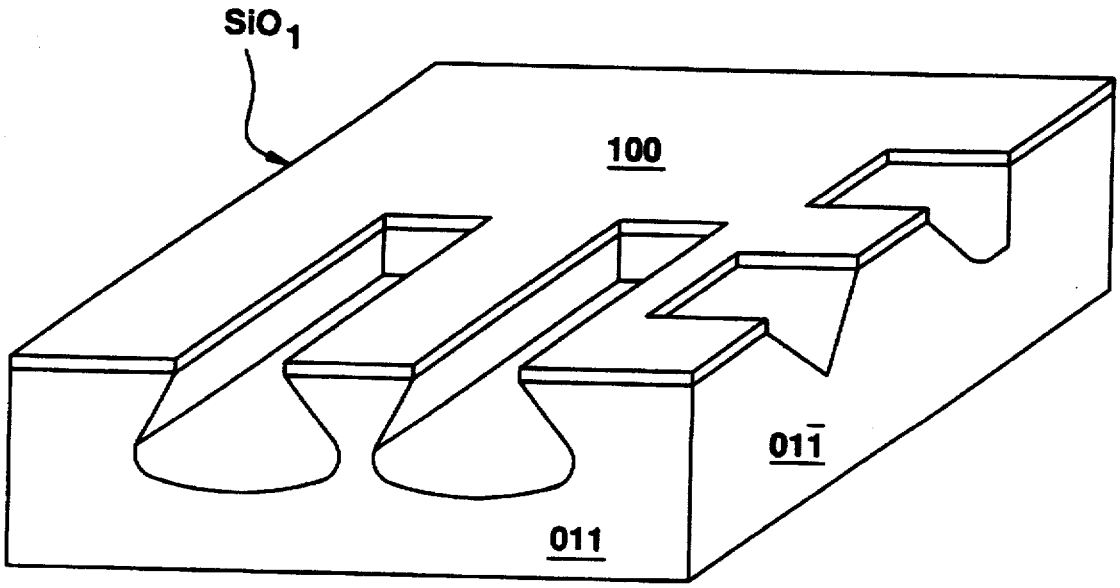
FIG. 10 PRIOR ART
FIG. 10 is a diagram showing a problem encountered when fabricating the structure of FIG. 8.

When the structure of FIGS. 8 and 9 is formed by the conventional wet etching process, one encounters a difficulty in obtaining the edge surfaces that are perpendicular to the upper major surface 501*b* for both the LEDs 502 forming the array and the LED 505 or the photodiode 506, as the edge surface 502*a* of the LEDs 502 is oriented in the X-direction while the edge surfaces 505*a* and 506*a* of the LED 505 and the photodiode 506 are oriented in the Y-direction. As shown in FIG. 10 showing the crystal surface obtained in the III-V compound semiconductor substrate by a wet etching process that typically employs a $Br_2$—$CH_3OH$ etching solution, there develops a significant anisotropy in the etching rate of the crystal surface, and it is generally impossible to obtain the desired vertical edge for both the edge 502*a* oriented in the X-direction and the edges 505*a* and 506*a* oriented in the Y-direction.

In order to overcome the problem outlined above, the present invention employs a reactive ion beam etching (RIBE) process that is conducted in an evacuated environment with a pressure in the order of $4\times10^{-2}$ Pa while using an etching gas typically containing Cl such as $Cl_2$, $CCl_2F_2$, $CHF_3$, etc. More specifically, the substrate 501 carrying thereon the layered semiconductor structure described before is provided with a mask and is placed in a reaction vessel of a RIBE apparatus after patterning the mask in accordance with the shape of the LEDs 502, 505 and the photodiode 506. In the RIBE apparatus, the etching gas is excited by the plasma formed as a result of ECR (electron cyclotron resonance), and the reactive species formed as a result of the excitation reacts with the exposed surface of the layered semiconductor structure on the substrate 501. Thereby, one obtains a vertical edge surface for the LEDs 502 and 505 as well as for the photodiode 506.

The following TABLE I summarizes the performance of the LED chip described above.

TABLE I

| | |
|---|---|
| dpi | 600 |
| number of LEDs | 256 |
| wavelength | 760 ± 10 nm |
| optical power | 15 μW (20 mA) |
| optical power variation in chip | <±5% |
| LED structure | double hetero |
| LED material | AlGaAs |

It will be noted that the variation of the optical power is held within ±5% for the LEDs formed commonly on a single chip.

In the LED chip 500 of FIG. 8, one may use other material system such as InGaAs, AlGaInP, InP, InGaAsP, InGaP, GaAsP, GaN, . . . such that a double-hetero structure is formed in correspondence to the active layer 523. Further, one may reverse the conductivity type of the epitaxial layers in the structure of the LEDs 502 or 505.

When constructing the optical line printhead by using the LED chip 500, it is necessary that the output power of the optical beams is set at a predetermined, constant level irrespective of the chips used in the optical line printhead. In order to achieve such a homogenization of the optical power of the LED chips, the optical line printhead uses a feedback control system shown in FIGS. 11(A) and 11(B), wherein FIG. 11(A) shows a construction for setting the optical power of the LEDs on the chip 500 at the foregoing predetermined level when assembling the optical line printhead, while FIG. 11(B) shows a construction for compensating for the variation of the optical power of the LEDs on the chip 500 during the use of the optical line printhead.

Figure 11A:
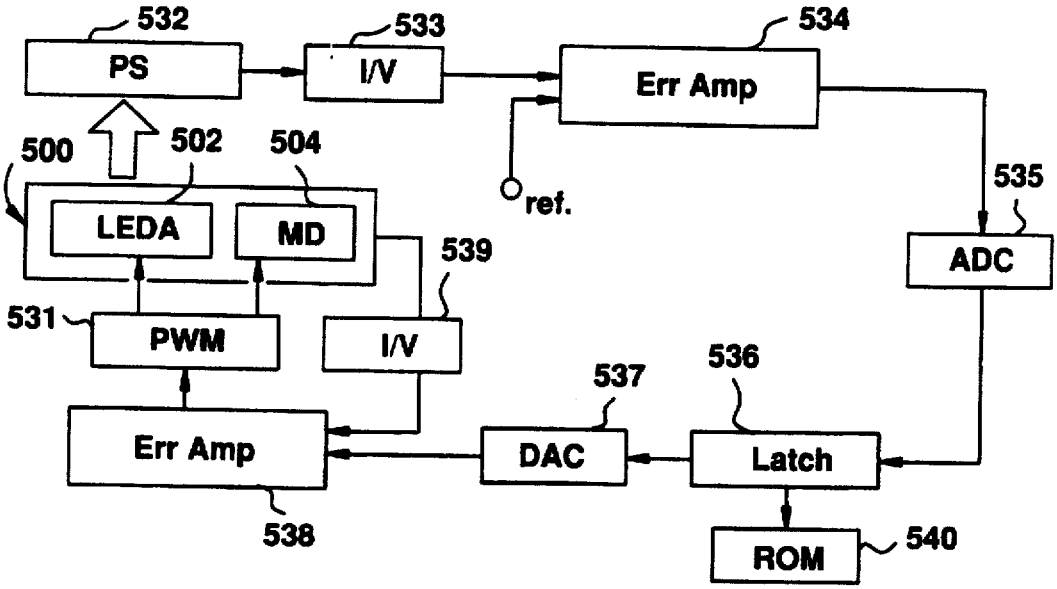
FIG. 11(A) is a block diagram showing the feedback control system for setting the optical power of the LED chips when assembling the optical line print head.
Figure 11B:
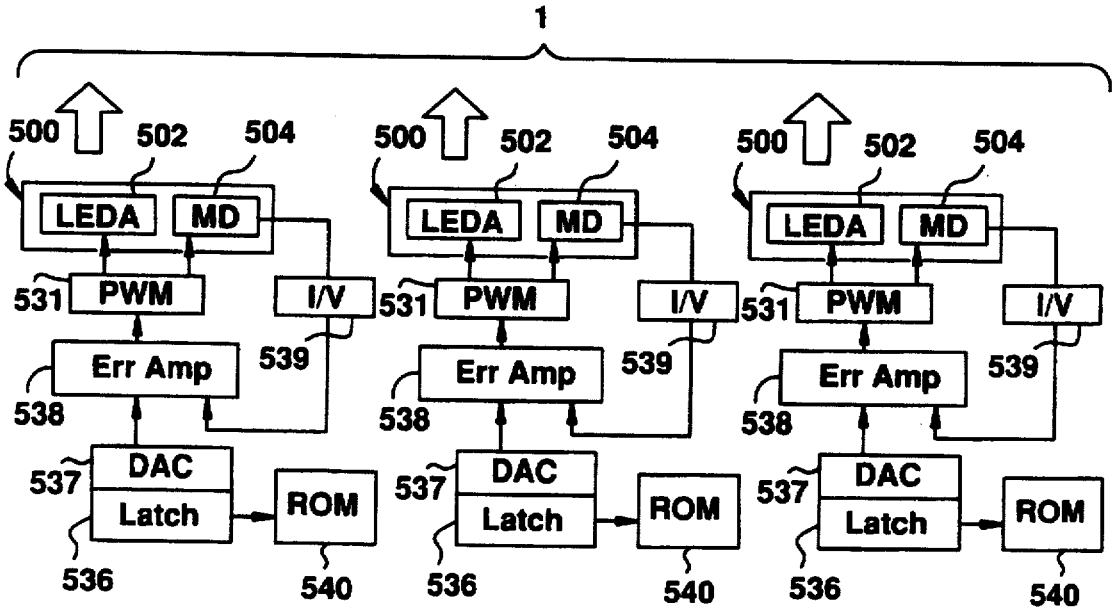
FIG. 11(B) is a block diagram showing the feedback control system employed for maintaining the power of the optical beams constant in each of the LED chips forming the optical line printhead.

Referring to FIG. 11(A), the LEDs 502 forming the LED array on the chip 500 are energized by a driver circuit 531 that supplies a drive pulse current to each of the LEDs 502, and the output optical power of the optical beams produced by the LEDs 502 is detected by an external optical power sensor 532. As the variation of the output optical power is less than ±5% for the LEDs on the common LED chip, the output optical power of a single LED in the LED array represents the output optical power of the LEDs 502 on the chip 500. The optical power of the LED 502 thus detected by the external photosensor 532 is converted to a voltage signal by a current-voltage converter 533 and supplied to an analog error amplifier 534. The analog error amplifier 534 compares the level of the input voltage signal supplied thereto from the current-voltage converter 533 with a reference voltage level "ref," and produces an output voltage signal corresponding to the output voltage of the converter 533 except that the difference between the output voltage of the current-voltage converter 533 and the reference voltage level "ref" is compensated for. Typically, the reference voltage level "ref" is set to a level corresponding to about 15 μW. The output voltage thus produced by the error amplifier 533 is converted to a digital signal in an A/D converter 535, and the output digital signal thus formed is held in a latch circuit 536.

The digital signal held in the latch circuit 536 is further converted to an analog signal in a D/A converter 537 and the analog signal thus formed is supplied to another analog error amplifier 538. The analog error amplifier 538 is further supplied with the output signal of the photodiode 506 included in the monitoring element 504 via a current-voltage converter 539 and produces an output signal indicative of the difference between the signal that has been supplied from the latch circuit 536 via the D/A converter 537 and the signal supplied from the monitoring element 504 via the current-voltage converter 539. Thereby, there is formed a feedback loop for controlling the driver circuit 531 in response to the output signal of the error amplifier 538 such that the difference between the foregoing two input signals to the error amplifier 538 is minimized. The energization of the LEDs on the chip 500 is changed for example according to the pulse-width modulation process wherein the width of the driving pulses supplied to the LEDs is changed in response to the output of the error amplifier 538. Of course, one may use other pulse modulation processes for controlling the LEDs in the chip 500.

In the system of FIG. 11(A), it should be noted that the output power of the optical beams produced by the LEDs 502 changes when the energization of the LED is changed as a result of the feedback control applied via the feedback path that includes the monitoring element 504. Thereby, the input signal supplied to the error amplifier 538 via the other feedback loop that includes the error amplifier 534 and the latch 536 changes also, and the operation of the system of FIG. 11(A) gradually approaches a convergent state wherein the optical power of the LEDs 502 is set equal to the predetermined reference optical power given in the form of the reference voltage level "ref." When the convergence of operation is established, the level of the optical output held in the latch circuit 536 is written into a non-volatile memory 540 as a predetermined, reference output power. In the construction of FIG. 11(A), it should be noted that the driver circuit 531, the latch circuit 540, the D/A converter 537, the error amplifier 538, the current-voltage converter 539 and the non-volatile memory 540 are provided in correspondence to each of the LED chips 500. As already noted, the system of FIG. 11(A) is used when assembling the optical line print head.

Next, the system of FIG. 11(B) for compensating for the deviation of the optical power of the LEDs 502 during the operation of the optical line printhead will be described.

Referring to FIG. 11(B), the LEDs 502 on the chip 500 are driven by the driver circuit 531 similarly to the case of FIG. 11(A). Further, the monitoring element 504, the current-voltage converter 539 and the error amplifier 538 form a feedback control loop similarly to the system of FIG. 11(A). In the system of FIG. 11(B), on the other hand, the data stored in the non-volatile memory 540 indicative of the predetermined reference optical output power of the LED is read out and held in the latch circuit 536. Further, the data thus held in the latch circuit 536 is transferred to the error amplifier 538 via the D/A converter 537, and the error amplifier 538 controls the drive circuit 531 such that the difference between the output of the current-voltage converter 539 and the output of the D/A converter 537 minimized. Thereby, the output optical power of the LEDs 502 on the chip 500 is set at the reference power level stored in the non-volatile memory 540, irrespective of the chip. In other words, the LED chips 500, shown in FIG. 11(B) and arranged in a row in the optical line printhead 1 (see FIG. 7), show the same optical characteristic with respect to the power of the optical beams.

Figure 12A:
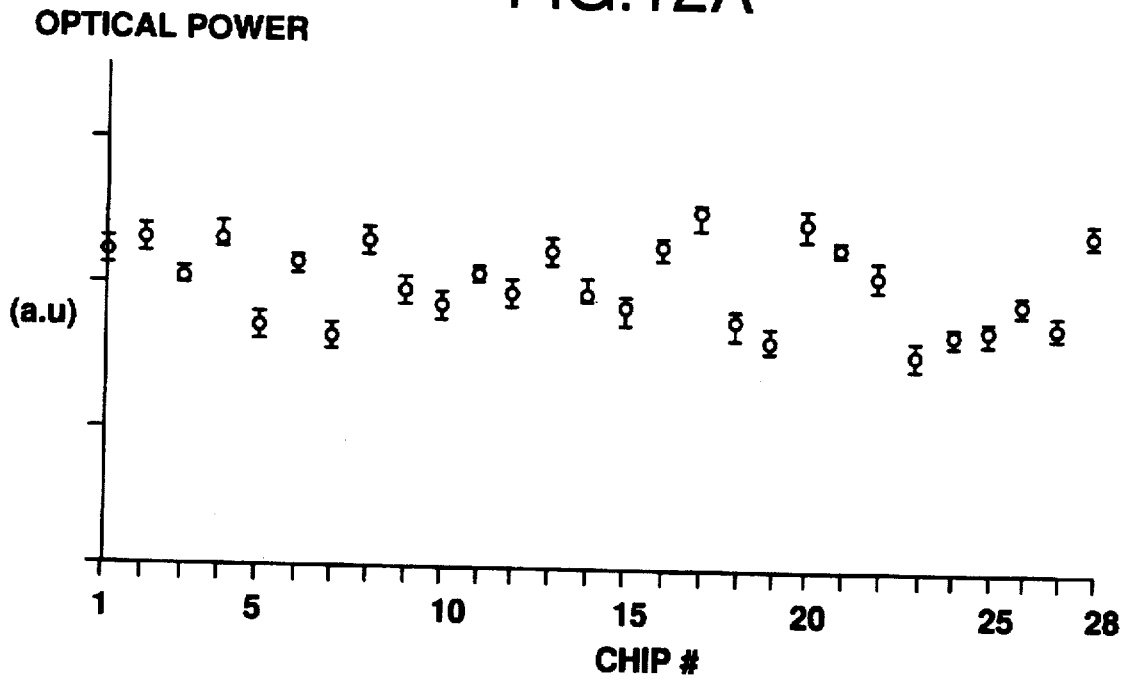
FIG. 12(A) shows the chip-to-chip variation of the power of the optical beams obtained without applying the feedback control to the optical power on the LED chips.
Figure 12B:
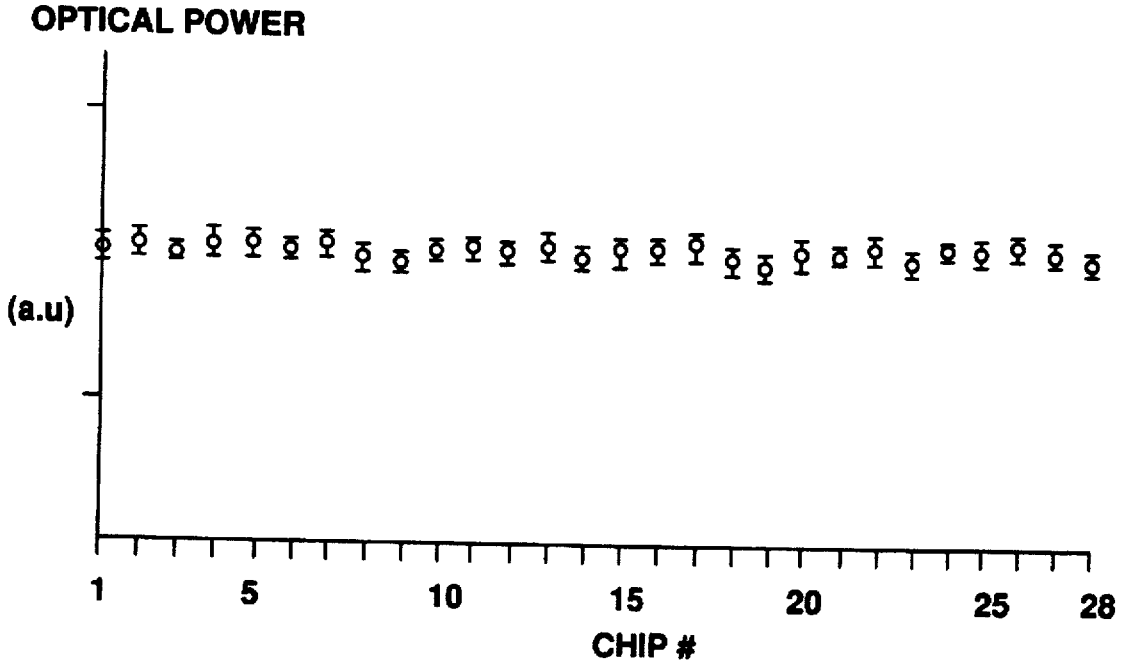
FIG. 12(B) shows the chip-to-chip variation in the power of the optical beams obtained under the feedback control applied to the power of the optical beams.

FIG. 12(A) shows the optical power obtained by the LED chips 500 that are not subjected to the feedback control described with reference to FIGS. 11(A) and 11(B), while FIG. 12(B) shows the optical power of the optical beams produced by the LED chips 500 that are subjected to the feedback control. In FIGS. 12(A) and 12(B), the vertical axis is represented with the same scale. As will be noted, the chip-to-chip variation of the optical power is substantially reduced when the feedback control system of FIG. 12(B) is employed.

The result of FIG. 12(B) indicates that one can construct an optical line printhead of an arbitrary size for the horizontal scanning direction by simply increasing the number of the LED chips and the corresponding feedback control circuit including the non-volatile memory 540, in the optical line printhead. The following TABLE II shows the performance of the optical line printhead constructed by arranging the LED chips 500. As noted from TABLE II, one can suppress the chip-to-chip variation of the optical power to be less than ±10%.

TABLE II

| | |
|---|---|
| dot density | 600 dpi |
| effective size | A3 |
| effective dots | 7021 dots |
| optical power after passing through optical system | 0.3 μW/dot (2 mA) |
| optical system | SELFOC array |
| chip-to-chip optical variation | <±10% |

Next, a second embodiment of the present invention will be described with reference to FIG. 13.

Figure 13:
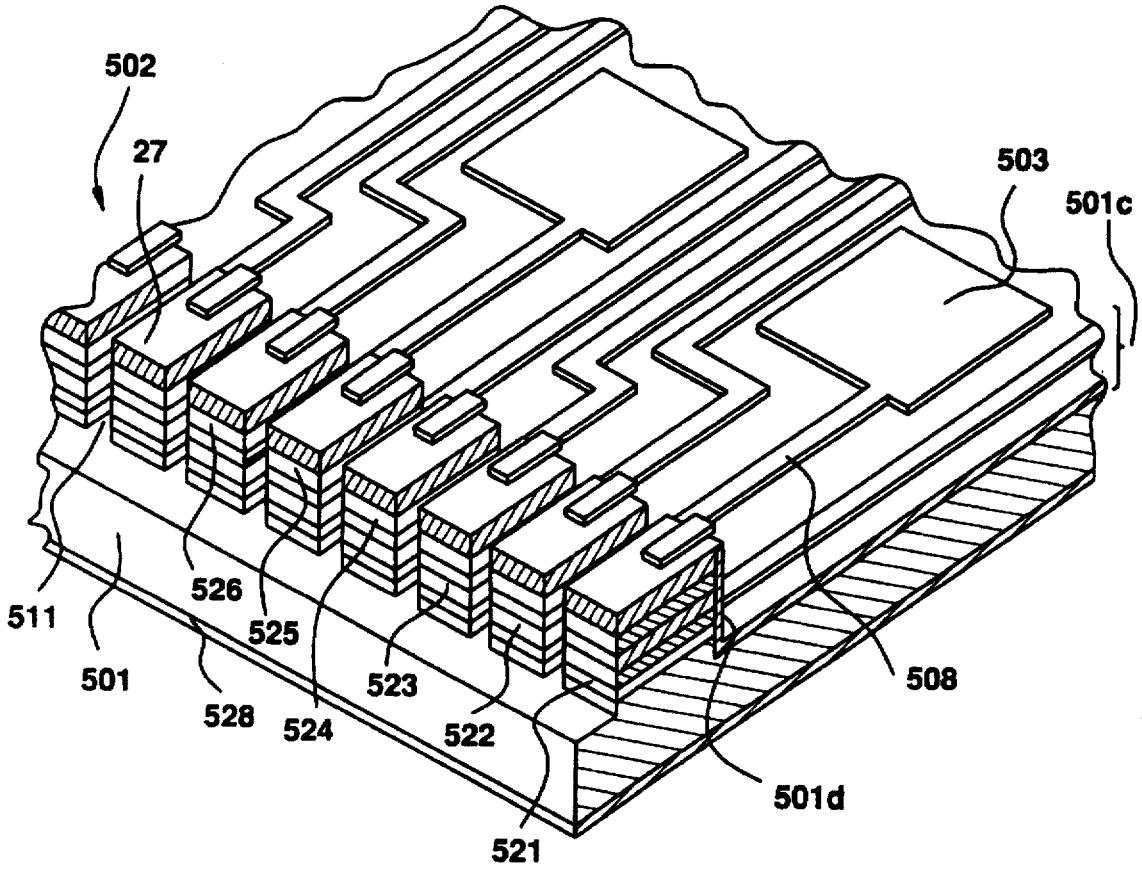
FIG. 13 is a diagram showing the construction of an LED chip according to a second embodiment of the present invention.

In the embodiment of FIG. 13, a layer 501*c*, which may include a stacking of different layers, is provided on the upper major surface 501*b* of the substrate 501 in correspondence to the part located behind the rear edge of the LEDs 502 forming the LED array, and the bonding pads 503 as well as the interconnection patterns 508 are provided on the upper major surface of the layer 501*c*. By providing the layer 501*c*, the step formed in the conductor pattern 508 in correspondence to the rear edge of the LEDs 502 is substantially reduced, and the risk that the interconnection pattern is damaged or disconnected at the rear edge of the LEDs 502 is substantially reduced. The layer 501*c* is isolated from the rear edge of the LEDs 502 by an insulating film 501*d* which may be formed of $SiO_2$ or SiN.

Figure 14:
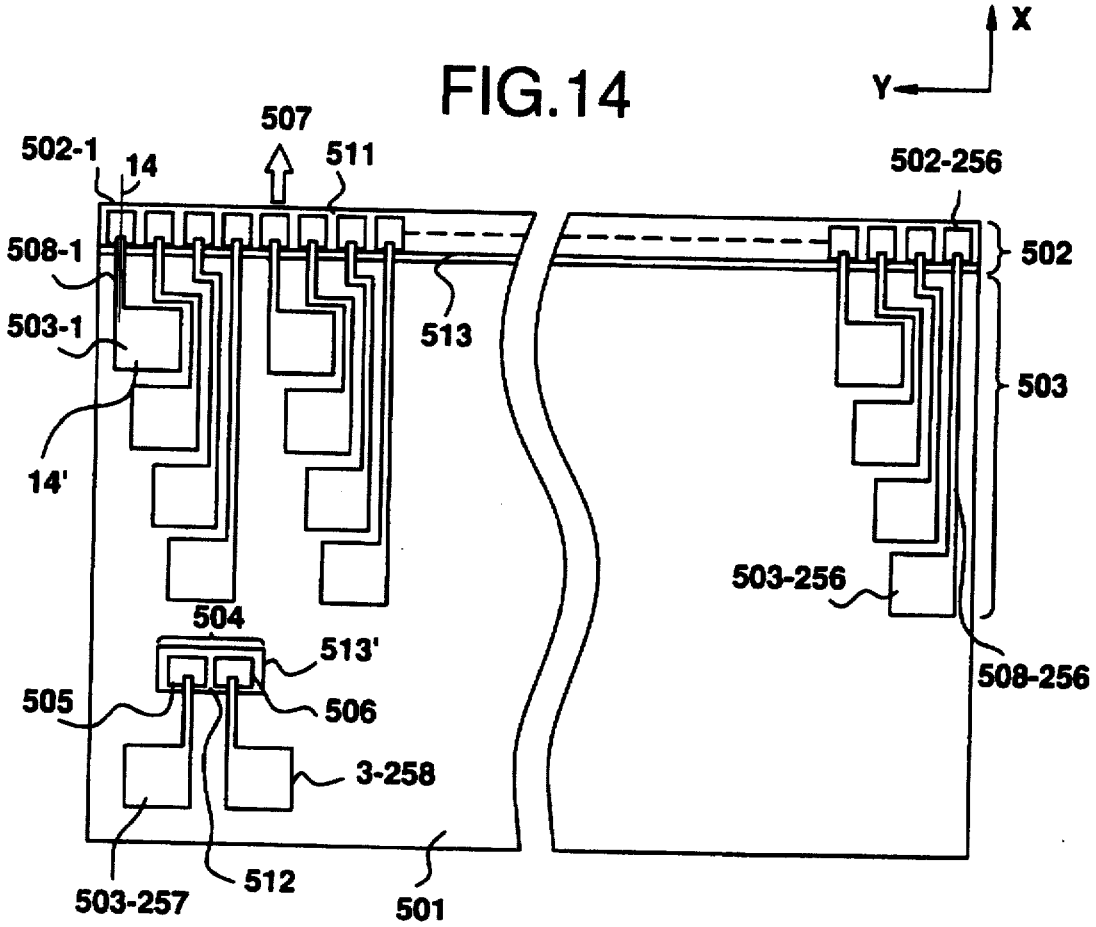
FIGS. 14 and 15 are diagrams showing a modification of the LED chip of FIG. 13 respectively in a plan view and in a cross sectional view.

FIG. 14 shows a modification of the second embodiment of FIG. 13, wherein the layer 501*c* has the same layered structure as the LEDs 502 and 505 as well as the photodiode 506 formed on the chip 500, wherein the layer 501*c* is isolated from the LEDs 502 by an isolation groove 513 provided at the rear edge of the LEDs 502. The isolation groove 513 extends in the Y-direction and is filled with an insulating material such as SOG or polyimide 529 that provides a planarized protective cover layer on the upper major surface of the layer 501*c*, as shown in the cross sectional view of FIG. 15. Thereby, the conductor pattern 508 extends over the planarized surface of the layer 529 and the step is eliminated at the rear edge of the LEDs 502. Thus, the structure of FIGS. 14 and 15 provides an improved reliability of electric connection.

In the structure of FIG. 14, it should be noted that the monitoring element 504 is surrounded by an isolation groove 513' formed in the layer 501*c*. Thereby, the LED 505 and the photodiode 506 of the monitoring element 504 are effectively shielded optically from the LEDs 502 at the front edge of the substrate 501, and the crosstalk between the optical beams of the LEDs 502 and the monitoring element 504 due to the stray light is effectively eliminated. It should be noted that thegroove 513' continues to the isolation groove 512 that separates the LED 505 from the photodiode 506. Although not shown, such an isolation groove surrounding the monitoring element 504 also isolates the LED 505 and the photodiode 506 from the layer 501*c* in the embodiment of FIG. 13.

Figure 15:
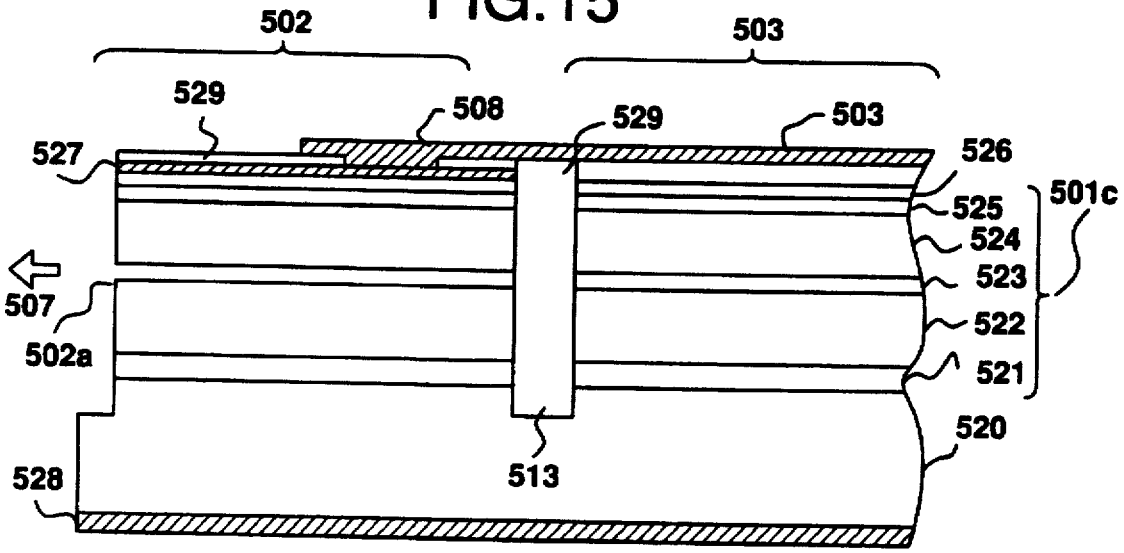
Figure 16:
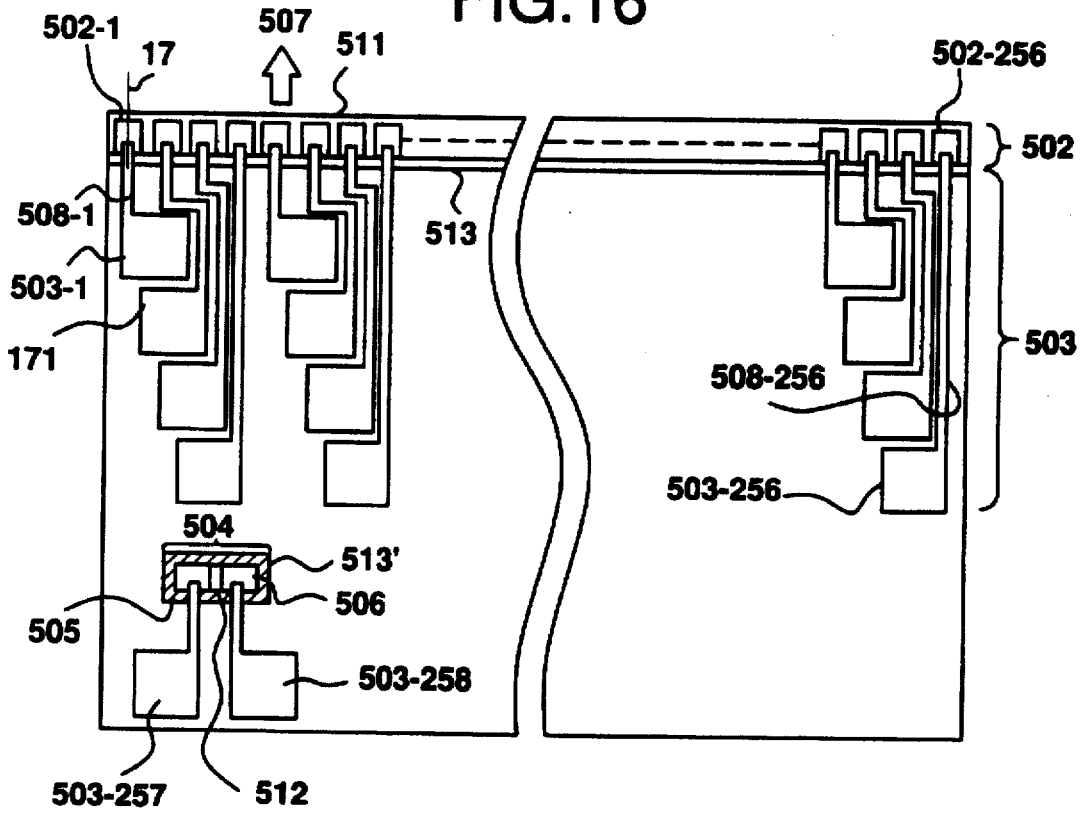
FIGS. 16 and 17 are diagrams showing another modification of the LED chips of FIG. 13 respectively in a plan view and in a cross-sectional view.
Figure 17:
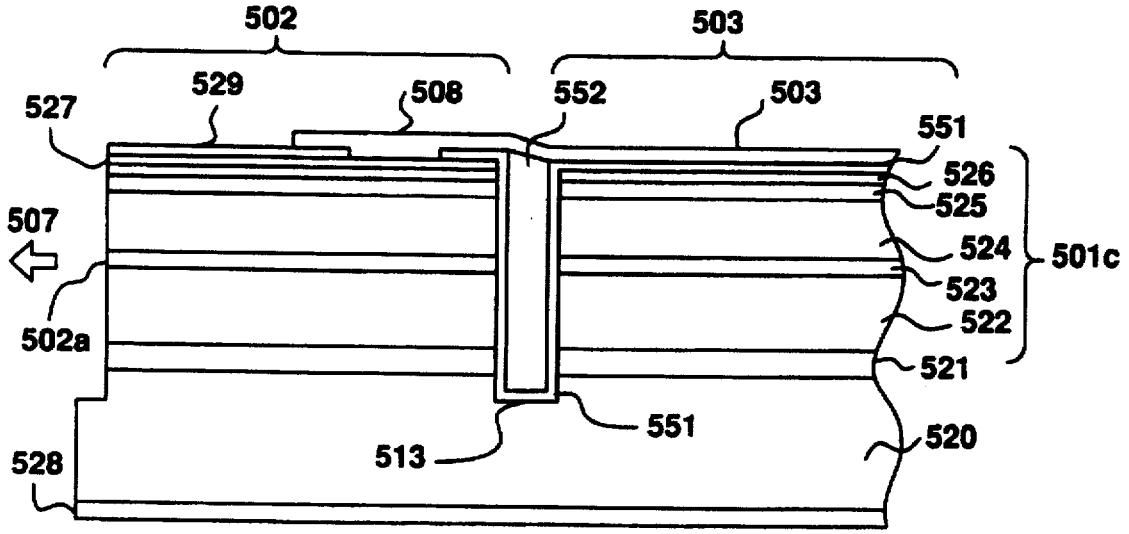

FIGS. 16 and 17 show another modification of the structure shown in FIGS. 14 and 15, wherein a thin $SiO_2$ film 551 is deposited on the layer 501*c* including the exposed surface of the isolation groove 513 as well as the isolation groove 513'. Further, the isolation grooves 513 and 513' thus covered by the thin $SiO_2$ film 551 are filled by polyimide designated in FIG. 17 by a numeral 552. Thereby, the interconnection conductor pattern is provided on the exposed surface of the $SiO_2$ film 551 covering the layer 501*c* and the step at the rear edge of the LEDs 502 is substantially eliminated. In FIG. 17, it should be noted that the bridging part of the conductor pattern 503 bridging across the LED 502 and the layer 501*c* is supported by the polyimide region 552 filling the isolation groove 513.

Figure 18:
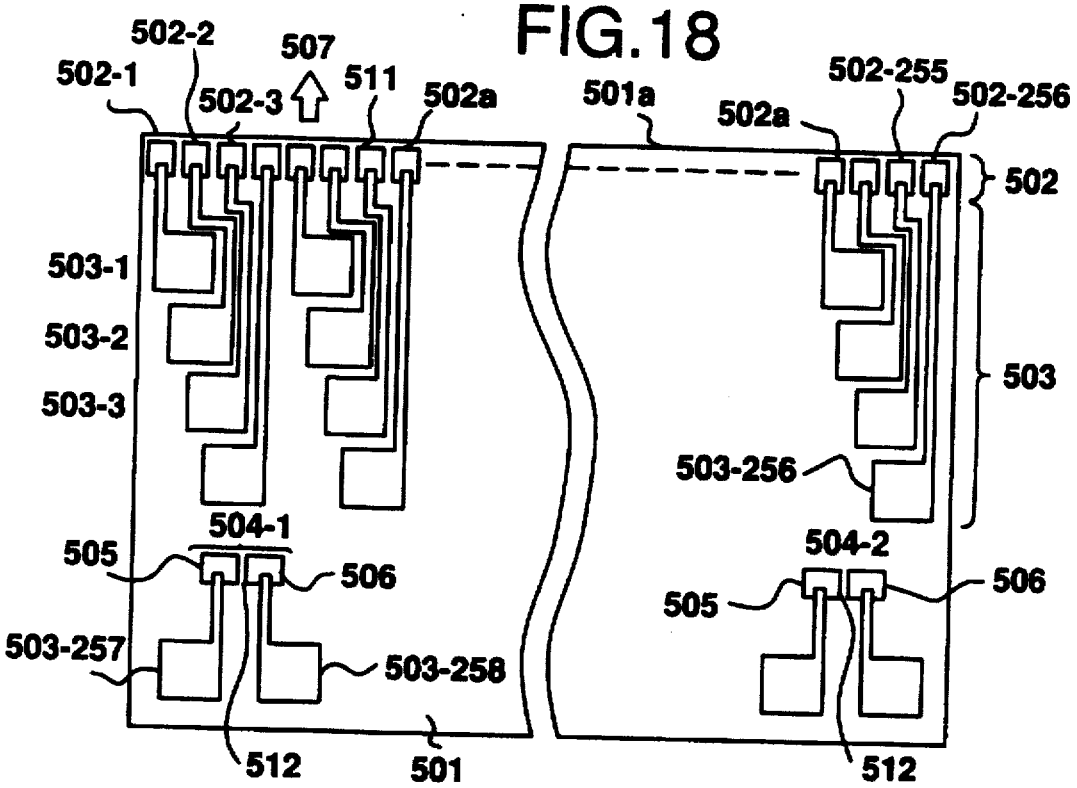
FIGS. 18 and 19 are diagrams showing another modification of the LED chips of FIG. 13 respectively in a plan view and in a cross sectional view.

FIGS. 18 shows another modification of the LED chip 500 of FIGS. 8 and 9, wherein there are provided a plurality of monitoring elements $504_{-1}$ and $504_{-2}$ on the same substrate 501. Each of the monitoring elements $504_{-1}$ and $504_{-2}$ has the same structure as the monitoring element 504 described previously and includes an LED corresponding to the LED 505 and a photodiode corresponding to the photodiode 506.

When using such an LED chip including a plurality of monitoring elements, one may control the LEDs 502 on the left half of the substrate 501 in response to the output of the monitoring element $504_{-1}$ and the LEDs 502 on the right half in response to the output of the monitoring element $504_{-2}$. Thereby, the variation of the optical beams within the chip can be reduced further. Alternatively, one may average the output of the monitoring elements $504_{-1}$ and $504_{-2}$ for controlling the LEDs 502. Further, one may select one of the monitoring elements $504_{-1}$ and $504_{-2}$ for controlling the LED 504, and switch to the other monitoring element when the drive current to the LEDs 502 exceeds a predetermined threshold. By detecting the abnormal drive current supplied to the LEDs 502, one can detect an anomaly in the monitoring element. It should be noted that operation of the LED 505, forming the monitoring element 504 and energized substantially continuously during the operation of the LED chip, tends to deteriorate with a shorter operational duration as compared with the LEDs 502 forming the LED array.

Figure 19:
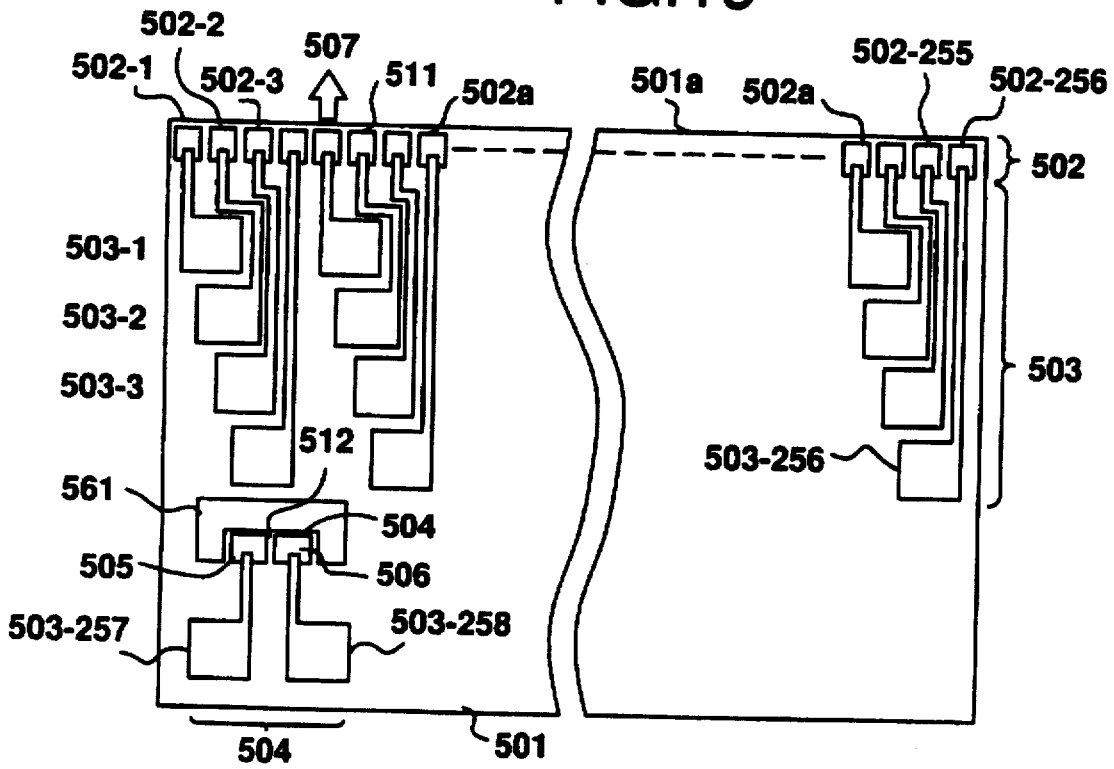

Further, FIG. 19 shows another modification of the LED chip 500 shown in FIGS. 8 and 9, wherein the monitoring element 504 is shielded optically from the LEDs 502 by a shielding member 561 formed monolithically on the substrate 501. More specifically, the shielding member 561 is formed when removing the layered structure on the substrate 501 by the RIBE etching process while leaving the LED 502 as well as the LED 505 and the photodiode 506 unetched, as a part of the layered structure. Thereby, the shielding member 561 has a layered structure identical with the LEDs 502 or the LED 505 and the photodiode 506 forming the monitoring element 504. The shielding member 506 is provided between the monitoring element 504 and the LEDs 502 and effectively shields the monitoring element optically from the optical beams produced by the LEDs 502. Thereby, an accurate and reliable feedback control can be achieved in the feedback control system of FIGS. 11(A) and 11(B).

In the foregoing embodiments, it should be noted that the depth of the isolation grooves 512, 513 and 513' are not necessarily identical. Further, it is not necessary that the isolation grooves reach the substrate 501 as shown in the cross sectional diagram such as FIG. 9. As long as the isolation groove crosses the active layer and reaches the underlying lower cladding layer, a satisfactory device isolation can be achieved.

Figure 20:
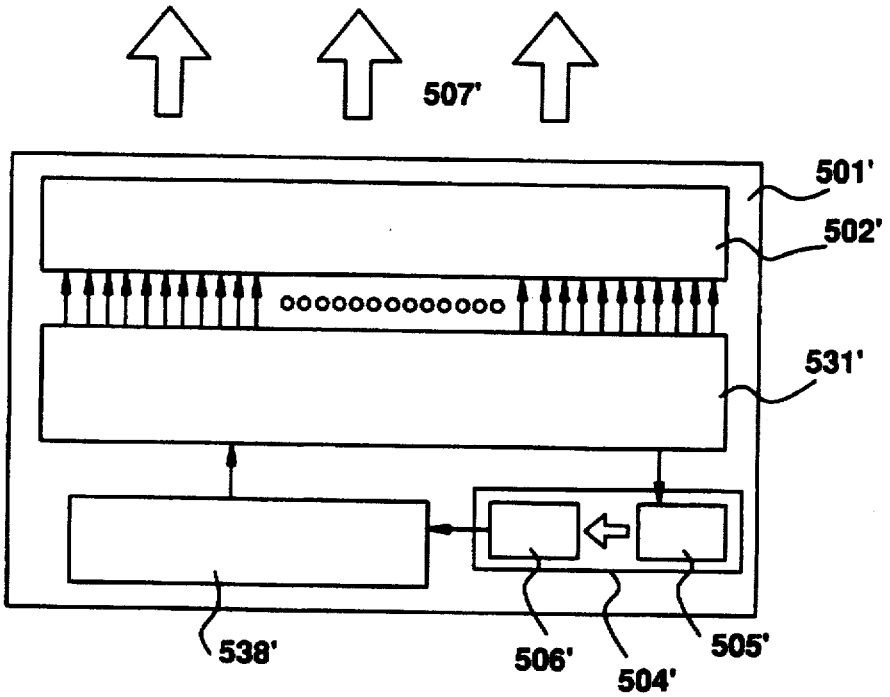
FIG. 20 is a diagram showing another modification of the LED chips of FIG. 13 in a plan view.

*FIG. 20 shows a modification of the LED chip of the present invention, wherein the driver circuit as well as the feedback circuit shown in FIG. 11(B) are formed monolithically on a common substrate as the LEDs.

Referring to FIG. 20, the LEDs forming an array 502' corresponding to the LED array 502 of FIG. 8 is provided on an updoped, semi-insulating GaAs substrate 501' corresponding to the GaAs substrate 501 of FIG. 8 except for the conductivity type, wherein the GaAs substrate 501' carries thereon a driver circuit 531' corresponding to the driver circuit 531. The driver circuit 531' is formed monolithically with respect to the substrate 501' as already mentioned, together with the LEDs 502'. Further, there is provided a feedback control loop designated collectively as 538' also on the substrate 501' monolithically, wherein the feedback control loop 538' includes circuits corresponding to the current-voltage converter 539, the error amplifier 538, the read only memory 540, the latch circuit 536 and the D/A converter 537. Thereby, the entire system shown in FIG. 11(B) is formed on a single chip and one can assemble of the optical printhead by merely placing the LED chips on a support substrate 3 shown in FIG. 7. It should be noted that the embodiment of FIG. 20 includes also a monitoring LED 505' and a corresponding photodiode 506' similarly to the embodiment of FIG. 8.

Figure 21:
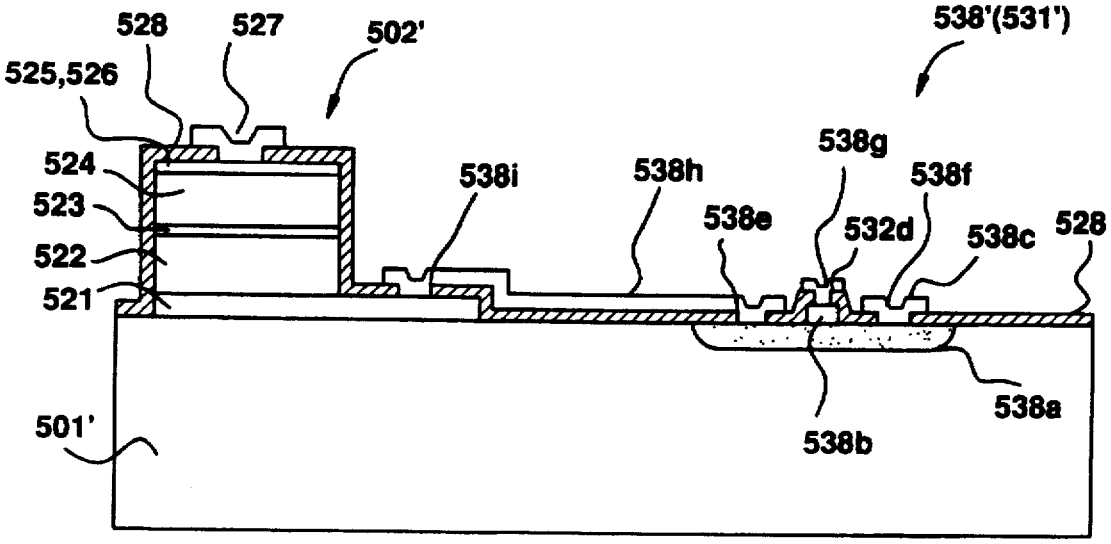
FIG. 21 is a diagram showing the structure of the LED chip of FIG. 20 in a cross sectional view.

FIG. 21 shows the cross sectional view of the LED chip of FIG. 20, wherein it will be noted that there is formed an n-type well 538*a* in the undoped semi-insulating GaAs substrate 501' in correspondence to where the driver circuit 531 or feedback control loop 538' is to be provided, by injecting dopant such as Si.

Referring to FIG. 21, the substrate 501' including the LEDs 502' are covered by a protective coating 528 of silicon oxide, and contact holes 538*c*, 538*d* and 538*e* are formed on the silicon oxide coating 528 in correspondence to the n-type well 538*a*, wherein an Al electrode 538*b* is provided on the surface of the well 538*a* as a gate electrode of a transistor that forms a part of the circuit 531 or 538'. Thereby, the gate electrode 538*g* is exposed by the contact hole 538*d* while the contact holes 538*c* and 538*e* expose the source and drain regions that are also defined in the n-type well 538*a*. Thereby, there is formed a MESFET structure on the substrate 501' in correspondence to the well 538*a*. The contact holes 538*c* and 538*d* for the source and gate are filled by ohmic electrodes 538*f* and 538*g*, while the contact hole 538*e* for the drain is filled by an electrode 538*h* that extends over the silicon oxide film 528 and forms an interconnection pattern. In the illustrated example, the interconnection pattern 538*h* establishes a contact with the buffer layer 522 at a contact hole 538*i*, and the carries are injected to the active layer 523 of the LED via the buffer layer 522 from the driver circuit 538' at the contact hole 538*i*.

Figure 22:
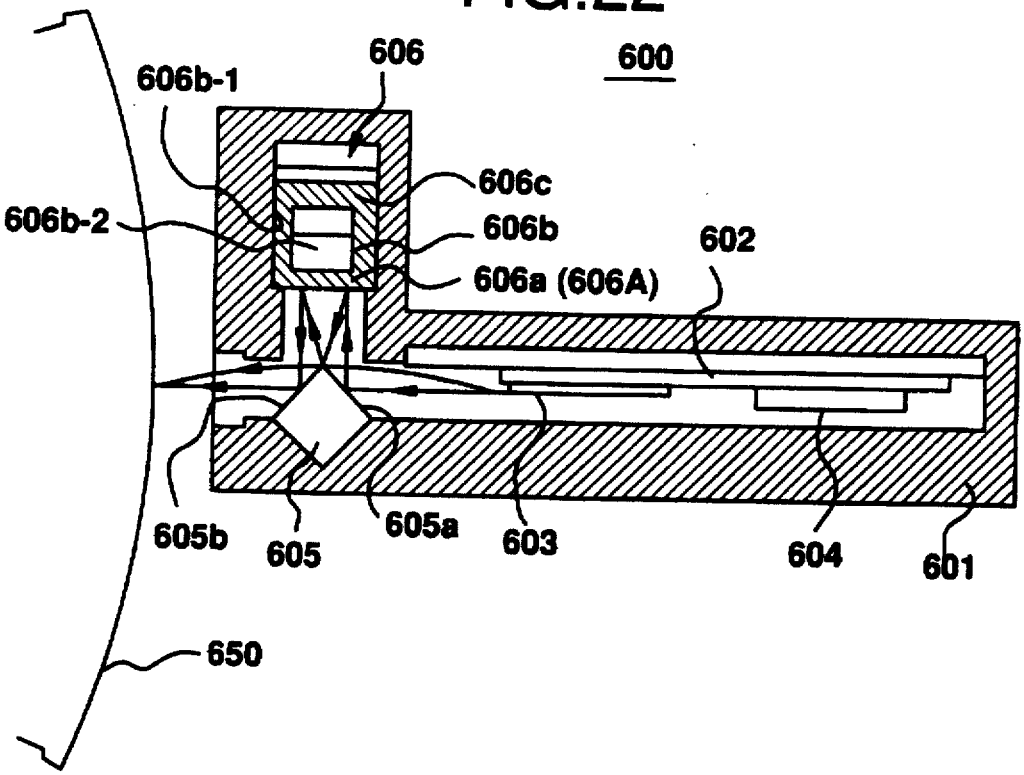
FIG. 22 is a diagram showing an optical line printhead according to a third embodiment of the present invention.

Next, the optical system used in the optical line print head will be described with reference to FIG. 22 showing a third embodiment of the present invention.

Referring to FIG. 22, showing an optical line printhead 600 in a cross sectional view, the optical line printhead includes an aluminum case 601 that carries therein a ceramic substrate 602. The ceramic substrate 602 extends perpendicularly to the plane of illustration in FIG. 22 in correspondence to the horizontal scanning direction, and a number of LED chips 603 each having a construction identical to the LED chip 500 described before are provided on the substrate 602. In FIG. 22 as well as the drawings to be described hereinafter, the feedback control circuit of FIGS. 11(A) and 11(B) is illustrated as being included in the LED chip 603 for the sake of simplicity of illustration. Further, the ceramic substrate 602 carries thereon various integrated circuits 604 forming other various control systems of the printhead 600.

The optical beams produced at the edge surfaces of the LEDs forming the LED array on the chip 603 are reflected at a first inclined mirror surface 605*a* of a mirror 605 disposed in the path of the optical beams emitted from the LED chips 603 toward a photosensitive drum 650, in a direction generally perpendicular to the plane of the LED chip 603 and hence the plane of the ceramic substrate 602. The optical beams thus reflected at the mirror 605 then enter into a roof mirror lens array (RMLA) 606 to be described later with reference to FIG. 23, wherein the optical beams are reflected back from the RMLA 606 and impinge upon another inclined mirror surface 605*b* of the mirror 605. The mirror 605 thereby reflects the optical beams toward the photosensitive drum 650.

Figure 23:
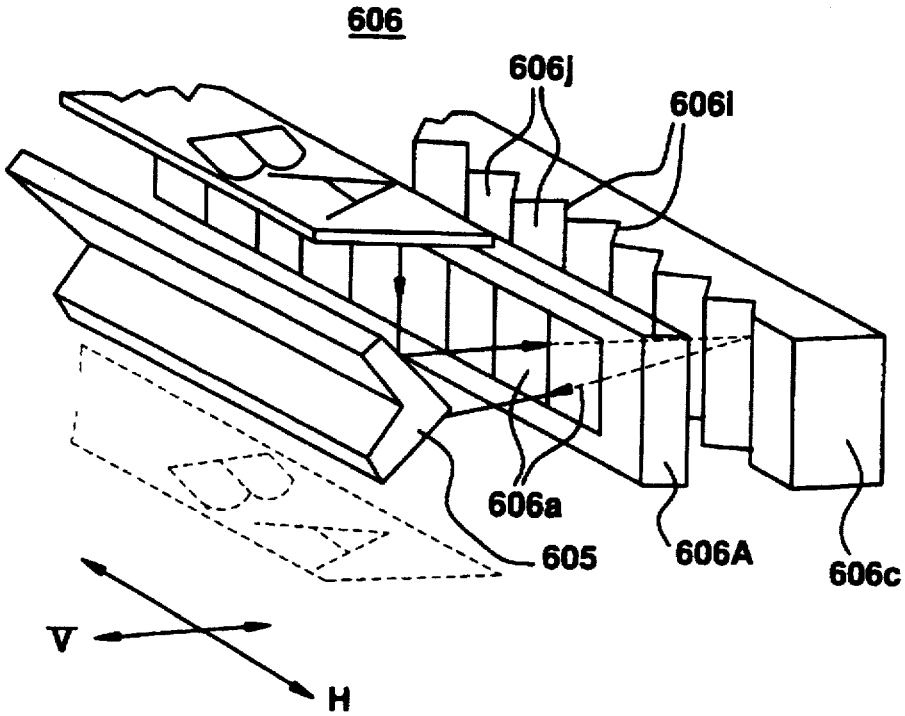
FIG. 23 is a diagram showing a roof mirror lens array (RMLA) forming an essential part of the optical line printhead of FIG. 22.

FIG. 23 shows the principle and construction of the RMLA 606.

Referring to FIG. 23, the optical beams produced by the LED chips 603 in accordance with the image to be recorded, schematically represented as "A", "B" . . . , are deflected by the mirror 605 at the mirror surface 605*a* and pass through a lens 606*a*. The lens 606*a* is aligned together with other identical lenses 605*a* in the horizontal scanning direction represented in FIG. 23 by an arrow H, to form a lens array 606A. The optical beams passed through the lenses 606*a* in the lens array 606A are reflected by inclined mirror surfaces 606*i* and 606*j*, inclined in mutually opposite directions and aligned alternately in the direction H to form a roof prism array 606*c*, after passing through a flare stop member 606*b* of which illustration is omitted in FIG. 23. The optical beams are thereby reflected consecutively by the mirror surfaces 606*i* and 606*j* or vice versa and emitted in the direction toward the mirror 605. The optical beams thus emitted are reflected by the mirror surface 605*b* of the mirror 605 and travel toward the photosensitive drum 650. Thereby, the images such as "A", "B", . . . are recorded by the optical beams line by line on the photosensitive drum 650. The flare stop member 606b includes an elongate opaque body $606b_{-1}$ extending in the direction H wherein the opaque body $606b_{-1}$ is formed with a number of optical paths $606b_{-2}$ provided in correspondence to the plurality of lenses 606*a*. See FIG. 22. The individual optical paths $606b_{-2}$, being surrounded by an opaque side wall acting as a hood, effectively eliminates the stray light, and the mixing of optical beams passed through different lenses is eliminated.

As a result of use of the RMLA 606, one can improve the accuracy for the focusing of the optical beams on the photosensitive drum 650 as compared to the unity magnification focusing system shown in FIG. 7, which employs a SELFOC lens array. In the SELFOC lens array, it should be noted that one has to align the level of the lenses forming the array exactly in alignment to the level of the corresponding LED array, and such a construction of the optical line printhead needs a careful assembling process that leads to the increased fabrication cost of the head. Further, the individual lenses forming the SELFOC lens array are formed by providing a refractive index profile in an optical medium, and exact control of such a refractive index profile is extremely difficult.

In the RMLA 606 shown in FIG. 23, it is not necessary to provide the lens 606*a* or the mirror surfaces 606*i* and 606*j* in correspondence to each of the LEDs forming the LED array on the chip 603. In other words, there may be a plurality of LEDs in correspondence to each lens 606*a* or each mirror pair that includes the mirror surfaces 606*i* and 606*j*. Thereby, one can form the lens array 606A and the roof prism array 606*c* with a size that allows a precise fabrication, and the accuracy of the optical system is improved substantially without increasing the cost. Furthermore, the increased tolerance for the precision of the optical system in the RMLA eliminates the necessity for the complicated adjustment process of the optical system, and the cost of the optical line printhead 600 is reduced further.

Thus, by using the optical system of FIG. 22, one can form a sharp, small optical dot on the surface of the photosensitive drum 650. Further, the optical line printhead 600 of FIG. 22, carrying the ceramic substrate 602 in intimate contact with the inner surface of the aluminum case 601, is suitable for achieving efficient cooling. As a result of the efficient cooling, it should be noted that the temperature rise in the optical line printhead is suppressed, and associated therewith, the problem of deviation of the optical system from the ideal state due to the temperature rise is minimized. Furthermore, the optical line printhead 600 having the RMLA 606 can be constructed with a compact size.

Figure 24:
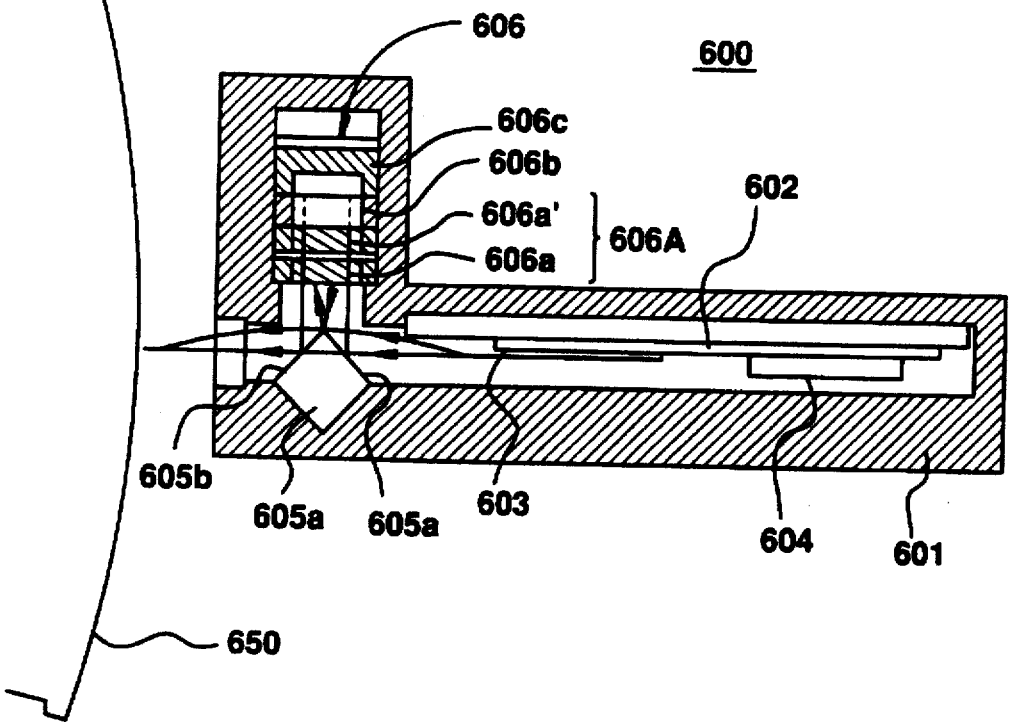
FIG. 24 is a diagram showing a modification of the optical line printhead of FIG. 22.

FIG. 24 shows a modification of the optical line printhead 600 of FIG. 22, wherein those parts constructed identically to FIG. 22 are designated by the same reference numerals and the description thereof will be omitted.

In the modification of FIG. 24, the lens array 606A includes a plurality of second lenses 606*a'* each provided in alignment with a corresponding lens 606*a* on the common optical axis. Further, the second lenses 606*a'* are aligned with each other in the horizontal scanning direction H to form an array similar to the lenses 606*a*. By employing a plurality of lenses 606*a* and 606*a'* aligned on a common optical axis, one can eliminate various distortions and aberrations, and the optical performance of the RMLA is improved substantially.

Figure 25:
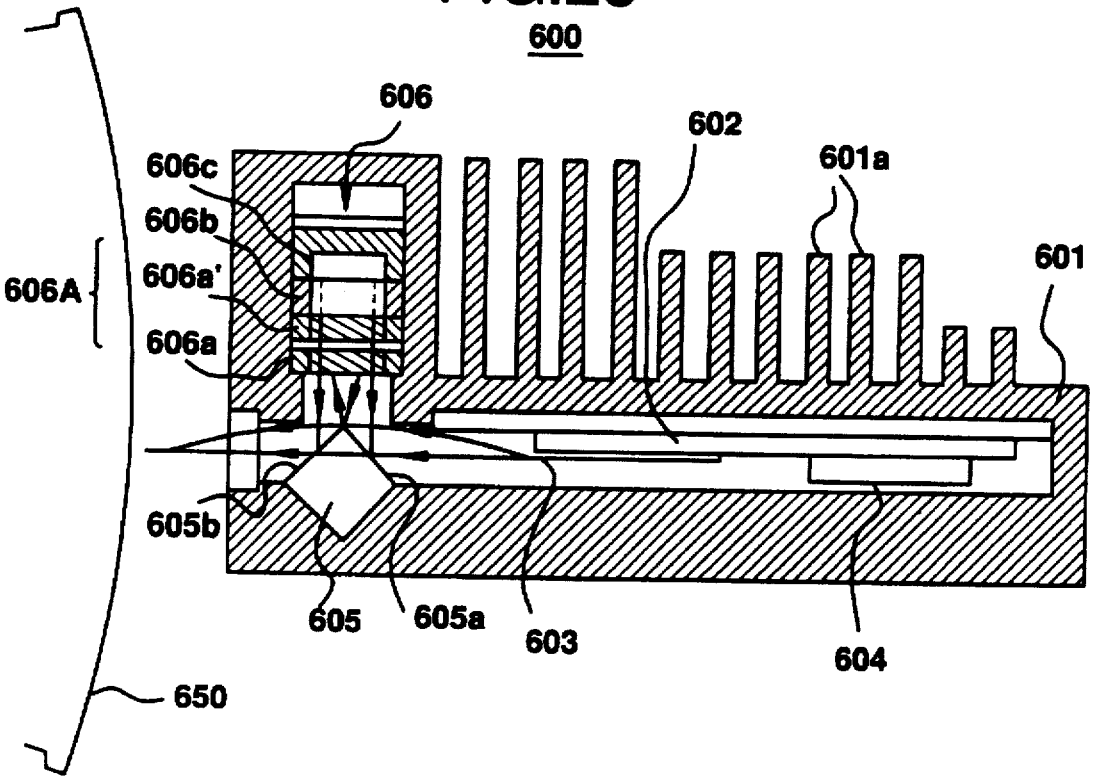
FIG. 25 is a diagram showing another modification of the optical line printhead of FIG. 22.

In the modification of FIG. 25, a number of cooling fins 601*a* are provided on the aluminum case 601 for facilitating the cooling of the optical line printhead 600. As the cooling fins 601*a* are provided at the side of the case opposite to the inner surface on which the ceramic substrate 602 is carried, one can obtain extremely efficient cooling of the head. Thereby, the distortion in the optical system caused as a result of the heating of the head is minimized.

Figure 26:
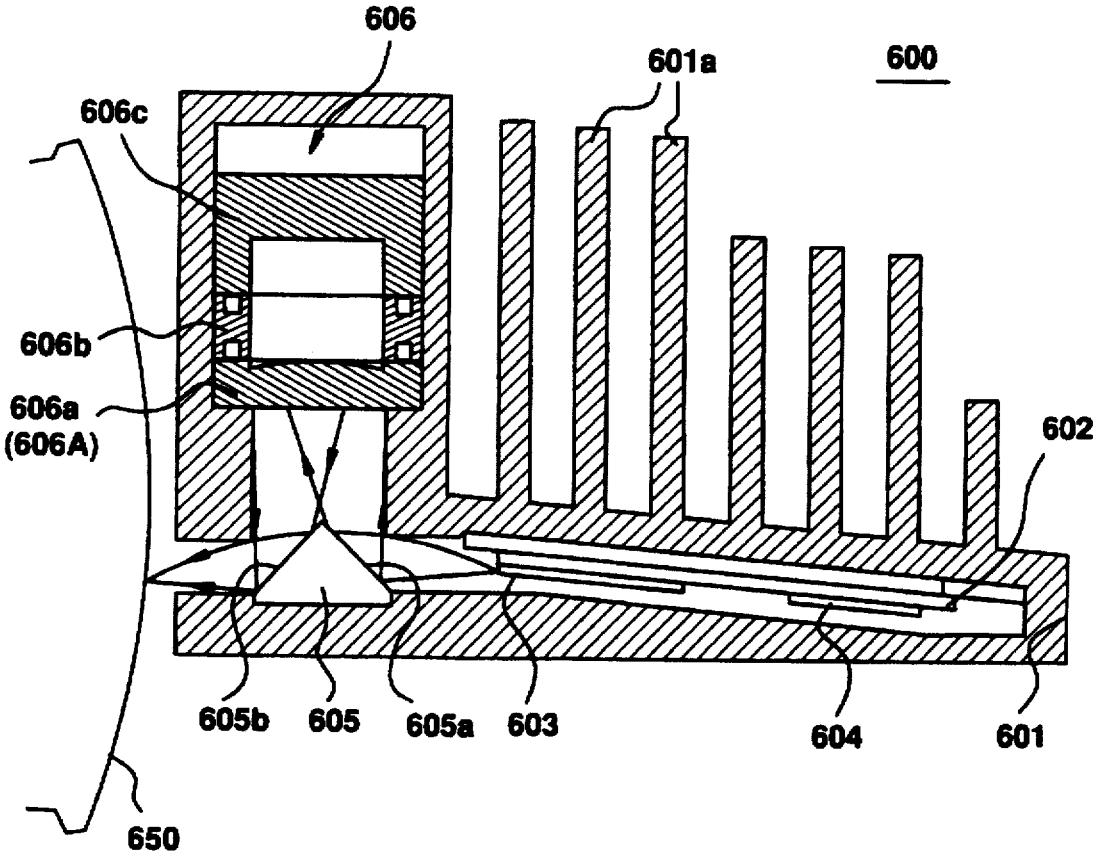
FIG. 26 is a diagram showing another modification of the optical line printhead of FIG. 22.

FIG. 26 shows another modification of the optical line printhead 600 of FIG. 22, wherein the ceramic substrate 602 and hence the LED chip 603 carried thereon are tilted with respect to the mirror surface 605*a* of the mirror 605 in a direction in which the angle of incidence of the optical beam on the mirror surface 605*a* is reduced. Thereby, the axis of the optical beams produced at the edge of the LEDs on the LED chip 603 crosses the lens 606*a* exactly in correspondence to the center of the lens, and the optical performance of the RMLA 606 is improved further.

Next, an optical line printhead according to a fourth embodiment of the present invention will be described with reference to FIG. 27.

Figure 27:
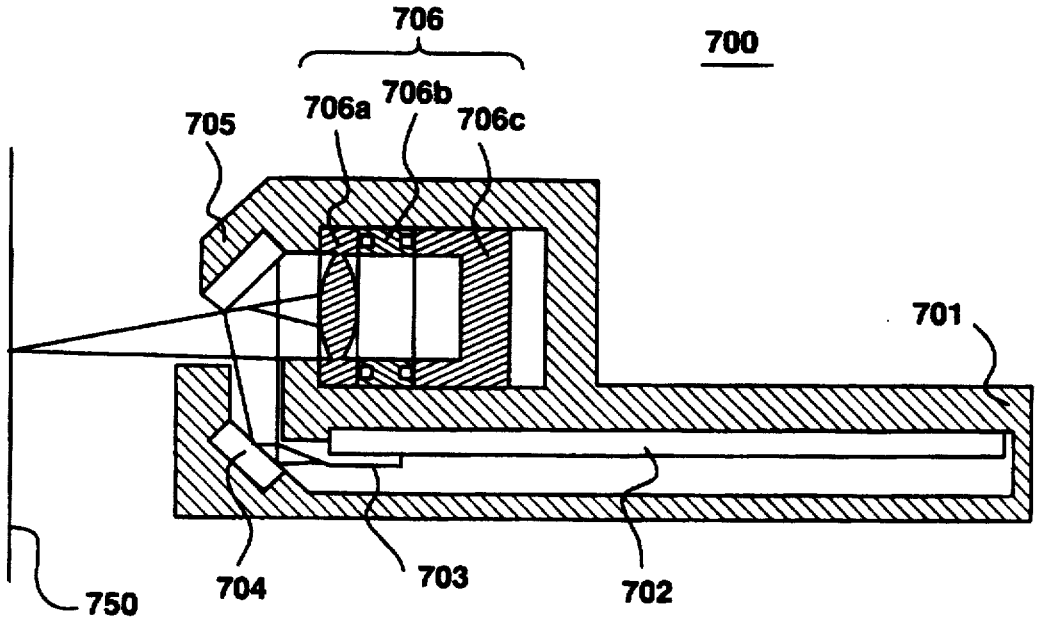
FIG. 27 is a diagram showing the construction of an optical line printhead according to a fourth embodiment of the present invention.

Referring to FIG. 27 showing an optical line printhead 700 of the present invention in a cross sectional view, the optical line printhead 700 includes an aluminum case 701 that carries thereon a ceramic substrate 702 in intimate contact with the inner surface of the case 701 for efficient heat dissipation. The ceramic substrate 702 carries thereon an array of LED chips 703 together with corresponding feedback circuits of which illustration is omitted, and the LEDs on the LED chips 703 emit the optical beams at the edge surface in a direction generally toward a photosensitive drum 750. The optical beams thus emitted are deflected at a mirror 704 in a direction generally perpendicular to the plane of the substrate 702, and hence the LED chip 703, toward another mirror 705, wherein the mirror 705 deflects the optical beams incident thereto in the direction generally opposite to the direction of the photosensitive drum 750. The optical beams thus deflected enter into an RMLA 706 corresponding to and having the identical construction to the RMLA 606 described previously, wherein the optical beams pass consecutively through a lens 706*a* and a flare stop member 706*b* respectively corresponding to the lens 606*a* and the flare stop member 606*b* and are reflected at a roof prism array 706*c* corresponding to the roof prism array 606*c*. The optical beams thus reflected pass consecutively through the member 606*b* and the lens 606*a* in the opposite direction and are focused on the surface of the photosensitive drum 750.

In this construction, too, one can eliminate the need for the exact alignment of the LED chips 703 with respect to the optical system, by employing the RMLA 706 for the optical system. Thereby, the optical line printhead is made easy to fabricate and the efficiency of production of the optical line printhead and hence the printer or copier that emplys such an optical line printhead is substantially improved.

Figure 28:
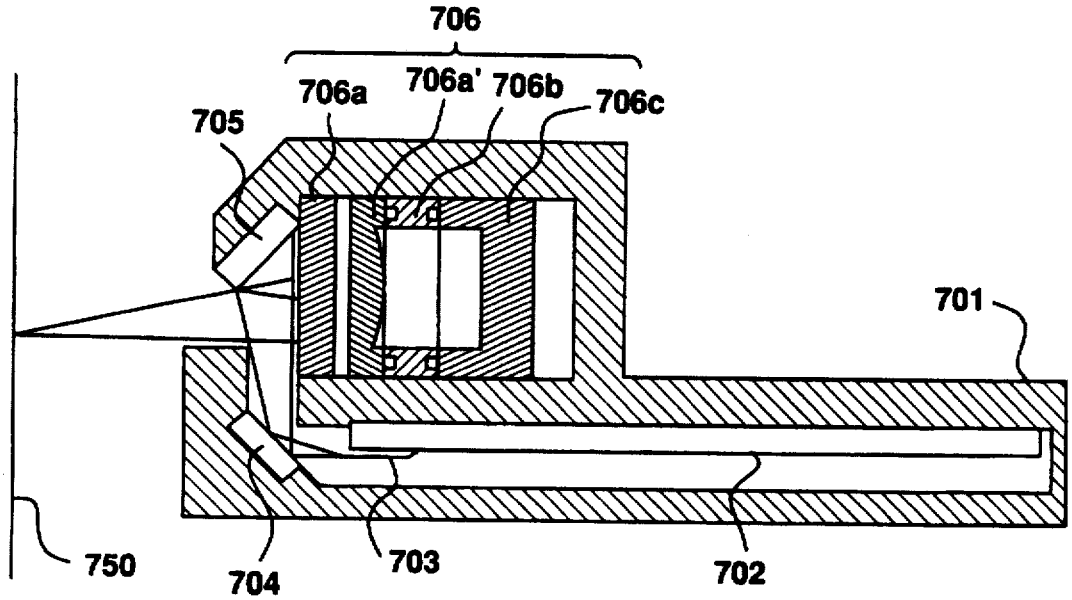
FIG. 28 is a diagram showing a modification of the optical line printhead of FIG. 27.

FIG. 28 shows a modification of the optical line printhead of FIG. 27, wherein another lens 706*a'* is disposed coaxially to the lens 706 similarly to the embodiment of FIG. 24. Thereby, an improved optical characteristic such as reduced aberration is obtained.

Figure 29:
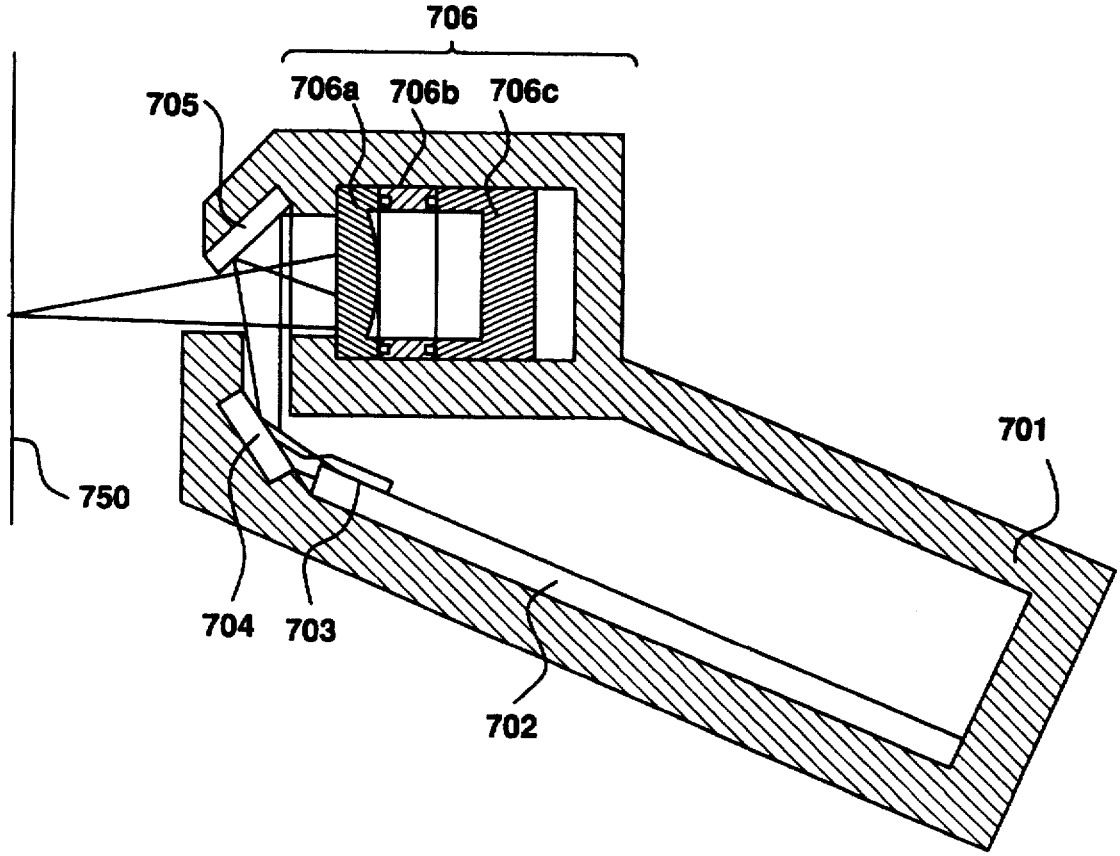
FIG. 29 is a diagram showing a modification of the optical line printhead of FIG. 27.

FIG. 29 shows another modification of the optical line printhead of FIG. 27, wherein the substrate 702 and hence the LED chip 703 held on the substrate 702 are mounted obliquely to the optical axis of the lens 706*a*. Thereby, the optical beams emitted at the front edge of the LEDs in the LED chip 703 passes through the lens 706*a* in correspondence to the optical axis thereof, and the distortion of the optical beam is substantially reduced. The modification of FIG. 29 therefore corresponds to the embodiment of FIG. 26.

Figure 30:
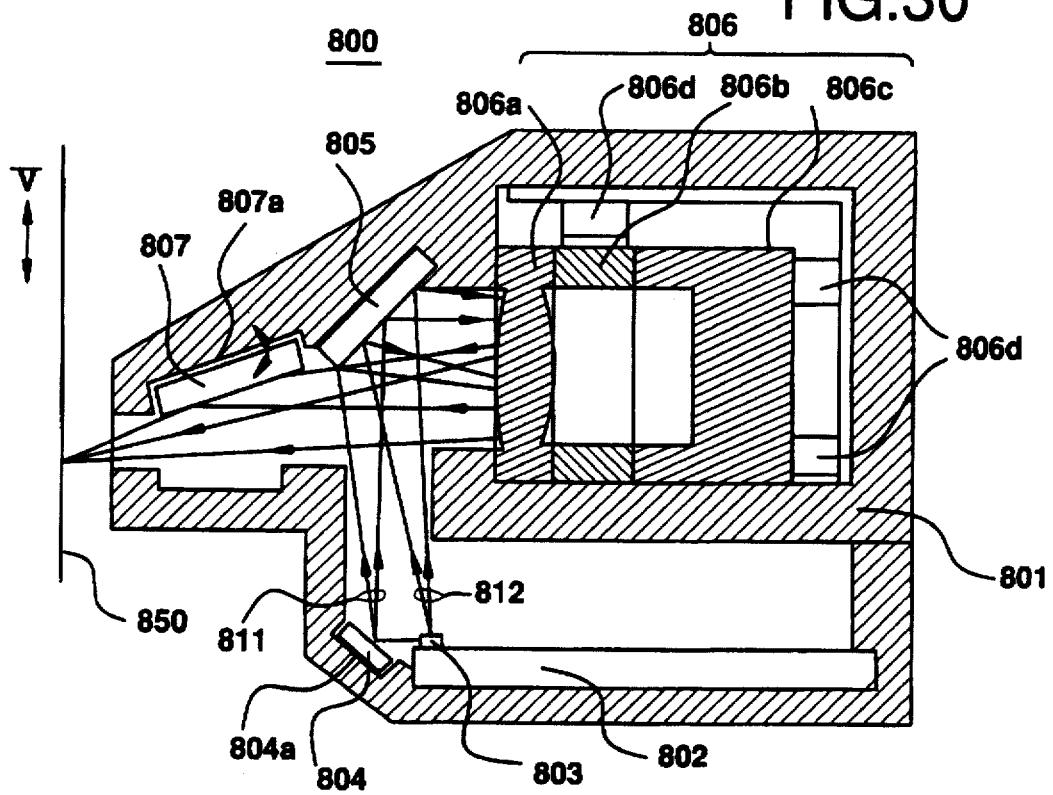
FIG. 30 is a diagram showing the construction of an optical line printhead according to a fifth embodiment of the present invention.

Next, a fifth embodiment of the present invention will be described with reference to FIG. 30 showing an optical line printhead 800 according to the present embodiment in a cross sectional view.

The optical line printhead 800 has a construction similar to the head 700 of FIG. 27 and includes an aluminum case 801 and a ceramic substrate 802 carried on an inner surface of the case 801 in intimate contact therewith for heat dissipation. The ceramic substrate 802 carries thereon an array of LED chips 803 that produce a first group of optical beams 811 at a front edge of the LEDs provided on the LED chip 803, together with corresponding feedback circuits for achieving the feedback control described with respect to FIGS. 11(A) and 11(B).

The LED chips 803 emit the optical beams generally in the direction toward a photosensitive drum 850, while there is provided a mirror 805 for deflecting the first optical beams 811 in a direction substantially perpendicular to the plane of the substrate 802 and hence the plane of the LED chip 803. In the path of the optical beams 811 thus deflected at the mirror 804, there is provided another mirror 805 that deflects the optical beams 811 in the direction generally away from the photosensitive drum 850, and the optical beams 811 thus deflected enter into an RMLA 806 that includes a lens 806*a* corresponding to the lens 606*a* and forming a lens array, a flare stop member 806*b* corresponding to the member 606*b* and disposed behind the lens 806*a*, and a roof prism array 806*c* corresponding to the roof prism array 606*c* and disposed behind the member 806*b*. Thereby, the optical beams 811 passed through the lens 806*a* and the flare stop member 806*b* are reflected consecutively at mutually inclined mirror surfaces formed in the roof prism array 806*c* in correspondence to the mirror surfaces 606*i* and 606*j* of FIG. 23, and emitted in the direction toward the photosensitive drum 850. The optical beams 811 thus reflected at the roof prism array 806*c* pass through the member 808*b* and the lens 808*a* consecutively and are deflected by another mirror 807 disposed in the path of the optical beams 811 reflected at the roof prism array 808*c*. The optical beams 811 are then focused on the surface of the photosensitive drum 850. In FIG. 30, it should be noted that the RMLA 806 is supported on the case 801 by a support member 806*d*.

Figure 32:
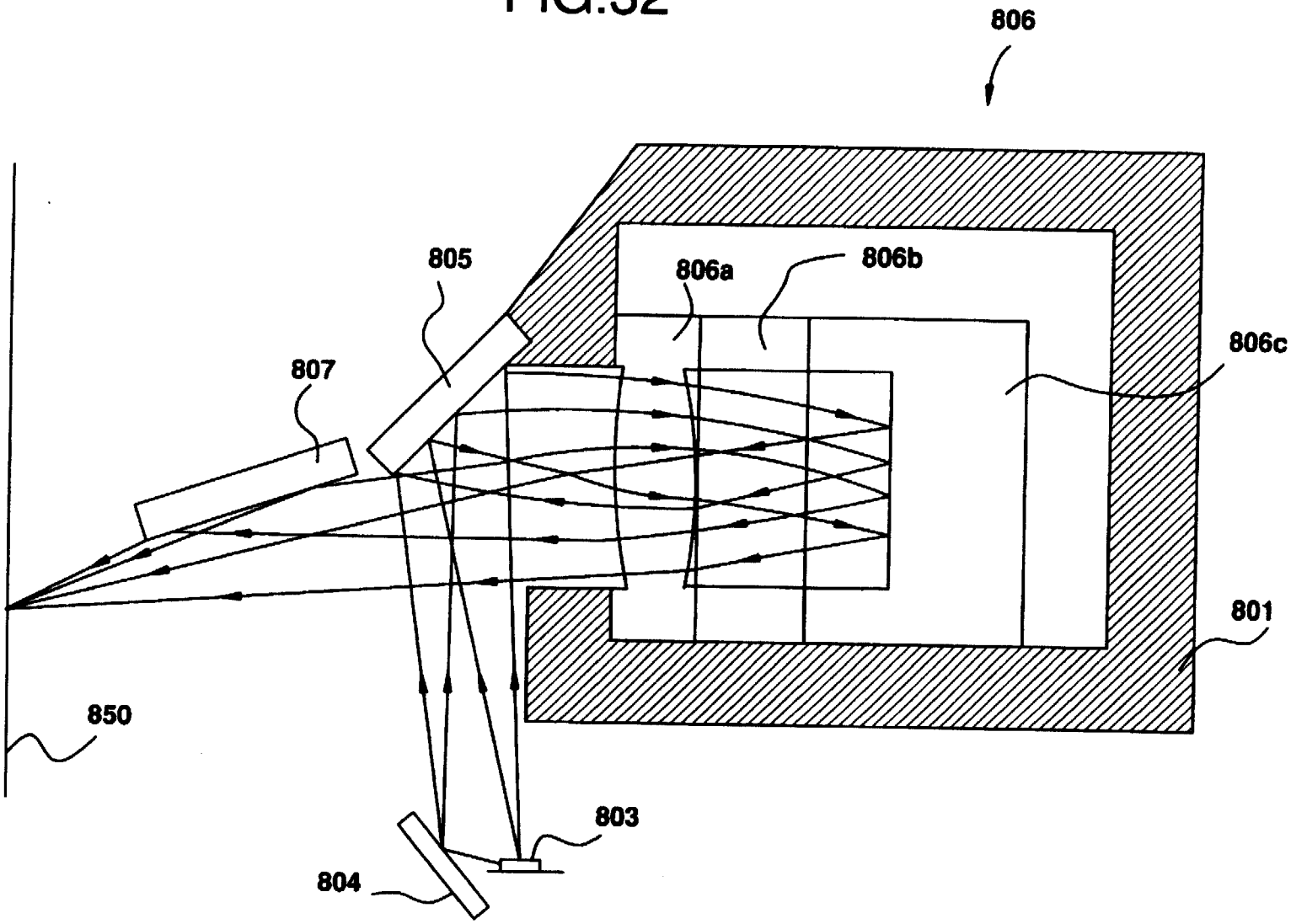
FIG. 32 is a diagram showing the path of the rays in the optical line printhead of FIG. 30.

In the embodiment of FIG. 30, the LEDs on the LED chip 803 produce also second group optical beams 812 at the upper major surface of the LEDs in the direction generally perpendicular to the plane of the LED chip 803 and hence the plane of the ceramic substrate 802. The mirror 805 is so disposed in the path of the optical beams 812 that the optical beams 812 are deflected generally away from the photosensitive drum 850 and enter the RMLA 806. Thereby, the optical beams 812 pass consecutively through the lens 806*a* and the flare stop member 806*b* and experience reflections at the roof prism array 806*c* similarly to the optical beams 811. The optical beams 812 thus reflected then pass through the member 806*b* and the lens 806*a* consecutively and focused on the surface of the photosensitive drum 850. In other words, the photosensitive drum 850 is exposed by both the optical beams 811 emitted at the front edge of the LEDs in the LED chips 803 and the optical beams 812 emitted at the upper major surface of the LED in the LED chips 803. As a result, the efficiency of exposure is substantially improved in the present embodiment over the embodiments described previously that employ only the optical beams emitted from the edge surface of the LEDs. The path of the first and second group optical beams inside the RMLA 806 is shown in FIG. 32.

In order to direct the optical beams 811 and the optical beams 812 so as to hit the same spot on the photosensitive drum 850, adjusting mechanism 804*a* and 807*a* are provided respectively in correspondence to the mirrors 804 and 807. By tilting the mirrors 804 and 807 as indicated by arrows in FIG. 30, the position of the optical beams 811 and 812 on the photosensitive drum 850 is adjusted in the vertical scanning direction represented in FIG. 30 by an arrow V. After adjustment, the mirrors 804 and 807 are fixed upon the case 801 by adhesive.

Figure 31:
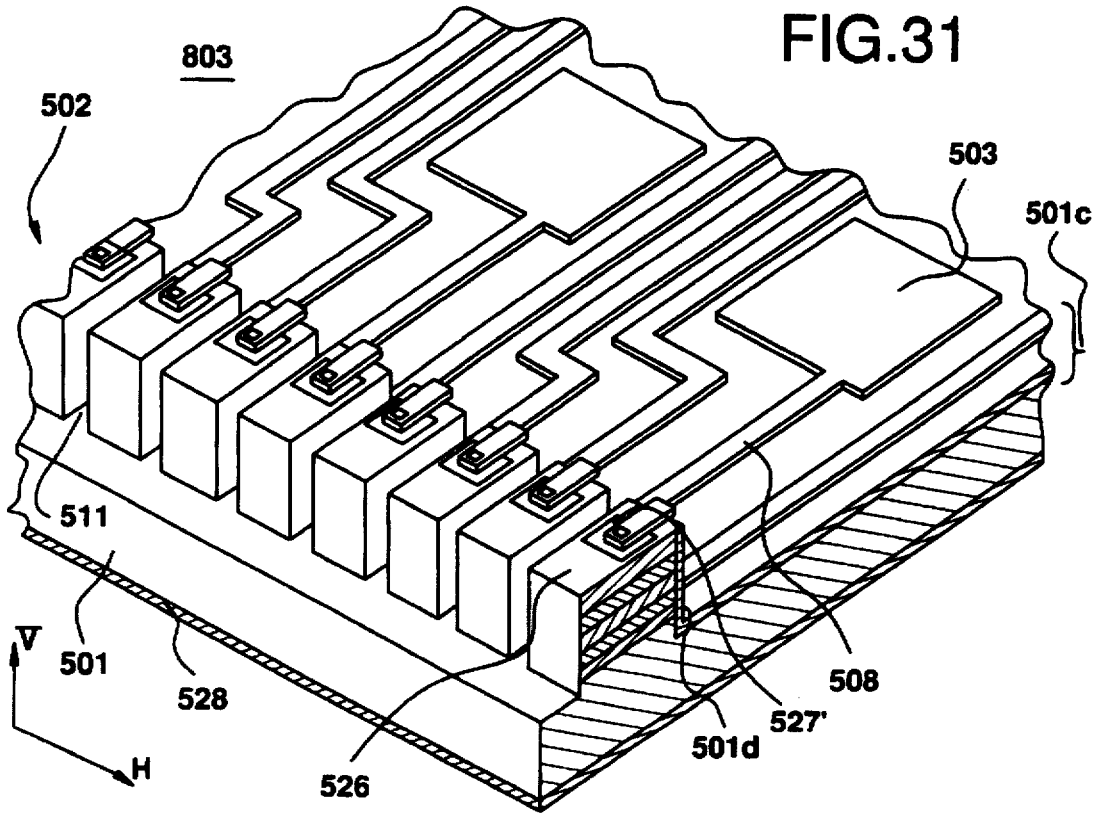
FIG. 31 is a diagram showing a part of the LED chip used in the optical line printhead of FIG. 30.

FIG. 31 shows a part of the LED chip 803 used in the embodiment of FIG. 30. In FIG. 31, it will be noted the LED chip 803 has a structure similar to the structure of FIG. 13. Therefore, those parts corresponding to the parts of FIG. 13 are designated by the same reference numerals and the description thereof will be omitted.

Referring to FIG. 31, the electrode covering the upper major surface of the contact layer 506 of the LED 502 is formed to have a reduced area to form an electrode 527'. Thereby, the substantial area of the upper major surface of the layer 506 is exposed, and the optical radiation produced in the LED 502 is emitted at the exposed surface of the layer 526 in the direction generally perpendicular to the upper major surface of the layer 526 and hence the plane of the chip 813 as the optical beam 812.

In the construction of FIG. 31, it will be noted that the optical path length of the optical beams 811 is longer than the optical path length of the optical beams 812. Associated therewith, there occurs a problem in that the point of convergence of the optical beam is different in the optical beams 811 and the optical beams 812. When the optical line printhead 800 is so positioned as to achieve a proper focusing for the optical beams 811, the optical beams 812 are defocused. Vice versa, the optical beams 811 are defocused when the optical beams 812 are focused properly. In the defocused state, it should be noted that the optical beams have an increased beam spot size on the photosensitive drum 850. Further, such a defocused optical beam forms a diffuse boundary and the contrast of the recorded beam spot is degraded.

Figure 33:
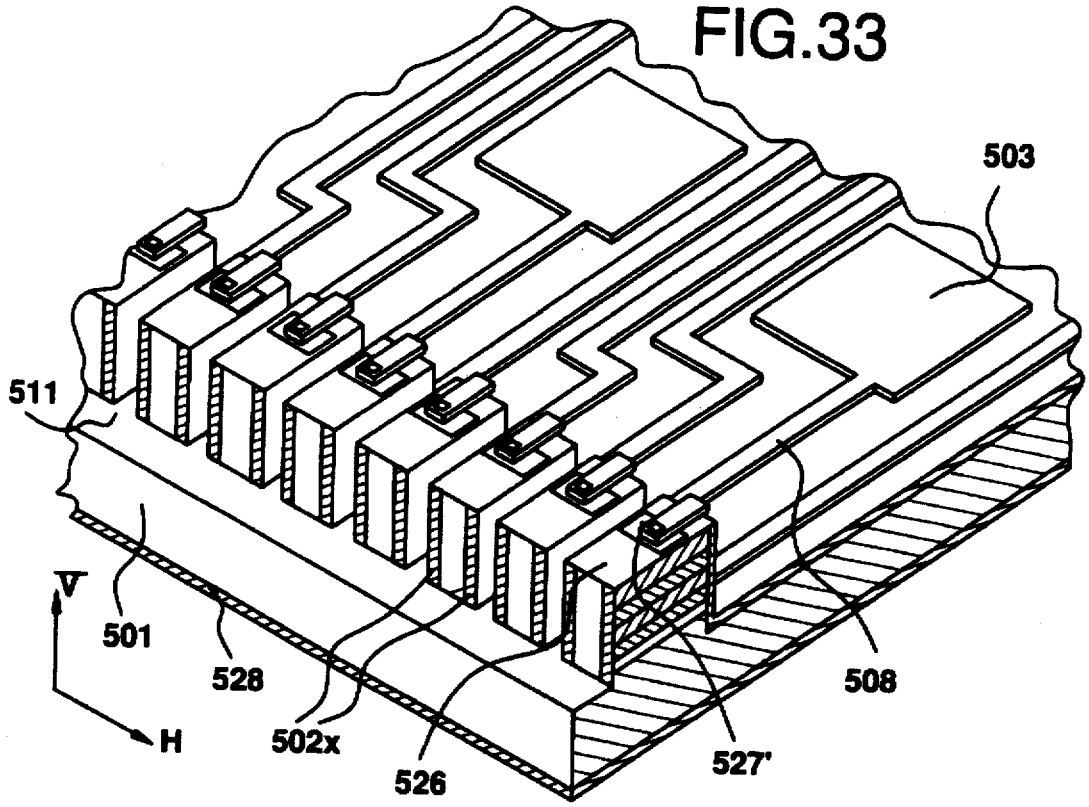
FIG. 33 is a diagram showing a modification of the LED chip of FIG. 31.
Figure 34:
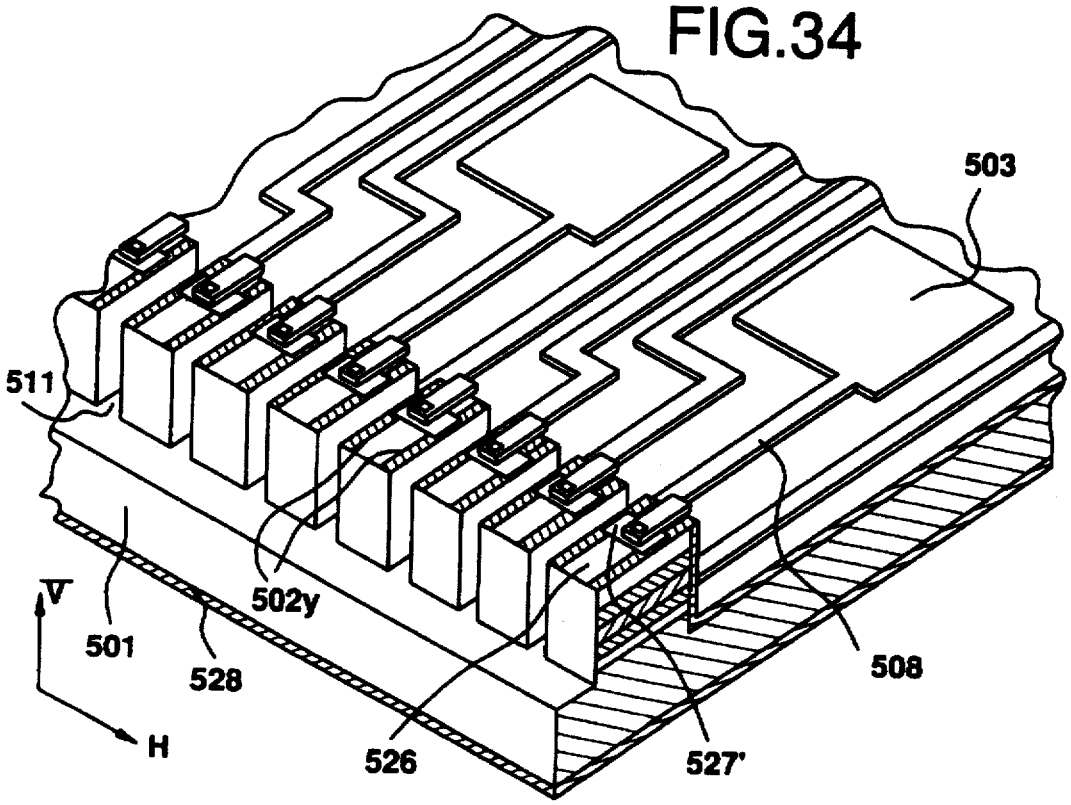
FIG. 34 is a diagram showing another modification of the LED chip of FIG. 31.

In order to overcome the problem of different beam spot sizes of the optical beams 811 and 812 on the photosensitive drum 850, one may provide a mask pattern 502*x* on the front edge of the LEDs 502 as shown in FIG. 33 so as to limit the width of the optical beams produced by the LEDs 502 with respect to the horizontal scanning direction H, which is perpendicular to the plane of the drawing in the illustration of FIG. 30. Thereby, the optical beams 811 have a reduced size in the horizontal scanning direction as compared with the optical beams 812, and the difference in the size of the optical beam spot on the photosensitive drum 850 is effectively compensated for. Alternatively, one may provide a mask pattern 502*y* on the upper major surface of the contact layer 526 as shown in FIG. 34 so as to limit width of the optical beams 812 with respect to the horizontal scanning direction. In this case, too, it is possible to reduce the size of the optical beams 812 with respect to the optical beams 811, and the difference in the size of the optical beams 811 and the optical beams 812 is effectively compensated for.

Figure 35:
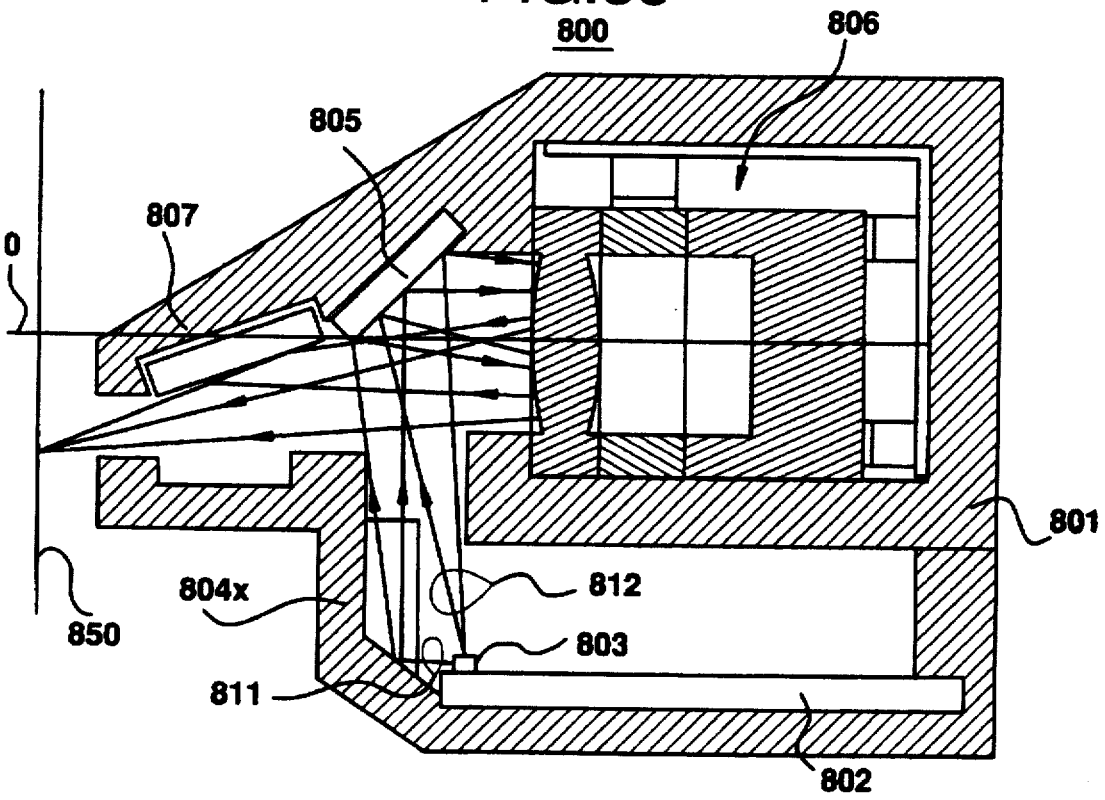
FIG. 35 is a diagram showing a modification of the optical line printhead of FIG. 30.

FIG. 35 shows another modification of the optical line printhead 800 of FIG. 30, wherein the optical path length of the optical beams 811 is shortened by interposing a prism 804*x* of high refractive index in the optical path of the beam 811 in place of the mirror 804. The prism 804*x* has an oblique surface that acts as the mirror for deflecting the optical beams 811 toward the mirror 805. Due to the prism 804*x*, the optical beams 811 are focused at the same position as the optical beams 812, and one can obtain a sharp optical dot on the surface of the photosensitive drum 850.

Figure 36:
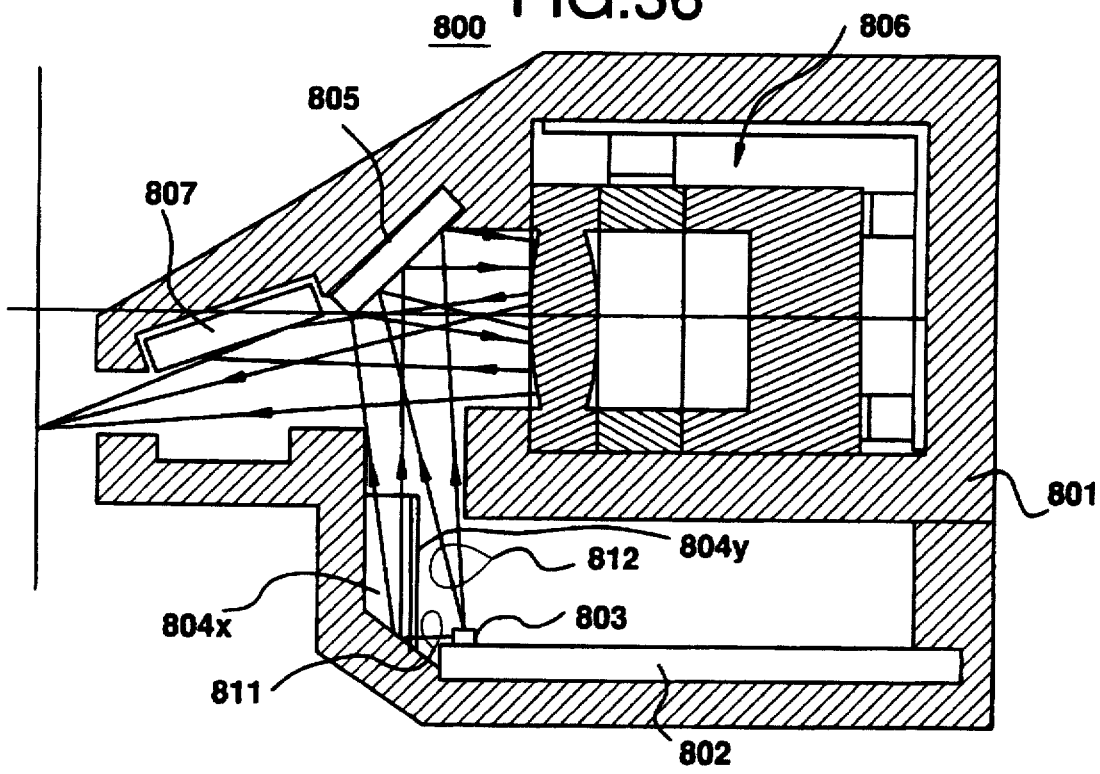
FIG. 36 is a diagram showing a modification of the optical line printhead of FIG. 35.

FIG. 36 shows a modification of the optical line printhead 800 of FIG. 35, wherein there is provided an optical shielding member 804*y* on the surface of the prism 804*x* for shutting off the optical beams 812 entering into the prism 804*x*. As a result of the shielding member 804*y*, one can eliminate the effect of the stray light caused by the optical beams 802 being mixed with the optical beams 811.

In the optical line printhead 800 of FIG. 36, it should be noted that the optical beams 811 produced at the edge of the LEDs in the LED chip 803 have a flat, horizontally elongated beam shape extending in the horizontal scanning direction H in correspondence to the flat cross section of the active layer in the LED. On the other hand, the optical beams emitted at the upper major surface of the contact layer 506 has a generally rectangular beam shape. Thereby, it will be noted that the size of the optical beam is different in the optical beams 811 and the optical beams 812 with respect to the vertical scanning direction V, even when both optical beams are properly focused on the photosensitive drum 850.

Figure 37:
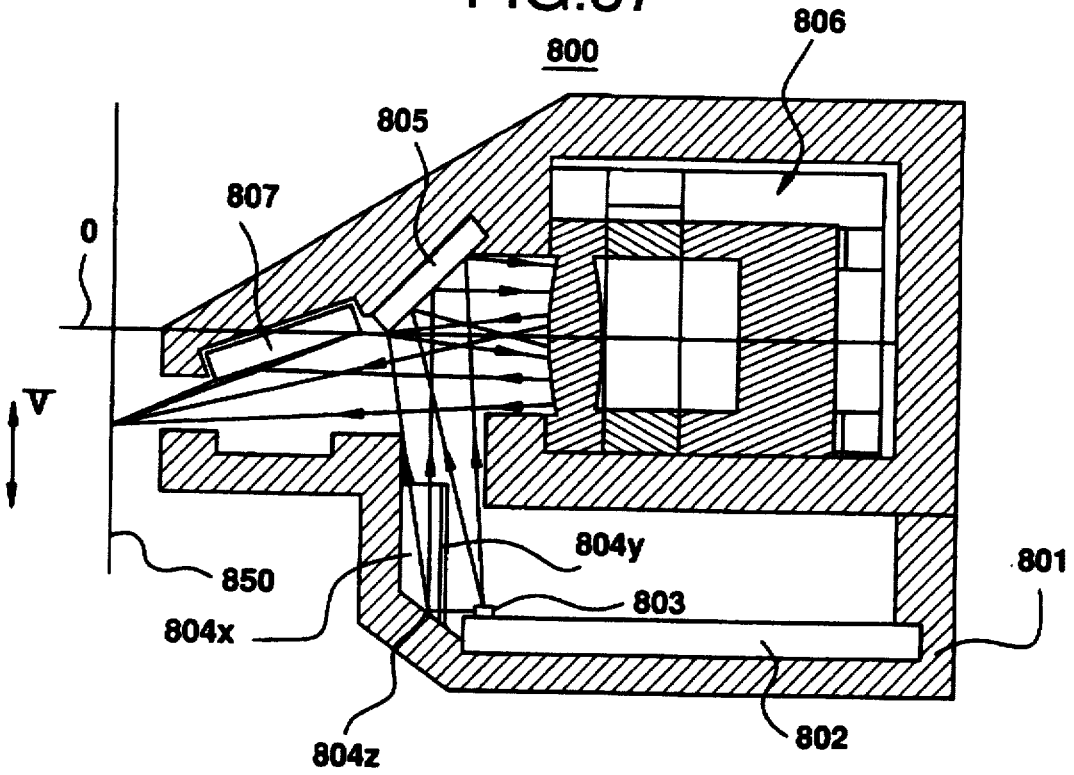
FIG. 37 is a diagram showing a modification of the optical line printhead of FIG. 36.

FIG. 37 shows a modification of the optical line printhead 800 of FIG. 36 for addressing the matter of the beam shape described above.

Referring to FIG. 37, the prism 804*x* has a convex cylindrical surface 804*z* extending perpendicularly to the plane of FIG. 37 in the horizontal scanning direction for diverging the optical beams 811 incident thereto from the edge surface of the LEDs in the LED chip 803. Thereby, the spot of the optical beams 811 is expanded in the vertical scanning direction V on the surface of the photosensitive drum 850, and the optical beams 811 have a substantially identical beam shape to that of the optical beams 812. It should be noted that expansion of the beam in the horizontal scanning direction does not occur, as the surface 804*z* is a cylindrical surface and does not cause the divergence of the optical beam 811 in the horizontal scanning direction.

Figure 38:
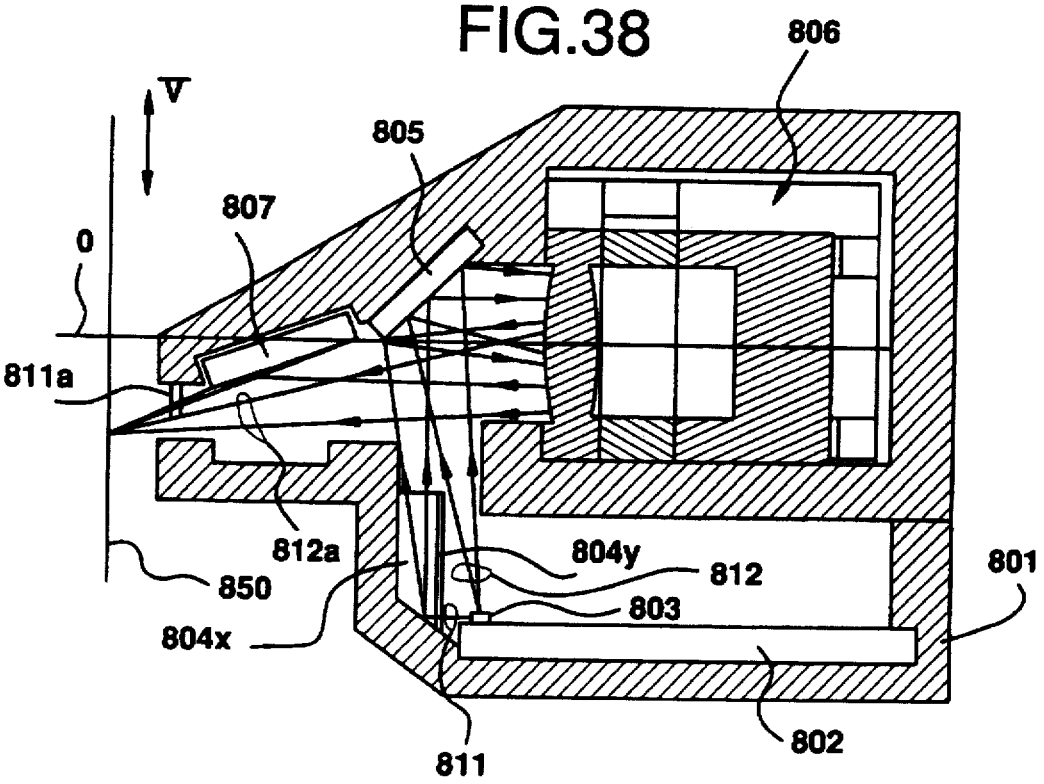
FIG. 38 is a diagram showing a modification of the optical line printhead of FIG. 37.

FIG. 38 shows an alternative approach to achieve the same object as the optical line printhead 800 of FIG. 37.

Referring to FIG. 38, there is disposed a cylindrical lens 811*a* having a concave surface in the optical path of the optical beams 811 for causing a divergence in the optical beams in the vertical scanning direction V upon passage of the beam 811 through the lens 811*a*. It should be noted that the cylindrical lens 811*a* causes no divergence or convergence of the beam in the horizontal scanning direction. Thereby, the optical beam spot for the beam 811 is expanded in the vertical scanning direction on the surface of the photosensitive drum 850.

Further, there is disposed another cylindrical lens 812*a* having a convex surface in the optical path of the optical beams 812 for causing a convergence in the optical beams in the vertical scanning direction V upon passage of the beam 812 through the lens 812*a*. Thereby, the optical beam spot for the beam 812 is compressed in the vertical scanning direction on the surface of the photosensitive drum 850, and the size of the beam spot is set substantially identical for the optical beams 811 and the optical beams 812.

In the optical line printhead of FIG. 38, it is not necessary to use both the cylindrical lenses 811*a* and 812*a*, each may be employed alone.

Figure 39:
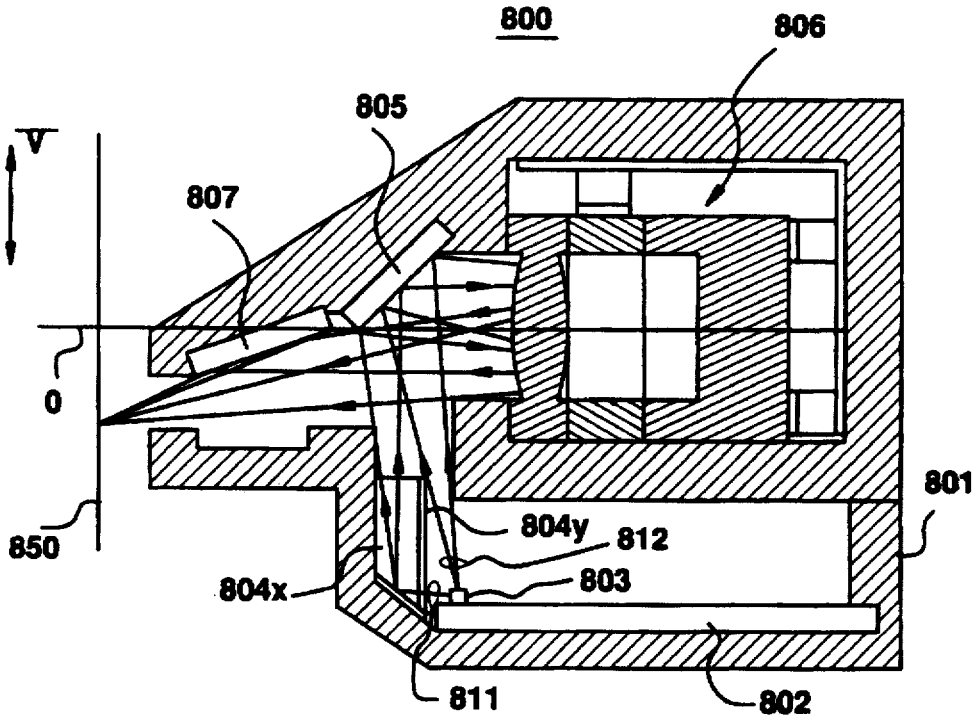
FIG. 39 is a diagram showing another modification of the optical line printhead of FIG. 36.

FIG. 39 shows another modification of the optical line printhead 800 of FIG. 35, wherein the prism 804*x* is movably supported on the case 801 in the vertical scanning direction V. Thereby, it is possible to move the optical beam spots corresponding to the optical beams 811 vertically on the surface of the photosensitive drum 850, such that the optical beam spots formed by the optical beams 811 coincide with the corresponding optical beam spots formed by the optical beams 812.

Figure 40:
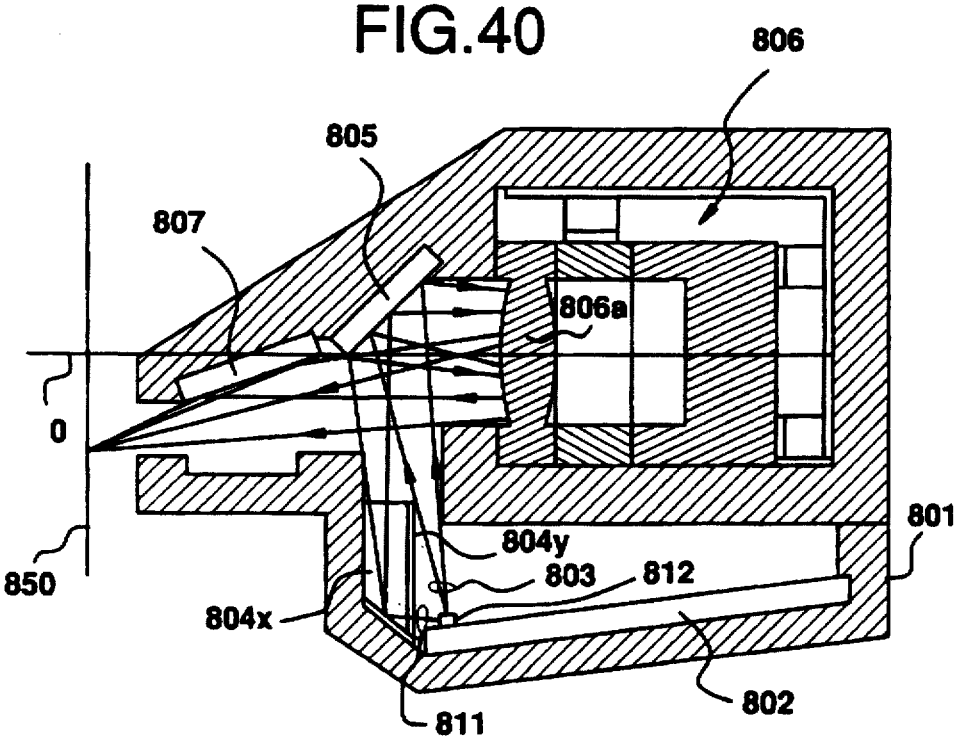
FIG. 40 is a diagram showing a modification of the optical line printhead of FIG. 39.

FIG. 40 shows a modification of the optical line printhead 800 of FIG. 36, wherein it will be noted that the substrate 802 is tilted with respect to an optical axis O of the lens 806*a* forming the RMLA 806, such that a hypothetical normal drawn to the upper major surface of the LEDs on the LED chip 803 intersects perpendicularly the path of the principal ray of the second optical beams 812 that is emitted from the RMLA 806 after reflections at the roof prism 806*c*. Thereby, the second optical beams 812 pass generally through the center of the lens 806*a* when the beam 812 enters the RMLA 806 after reflection at the mirror 805, and one can minimize the distortion of the second optical beams 812 caused by the lens 806*a*.

In the optical line printhead 800 of the present embodiment, the shape of the optical beam is generally different in the optical beams 811 and in the optical beams 812 as already noted. The beams in the optical beam group 811 have a flat elongated cross section with a reduced size in the vertical scanning direction. On the other hand, the beams in the optical beam group 812 have a generally rectangular cross section. Thus, one can achieve a high resolution recording of images on the surface of the photosensitive drum 850 with an increased dot pitch in the vertical scanning direction when the optical beams 811 alone are used. When the optical beams 812 are used, on the other hand, a low resolution recording of images with a coarse dot pitch is achieved.

Figure 41:
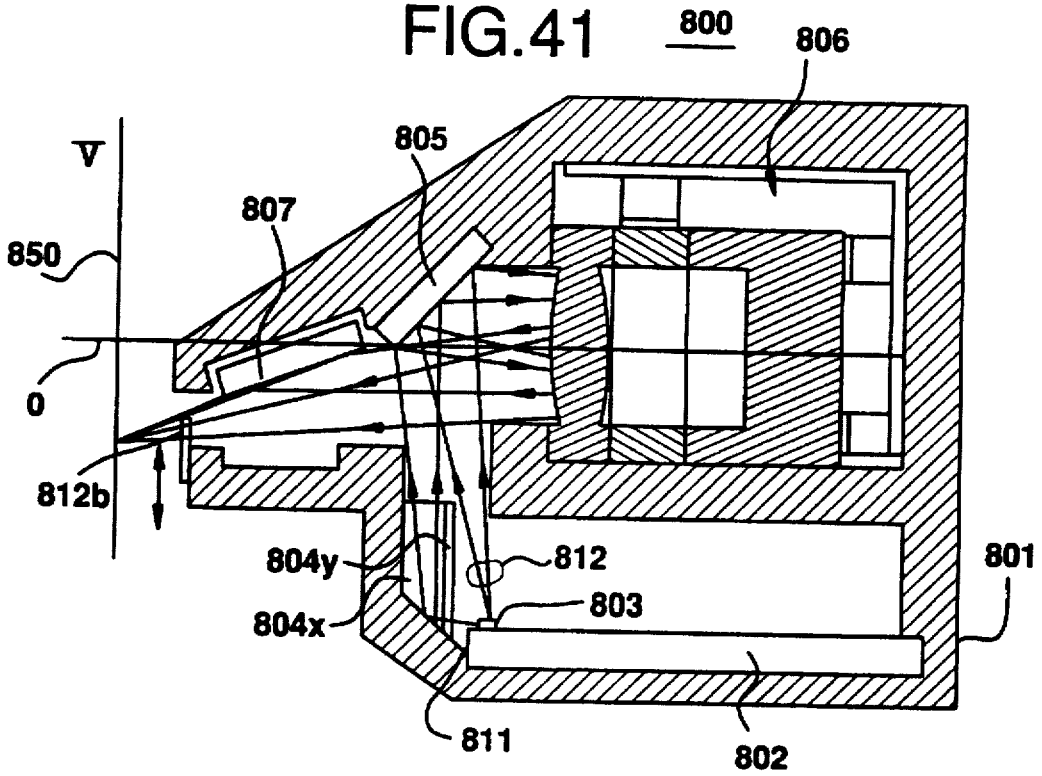
FIG. 41 is a diagram showing still another modification of the optical line printhead of FIG. 36.

In order to achieve switching of the recording mode between the high resolution mode and the coarse resolution mode, a modification of the optical line printhead 800 shown in FIG. 41 has a movable shutter member **812*b* movably supported on the case 801 in the vertical scanning direction V such that the optical beams 812 are interrupted when the shutter member 812*b* is moved in the upward direction. In this state, only the optical beams 811 reach the photosensitive drum 850 and the recording of images is achieved with the high resolution in the vertical scanning direction. When the shutter member 812*b* is moved in the downward direction, the optical beams 812 reach the photosensitive drum 850** and the recording is achieved in the low resolution mode.

Figure 42:
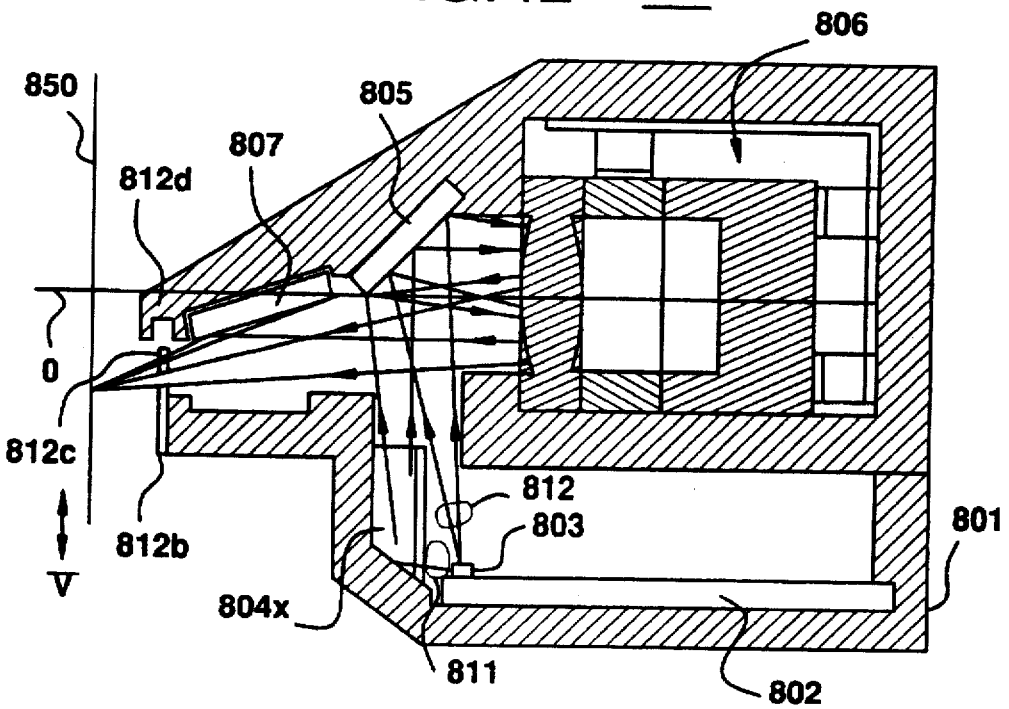
FIG. 42 is a diagram showing a modification of the optical line printhead of FIG. 41.

FIG. 42 shows a modification of the optical line printhead 800 of FIG. 41, wherein a cylindrical lens **812*c* having a concave surface is provided integrally to the shutter member 812*b* such that the lens 812*c* moves in the upward and downward directions together with the shutter member 812*b*. The cylindrical lens 812*c* is so disposed as to be located in the path of the optical beams 811 reflected at the mirror 807 and traveling toward the photosensitive drum 850 and expands the beam in the vertical scanning direction. More specifically, the lens 812*c* is located in the path of the optical beams 811 when the shutter member 812*b* is in the lowered state. Thereby, the vertically expanded beams 811 and the beams 812 are overlapped on the surface of the photosensitive drum 895 and an efficient exposure of the image is achieved in the low resolution mode. When the shutter member 812*b* is moved in the upward direction, the cylindrical lens 812*c* is removed from the path of the optical beams 811 and is accepted in a depression provided on the case 801 for accommodating the lens 812*c*. Thereby, the optical beams 812 are interrupted by the shutter member 812*b* and the optical beams 811 reach the surface of the photosensitive drum 850**. As a result, a recording of the image is achieved in the high resolution mode.

Figure 43:
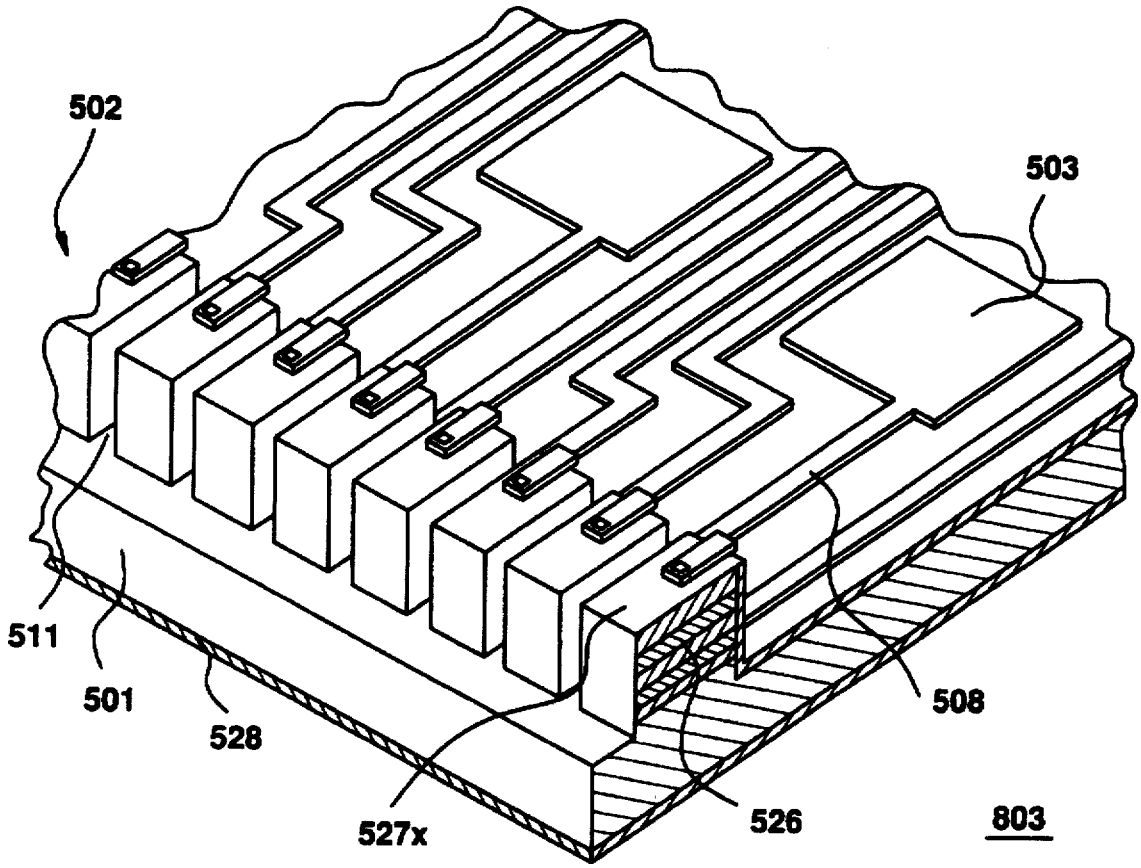
FIG. 43 is a diagram showing a part of the LED chip used in the optical line printhead of FIG. 30.
Figure 44A:
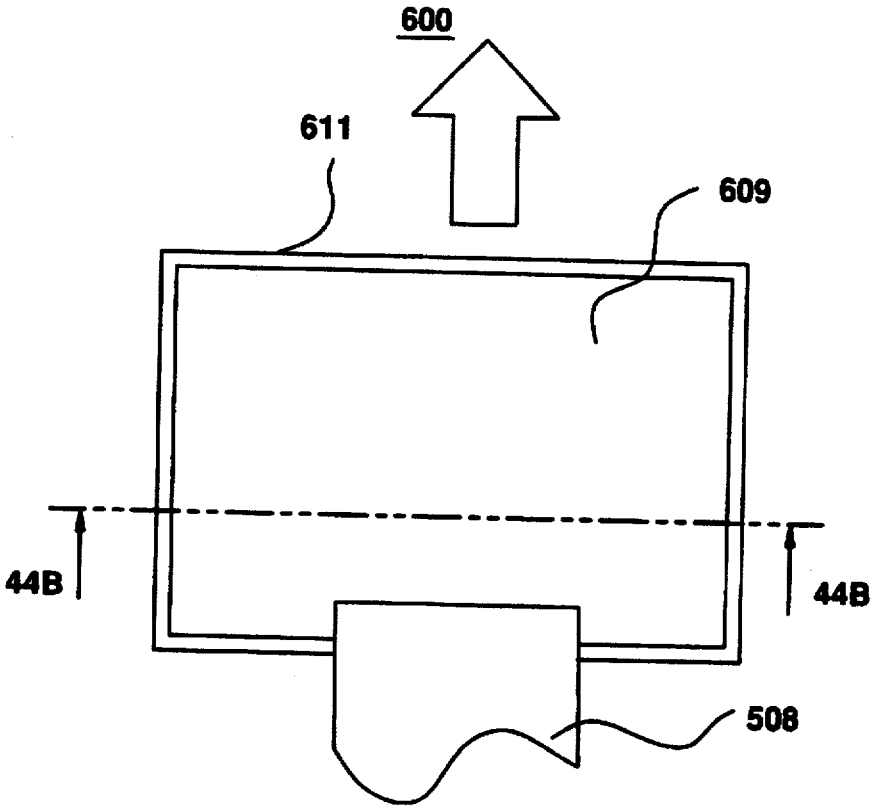
FIGS. 44(A) and 44(B) are diagrams showing a part of the LED chip of FIG. 43 respectively in a plan view and cross sectional view.
Figure 44B:
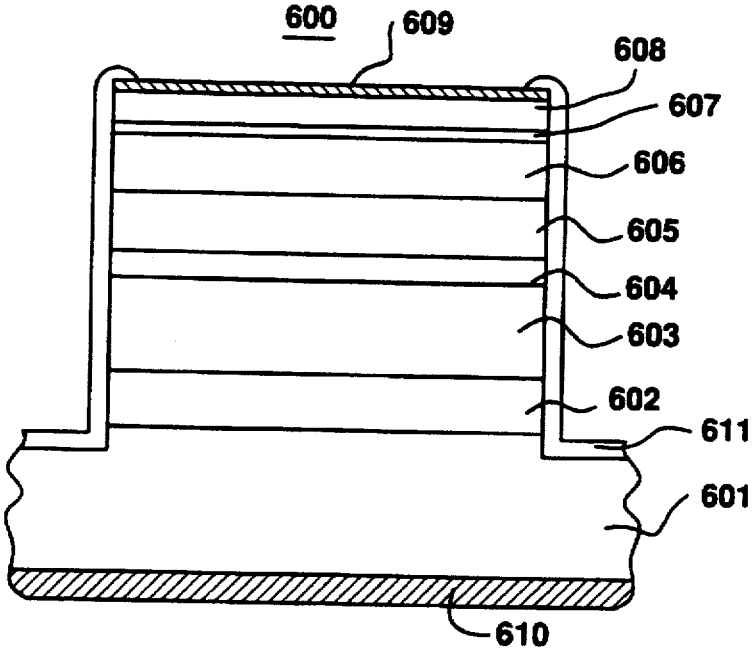

FIG. 43 shows an embodiment of the LED chip 803 used in the optical line printhead of FIG. 30 in a perspective view, while FIGS. 44(A) and 44(B) are diagrams showing the construction of an LED 600 included in the chip 803 respectively in a plan view and a front view, wherein the LED 600 corresponds to the LED 502 described with reference to preceding embodiments.

Referring to the cross sectional diagram of FIG. 44(b), it will be noted that the LED 600 is constructed on an n-type GaAs substrate 601, wherein a buffer layer 602 of n-type GaAs is provided on the substrate 601 by an MOVPE process with a thickness of 0.3 μm and the carrier concentration level of $3\times10^{18}cm^{-3}$. The buffer layer 602 is covered by a cladding layer 603 of n-type AlGaAs deposited epitaxially on the layer 602 with a thickness of 0.7 μm and a composition of $Al_{0.4}Ga_{0.6}As$, wherein the cladding layer 603 is doped to have a carrier concentration level of $3\times10^{17}$ $cm^{-3}$. Further, an active layer 604 of undoped AlGaAs is provided on the cladding layer 603 epitaxially with a thickness of 0.15 μm and carrier concentration level of about $1\times10^{16}cm^{-3}$ or less, wherein the active layer 604 has a composition of $Al_{0.2}Ga_{0.8}As$. The active layer 604 is covered by another cladding layer 605 of p-type AlGaAs deposited on the active layer 604 epitaxially with a thickness of 0.5 μm, wherein the cladding layer has a composition of $Al_{0.4}Ga_{0.6}As$ and is doped to a carrier concentration level of $5\times10^{17}cm^{-3}$. On the structure of LED thus formed, there is provided a carrier diffusion layer 606 of p-type AlGaAs having a composition of $Al_{0.4}Ga_{0.6}As$, wherein the carrier diffusion layer 606 is doped to a carrier concentration level of $2\times10^{18}cm^{-3}$ and is deposited epitaxially on the cladding layer 605 with a thickness of 1.25 μm. Further, there are provided successively first and second cap layers 607 and 608 of p-type GaAs on the carrier diffusion layer 606 while maintaining epitaxy therewith, wherein the cap layer 607 has a thickness of 0.05 μm and a carrier concentration level of $1\times10^{18}cm^{-3}$ while the cap layer 608 has a thickness of 0.05 μm and a carrier concentration level of $3\times10^{19}cm^{-3}$. Further, a transparent electrode 609 of thin metal film such as Au, Al or Ag is provided on the second cap layer 608 with a thickness typically smaller than 200 Å. The transparent metal electrode 609 is thereby contacted to the conductor pattern 508 as indicated in FIG. 44(A), wherein it will be noted that the conductor pattern covers only a minimum area of the transparent electrode 609. Further, an n-type electrode 610 of known structure as Au-Ge/Ni/Au is provided on the lower major surface of the substrate 601. The side walls of the LED 600 including the front and rear edge surfaces are covered by a protective layer of $SiO_2$ 611.

In the structure of LED of FIG. 44(B), the carriers injected from the conductor pattern 508 into the cap layers 608 and 607 via the transparent metal electrode 609 experience diffusion in the carrier diffusion layer 606 and are injected uniformly into the cladding layer 605 and hence the active layer 604. Thereby, a uniform photon emission is guaranteed over the entire area of the active layer when viewed in the plan view of FIG. 44(A).

Thus, the LED 600 produces light not only in the edge direction as indicated by the arrow in FIG. 44(A) but also in the direction perpendicular to the plane of drawing via the transparent electrode 609. As the conductor pattern 508 covers only the minimum area of the electrode 609, the optical beam emitted vertically to the plane of FIG. 44(A) has a rectangular beam shape suitable for forming images with a large dot size.

Figure 45:
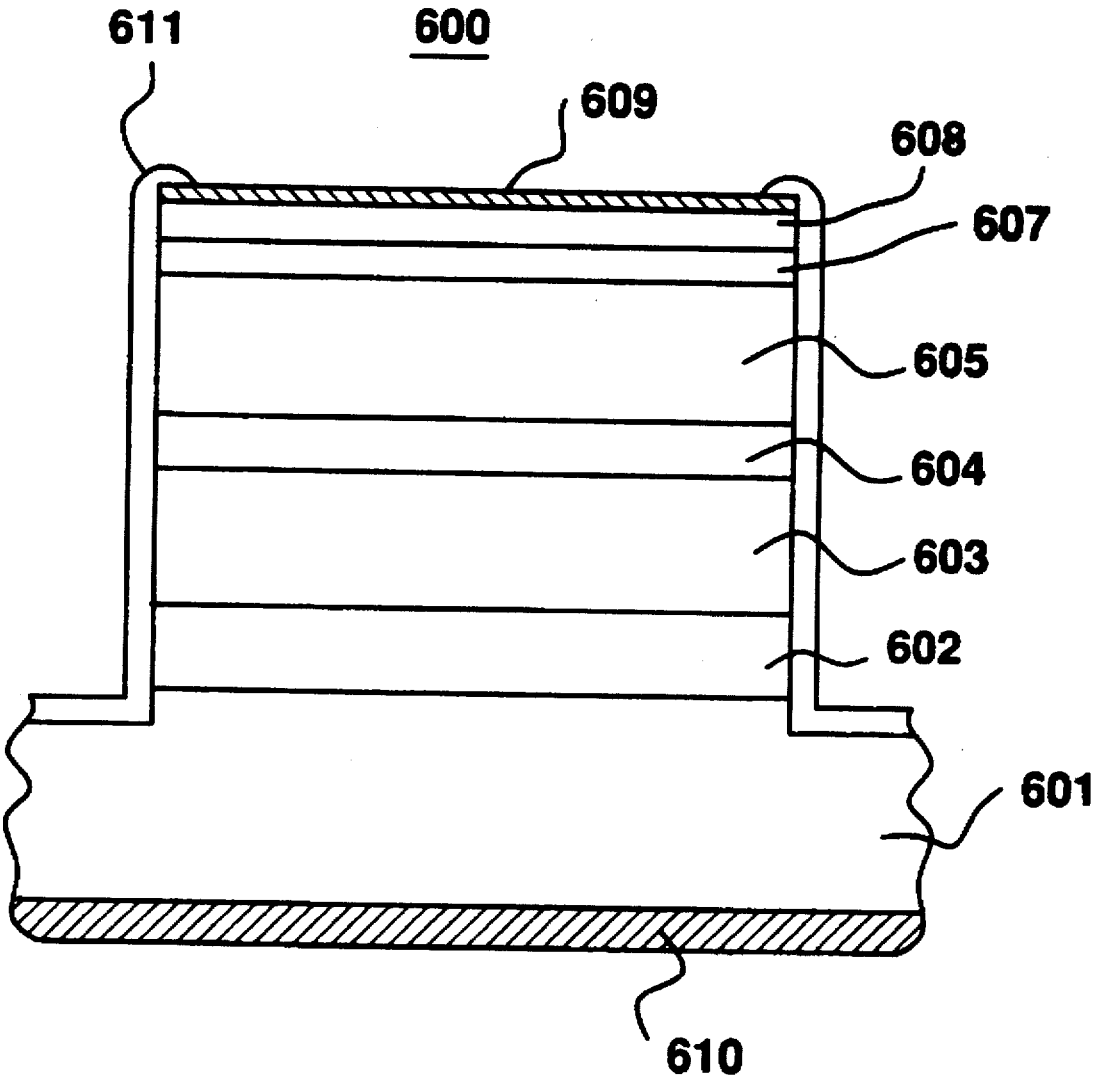
FIGS. 45–51 are diagrams showing a modification of the LED chip of FIG. 43 in a cross sectional view.

In the LED 600, one may eliminate the carrier diffusion layer 606 as long as the transparent metal electrode 609 covers substantially the entire upper major surface of the cap layer 608 as shown in FIG. 45. In such a structure too, the injection of the carriers into the active layer 604 is made substantially uniformly over the entire upper major surface thereof.

Figure 46:
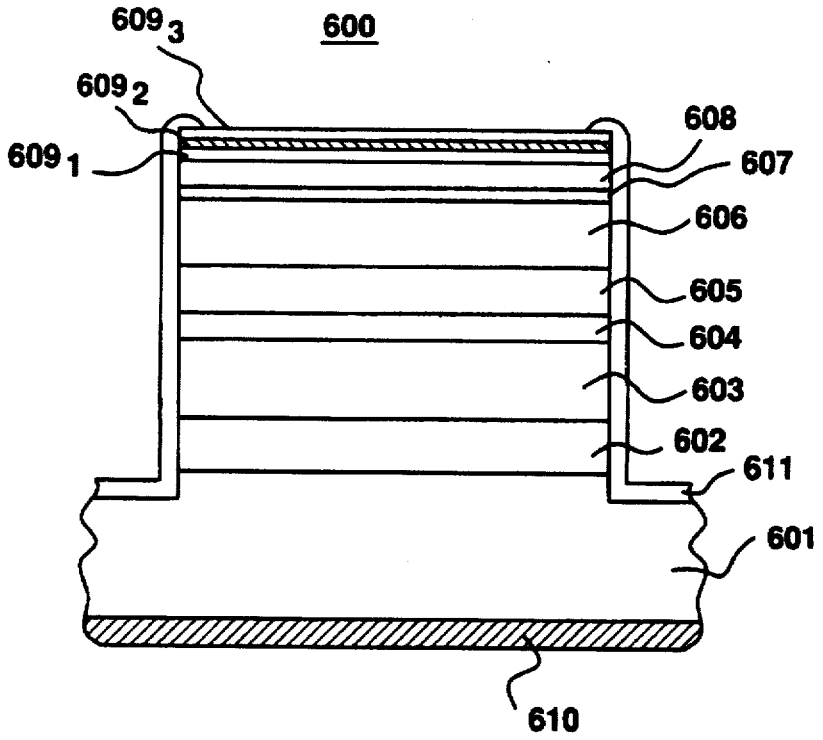
Figure 47:
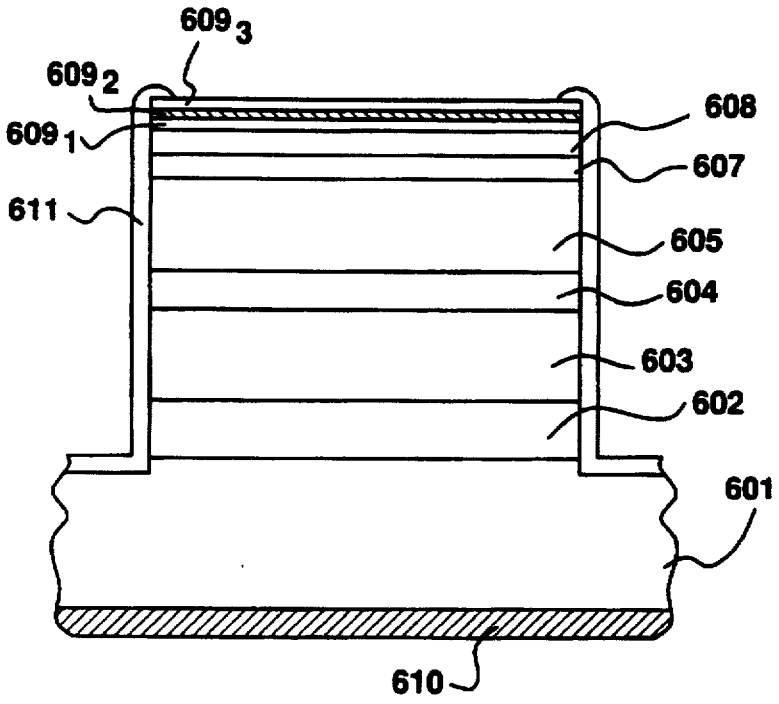

FIG. 46 shows another embodiment of the LED 600, wherein the LED 600 has a structure identical with the structure of FIG. 44(B) except that the transparent metal electrode 609 is replaced by a layered structure of a first oxide layer $\mathbf{609}_1$ and a second oxide layer $\mathbf{609}_3$ sandwiching therebetween a thin metal layer $\mathbf{609}_2$. The first oxide layer may be formed of $Ga_2O_3$ forming a native oxide film of GaAs or other oxides such as $In_2O_3$, $Bi_2O_3$ or $TiO_2$ while the second oxide layer may be formed of oxides such as $SiO_2$, $TiO_2$ or $Al_2O_3$. On the other hand, the metal layer $\mathbf{609}_2$ may be formed of a thin film of metal such as Au, Al, Rh, Cu, Cr or Pt and has a thickness less than 200 Å. By using such a composite structure for the electrode 609, one can provide a better protection against the thin and fragile metal layer $\mathbf{609}_2$. Further, by optimizing the refractive index and the thickness of the layers $\mathbf{609}_1$–$\mathbf{609}_3$, one can maximize the transmittance of the optical beam emitted therethrough. In the embodiment of FIG. 46, one may eliminate the carrier diffusion layer 606 similarly to the embodiment of FIG. 45, as indicated in FIG. 47.

Figure 48:
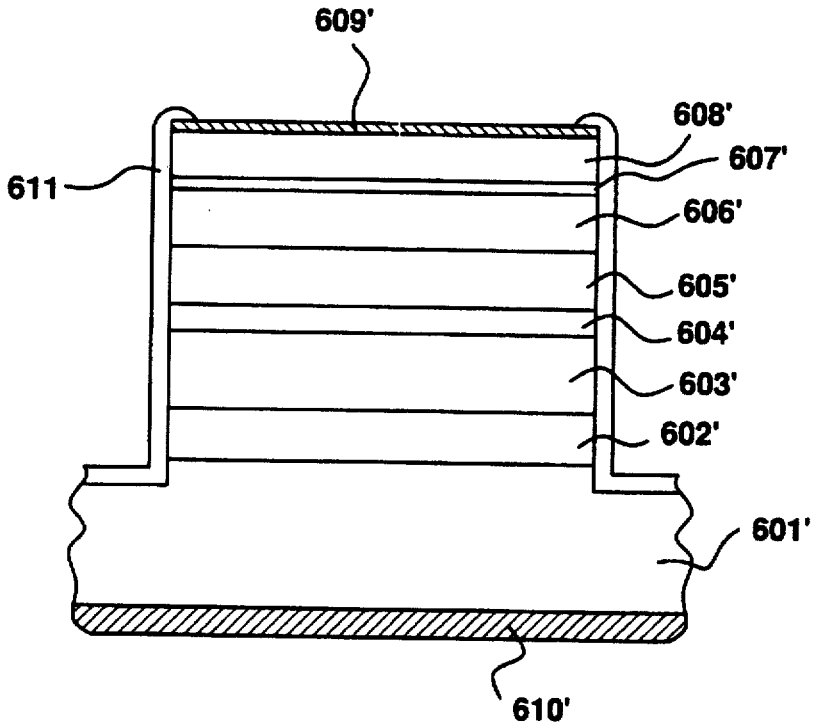
Figure 49:
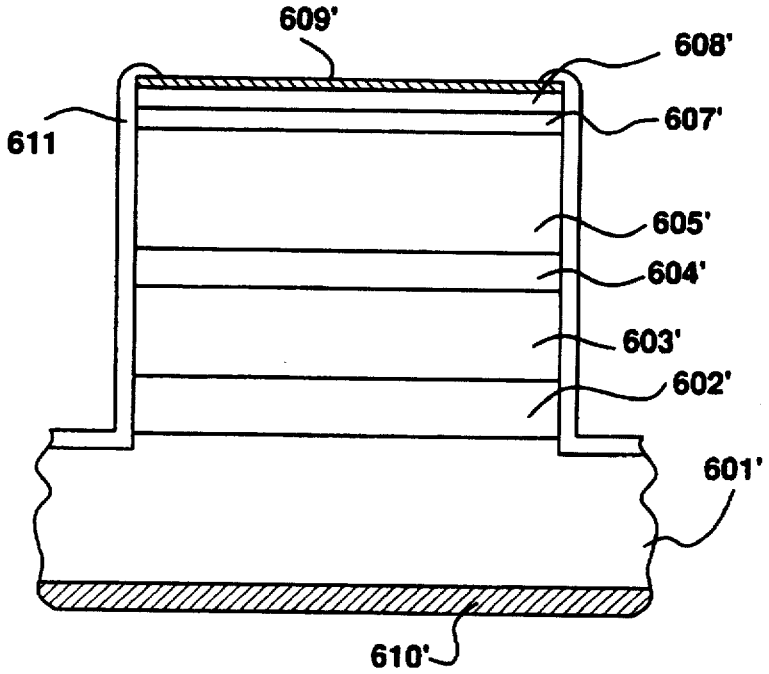

FIG. 48 shows another embodiment of the LED 600, wherein a p-type GaAs substrate 601' is used in place of the n-type GaAs substrate 601. In correspondence to the p-type conductivity of the substrate 601', there is provided a p-type GaAs buffer layer 602' having a thickness of 0.3 μm and a carrier concentration level of $3\times10^{18}cm^{-3}$. Above the p-type buffer layer 602' is provided a p-type cladding layer 603' of AlGaAs with a composition of $Al_{0.4}Ga_{0.6}As$ similarly to the cladding layer 603 except for the conductivity type, wherein the layer 601' has a thickness of 0.7 μm and a carrier concentration level of $3\times10^{17}cm^{-3}$. Further, an undoped active layer identical to the active layer 604 is provided on the cladding layer 603' with a thickness of 0.15 μm. On the active layer 604, there is provided an n-type cladding layer 605' of AlGaAs having a composition of $Al_{0.4}Ga_{0.6}As$ and a carrier concentration level of $5\times10^{17}cm^{-3}$ with a thickness of 0.5 μm, and an n-type carrier diffusion layer 606' corresponding to the carrier diffusion layer 606 except for the conductivity type, is provided on the cladding layer 605'. Thereby, the cladding layer 605' has a carrier concentration level of $2\times10^{18}cm^{-3}$ and a thickness of 1.25 μm. Further, first and second cap layers 607' and 608' of n-type GaAs are provided on the carrier diffusion layer 606' with a thickness of 0.05 μm and respective carrier concentration levels of $1\times10^{18}cm^{-3}$ and $3\times10^{19}cm^{-3}$. Further, a layer of transparent oxide conductor that shows the n-type conductivity such as $SnO_2$, $In_2O_3$, $SnO_2$-$In_2O_3$, CdO, or $Cd_2SnO_4$ is provided on the cap layer 608' as an n-type electrode 609' as shown in FIG. 48. Further, one may eliminate the carrier diffusion layer 606' in the structure of FIG. 49 as indicated in FIG. 49.

Figure 50:
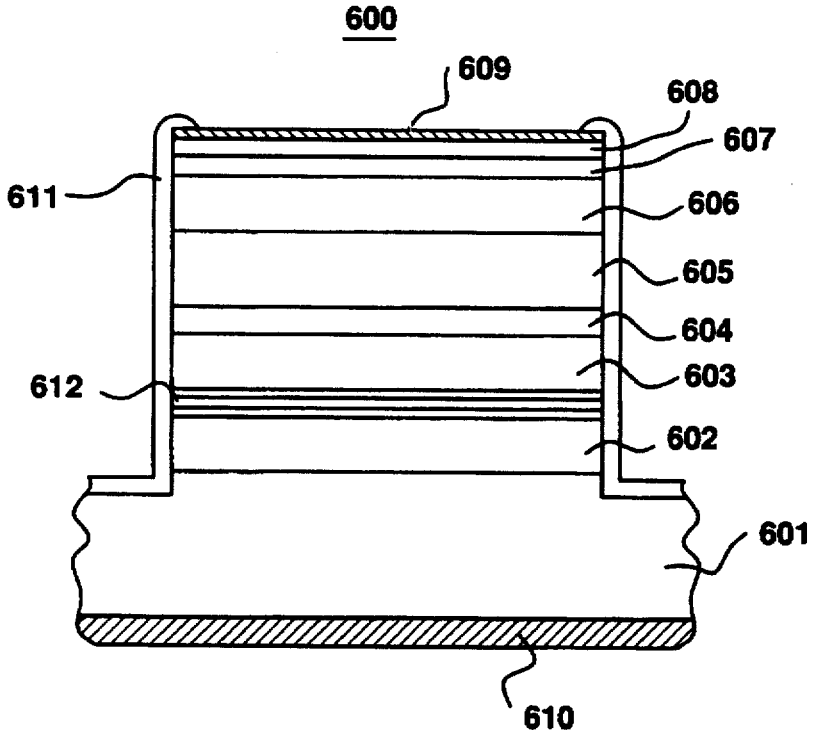
Figure 51:
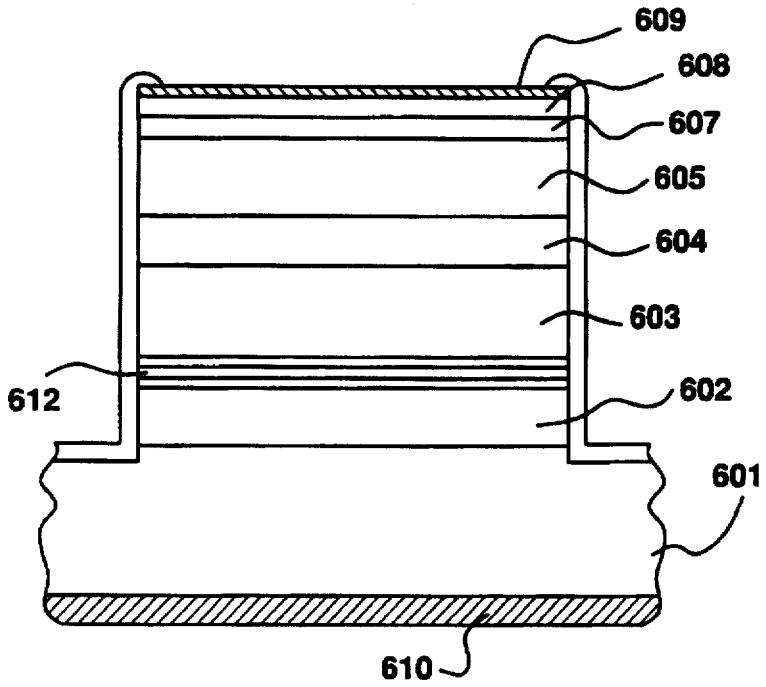

FIG. 50 shows still another embodiment of the LED 600 of FIG. 44(B), wherein there is provided a Bragg reflector 612 between the cladding layer 603 and the buffer layer 602 for reflecting the optical beam produced by the active layer 604 in the upward direction. The Bragg reflector 612 is formed of an alternate repetition of a first layer having a composition of $Al_{0.4}Ga_{0.6}As$ and a second layer having a composition of AlAs, wherein the first layer has a thickness of 540 Å and the second layer has a thickness of 610 Å. Generally, one may employ a material having a composition of $Al_xGa_{1-x}As$ with the compositional parameter x changed alternately in the first and second layers. As are result of the Bragg reflection at the layer 612, the intensity of the optical beam emitted upward from the LED increases. Further, one may eliminate the carrier diffusion layer 606 in the structure of FIG. 50 as indicated in FIG. 51.

Further, the present invention is not limited to the embodiments described heretofore, but various variations and modifications may be made without departing from the scope of the invention.

What is claimed is:

1. A light emitting diode chip, comprising:

a substrate of a single crystal semiconductor material doped to a first conductivity type and having upper and lower principal surfaces;

a bottom electrode covering said lower principal surface of said substrate;

a plurality of light emitting diodes disposed on said upper principal surface of said substrate so as to be aligned in a row, said plurality of light emitting diodes thereby forming a light emitting diode array;

each of said light emitting diodes having an identical construction and comprising: a first cladding layer doped to said first conductivity type and provided on said substrate epitaxially with respect to said substrate, said first cladding layer having a first bandgap; an active layer of undoped semiconductor material provided on said first cladding layer epitaxially with respect to said first cladding layer, said active layer having a second bandgap smaller than said first bandgap; a second cladding layer doped to a second, opposite conductivity type and provided on said active layer epitaxially with respect to said active layer, said second cladding layer having a third bandgap larger than said second bandgap; and a top electrode provided on said second cladding layer for injecting carriers of a first polarity thereto;

each of said light emitting diodes having a front edge facing a common, first direction perpendicular to a direction of a hypothetical normal drawn to said upper principal surface of said substrate and a rear edge opposing said front edge, each of said light emitting diodes emitting an optical beam at said front edge in said first direction, in response to electric energization applied across said top electrode and said bottom electrode; and monitoring means provided on said upper principal surface of said substrate for monitoring an optical power of said optical beams produced by said light emitting diodes forming said light emitting diode array, said monitoring means comprising: a monitoring-purpose light emitting diode having a construction substantially identical with the construction of said light emitting diodes that form said light emitting diode array, said monitoring-purpose light emitting diode having a front edge for emitting an optical beam therethrough, said monitoring-purpose light emitting diode being disposed on said upper principal surface of said substrate such that said front edge of said monitoring-purpose light emitting diode faces a second direction perpendicular to said first direction so that said optical beam produced by said monitoring-purpose light emitting diode is emitted in said second direction through said front edge of said monitoring-purpose light emitting diode; and a photodiode having a construction substantially identical with the construction of said light emitting diodes forming said light emitting diode array, said photodiode having a front edge facing said front edge of said monitoring-purpose light emitting diode for receiving said optical beam emitted from said monitoring-purpose light emitting diode, said photodiode producing an output signal indicative of an optical power of said optical beam produced by said monitoring-purpose light emitting diode, said output signal being produced across said top electrode of said photodiode and said bottom electrode; said monitoring means being disposed behind said rear edges of said light emitting diodes forming said light emitting diode array.

2. A light emitting diode chip as claimed in claim 1, wherein said substrate has a front edge and an opposing rear edge, said light emitting diodes forming said light emitting diode array being disposed along said front edge of said substrate, said monitoring means being disposed in the vicinity of said rear edge, such that said front edges of said light emitting diodes forming said light emitting diode array and said front edge of said substrate face said first direction.

3. A light emitting diode chip as claimed in claim 1, wherein each of said light emitting diodes forming said light emitting diode array are isolated, spatially and electrically, from each other by a groove.

4. A light emitting diode chip as claimed in claim 1, wherein said monitoring means comprises: a plurality of monitoring-purpose light emitting diodes each having a construction substantially identical with the construction of said light emitting diodes that form said light emitting diode array and disposed at respective, different locations on said upper principal surface of said substrate, each of said monitoring-purpose light emitting diodes having a front edge for emitting an optical beam therethrough, each of said monitoring-purpose light emitting diodes being disposed on said upper principal surface of said substrate such that said front edges of said monitoring-purpose light emitting diodes face said second direction such that said optical beam produced by said monitoring-purpose light emitting diode is emitted in said second direction through said front edge of said monitoring-purpose light emitting diode; and a plurality of photodiodes each having a construction substantially identical with the construction of said light emitting diodes forming said light emitting diode array and disposed in correspondence to said plurality of monitoring-purpose light emitting diodes, each of said photodiodes having a front edge facing said front edge of a corresponding monitoring-purpose light emitting diode for receiving said optical beam emitted from said corresponding monitoring-purpose light emitting diode, each said photodiode producing an output signal indicative of an optical power of said optical beam produced by said corresponding monitoring-purpose light emitting diode; said monitoring means being disposed behind said rear edges of said light emitting diodes forming said light emitting diode array.

5. A light emitting diode chip as claimed in claim 1, wherein said substrate carries, on said upper principal surface thereof, an optical shielding wall extending generally in an upward direction from said upper principal surface, said optical shielding wall being surrounded by a side wall and comprising semiconductor epitaxial layers, said optical shielding wall being provided on said upper principal surface of said substrate between said light emitting diodes that form said light emitting diode array and said monitoring means, such that said optical shielding wall shields said monitoring means from said optical beams produced by said light emitting diodes in said light emitting diode array.

6. A light emitting diode chip as claimed in claim 1, wherein said substrate carries, on said upper principal surface thereof: a first conductor pattern having a first end connected to a top electrode of said photodiode forming said monitoring means, for carrying said output signal of said photodiode therethrough; a first bonding pad provided on said upper principal surface of said substrate in electrical connection to a second, opposite end of said first conductor pattern for outputting said output signal of said photodiode; a second bonding pad provided on said upper principal surface of said substrate for receiving a drive current for energizing said monitoring-purpose light emitting diode; a second conductor pattern provided on said upper principal surface of said substrate and having a first end in electrical connection to said second bonding pad for conducting said drive current from said second bonding pad to said monitoring-purpose light emitting diode, said second conductor pattern having a second opposite end in electrical connection to a top electrode of said monitoring-purpose light emitting diode; a plurality of third bonding pads each provided on said upper principal surface of said substrate for receiving a drive current for energizing corresponding one of said light emitting diodes forming said light emitting diode array; a plurality of third conductor patterns each provided on said upper principal surface of said substrate and having a first end connected to corresponding one of said third bonding pads, for conducting said drive current supplied to said third bonding pad, each of said third conductor patterns having a second, opposite end connected to said top electrode of corresponding one of said light emitting diodes that form said light emitting diode array.

7. A light emitting diode chip as claimed in claim 1, wherein said light emitting diode chip comprises a material layer having upper and lower major surfaces provided on said upper principal surface of said substrate behind said rear edges of said light emitting diode array, said material layer carrying, on said upper major surface thereof, said first through third bonding pads and said first through third conductor patterns.

8. A light emitting diode chip as claimed in claim 7, wherein said material layer comprises semiconductor epitaxial layers provided epitaxially on said upper principal surface of said substrate, said material layer having a front edge facing said rear edges of said light emitting diodes that form said light emitting diode array, with a groove separating said material layer from said light emitting diodes in said light emitting diode array, said material layer having a thickness such that said upper principal surface of said material layer has a level generally identical with the level of said top electrode of said light emitting diodes in said light emitting diode array; said groove being filed by an insulating material having a top surface at a level substantially identical with said upper principal surface of said material layer.

9. A light emitting diode chip as claimed in claim 7, wherein said material layer has a layered structure substantially identical to the layered structure of said monitoring-purpose light emitting diode and the layered structure of said photodiode forming said monitoring means, said monitoring-purpose light emitting diode and said photodiode being isolated from said material layer by a surrounding groove that surrounds said monitoring means, said surrounding groove being filled with an insulating material.

10. An optical beam source for producing a plurality of optical beams, comprising:

a support substrate having an upper major surface;

a plurality of light emitting diode chips provided on said upper major surface of said support substrate so as to be aligned in a row, each of said light emitting diode chips comprising:

a substrate of a single crystal semiconductor material doped to a first conductivity type and having upper and lower principal surfaces;

a bottom electrode covering said lower principal surface of said substrate;

a plurality of light emitting diodes disposed on said upper principal surface of said substrate so as to be aligned in a row, said plurality of light emitting diodes thereby forming a light emitting diode array;

each of said light emitting diodes having an identical construction and comprising: a first cladding layer doped to said first conductivity type and provided on said substrate epitaxially with respect to said substrate, said first cladding layer having a first bandgap; an active layer of undoped semiconductor material provided on said first cladding layer epitaxially with respect to said first cladding layer, said active layer having a second bandgap smaller than said first bandgap; a second cladding layer doped to a second, opposite conductivity type and provided on said active layer epitaxially with respect to said active layer, said second cladding layer having a third bandgap larger than said second bandgap; and a top electrode provided on said second cladding layer for injecting carriers of a first polarity thereto;

each of said light emitting diodes having a front edge facing a common, first direction perpendicular to a direction of a hypothetical normal drawn to said upper principal surface of said substrate and a rear edge opposing said front edge, each of said light emitting diodes emitting an optical beam at said front edge in said first direction, in response to electric energization applied across said top electrode and said bottom electrode; and monitoring means provided on said upper principal surface of said substrate for monitoring the optical power of said optical beams produced by said light emitting diodes forming said light emitting diode array, said monitoring means comprising: a monitoring-purpose light emitting diode having a construction substantially identical with the construction of said light emitting diodes that form said light emitting diode array, said monitoring-purpose light emitting diode having a front edge for emitting an optical beam therethrough, said monitoring-purpose light emitting diode being disposed on said upper principal surface of said substrate such that said front edge of said monitoring-purpose light emitting diode faces a second direction perpendicular to said first direction and the direction of the hypothetical normal drawn to said upper principal surface of said substrate so that said optical beam produced by said monitoring-purpose light emitting diode is emitted in said second direction through said front edge of said monitoring-purpose light emitting diode; and a photodiode having a construction substantially identical to the construction of said light emitting diodes forming said light emitting diode array, said photodiode having a front edge facing said front edge of said monitoring-purpose light emitting diode for receiving said optical beam emitted from said monitoring-purpose light emitting diode, said photodiode producing an output signal indicative of the optical power of said optical beam produced by said monitoring-purpose light emitting diode, said output signal being produced across said top electrode of said photodiode and said bottom electrode; said monitoring means being disposed behind said rear edges of said light emitting diodes forming said light emitting diode array;

said plurality of light emitting diode chips being disposed on said support substrate so as to produce said optical beam in a common direction; and a plurality of feedback control circuits provided in a one-to-one correspondence with said plurality of light emitting diode chips, said feedback control circuit drives, in each of said plurality of light emitting diode chips, said monitoring-purpose light emitting diode with energization determined in response to said output signal of said photodiode, such that said optical beam produced by said monitoring-purpose light emitting diode has a predetermined optical power, said feedback control circuit driving said light emitting diodes forming said light emitting diode array on said light emitting diode chip by energization corresponding to the energization of said monitoring-purpose light emitting diode.

11. An optical beam source as claimed in claim 10, wherein each of said feedback control circuits comprises: non-volatile memory means for storing a value of desired power of the optical beams produced by said light emitting diodes; comparator means supplied with an output signal from said non-volatile memory means indicative of said desired power of said optical beam stored therein and further with said output signal of said photodiode indicative of the power of the optical beam produced by the monitoring-purpose light emitting diode, for producing an output signal in response to the difference between said output signal of said comparator means and said output signal of said photodiode, such that said difference is reduced; and driver means supplied with said output signal of said comparator means for producing a drive current, said comparator means energizing said monitoring-purpose light emitting diode by said drive current, said comparator means further energizing said light emitting diodes forming said light emitting diode array by said drive current.

12. An optical beam source as claimed in claim 10, wherein said optical beam source further includes an optical system for focusing said optical beams on a recording surface, said optical system comprising: first reflection means for deflecting said optical beams produced by said light emitting diodes on said light emitting diode chips in a direction generally perpendicular to said upper major surface of said support substrate; second reflection means for causing first and second successive reflections of said optical beams that have been deflected by said first reflection means, such that said optical beams are deflected first in a direction generally parallel to said upper major surface of said support substrate in correspondence to said first reflection and next in a direction generally perpendicular to said upper major surface of said support substrate in correspondence to said second reflection such that said optical beams travel toward said support substrate after said second reflection; third reflection means for deflecting said optical beams having undergone said first and second reflections in said second reflection means toward said recording surface; and a plurality of lenses aligned, with a predetermined pitch, in a direction in which said light emitting diode chips are aligned to form a lens array, said plurality of lenses being disposed in a path of said optical beams traveling from said first reflection means to said third reflection means via said second reflection means.

13. An optical beam source as claimed in claim 12, wherein said optical system includes another lens array including a plurality of lenses each being aligned coaxially with respect to the lenses forming said first mentioned lens array.

14. An optical beam source as claimed in claim 12, wherein said third reflection means comprises a plurality of roof mirrors each having a pair of mutually inclined mirror surfaces that cause said first and second reflections of said optical beams, said roof mirrors being disposed with a pitch corresponding to said predetermined pitch of said plurality of lenses.

15. An optical beam source as claimed in claim 12, wherein said optical system includes optical louver means including a plurality of apertures each forming a passage for said optical beams, said apertures being aligned with a pitch corresponding to the pitch of said lenses.

16. An optical beam source as claimed in claim 10, wherein said support substrate has a lower major surface on which a cooling fin fixture including a plurality of cooling fins is provided for radiating heat.

17. An optical beam source as claimed in claim 10, wherein said third reflection means deflects said optical beam in a direction that is inclined with respect to said upper major surface of said support substrate.

18. An optical beam source as claimed in claim 10, wherein said optical beam source further includes an optical system for focusing said optical beams on a recording surface, said optical system comprising: first reflection means for deflecting said optical beams produced by said light emitting diodes on said light emitting diode chips, in a direction generally perpendicular to said upper principal surface of said substrate; second reflection means for deflecting said optical beams deflected by said first reflection means in a direction generally parallel to said upper major surface of said support substrate such that said optical beams travel away from said recording surface; third reflection means for causing first and second successive reflections in said optical beams that have been deflected by said second reflection means, such that said optical beams are deflected by substantially 90 degrees generally along a plane parallel to said upper major surface of said support substrate in each of said first and second reflections, such that said optical beams travel toward said recording surface after said second reflection; and a plurality of lenses aligned, with a predetermined pitch, in a direction in which said light emitting diode chips are aligned to form a lens array, said plurality of lenses being disposed in a path of said optical beams traveling from said third reflection means to said recording surface.

19. A light emitting diode, comprising:

a substrate having upper and lower major surfaces, said substrate comprising a semiconductor material doped to a first conductivity type;

first electrode means provided on said lower major surface of said substrate;

a first cladding layer having upper and lower major surfaces and provided on said substrate, said first cladding layer comprising a semiconductor material doped to said first conductivity type and having a first bandgap;

an active layer having upper and lower major surfaces and provided on said first cladding layer, said active layer comprising an undoped semiconductor material having a second bandgap smaller than said first bandgap, said active layer producing optical radiation as a result of recombination of carriers, said active layer having an edge surface generally perpendicular to said upper major surface of said substrate for emitting said optical radiation as a first optical beam;

a second cladding layer having upper and lower major surfaces and provided on said active layer, said second cladding layer comprising a semiconductor material doped to a second, opposite conductivity type and having a third bandgap larger than said second bandgap; and second electrode means provided on said upper major surface of said second cladding layer and having upper and lower major surfaces, said second electrode means passing said optical radiation produced in said active layer generally in a direction perpendicular to said upper major surface of said second electrode means, as a second optical beam.

20. A light emitting diode chip as claimed in claim 1, wherein said light emitting diode chip comprising a control circuit for controlling said plurality of light emitting diodes in response to an output signal of said photodiode forming said monitoring means, said control circuit being provided on said upper principal surface of said substrate monolithically.

21. A light emitting diode chip as claimed in claim 20, wherein said control circuit includes a transistor provided monolithically on said upper principal surface of said substrate.

22. An optical beam source as claimed in claim 10, wherein each of said plurality of feedback control circuits includes a transistor provided monolithically on a corresponding light emitting diode chip.

23. An optical beam source for producing a plurality of optical beams, which comprises:

a case member having a first substrate positioned therein;

at least one light emitting diode chip positioned on said first substrate, said at least one light emitting diode chip having;

a second substrate of a single crystal semiconductor material doped to a first conductivity type and having upper and lower principal surfaces;

a bottom electrode covering said lower principal surface of said second substrate;

a plurality of light emitting diodes disposed on said upper principal surface of said second substrate so as to be aligned in a row;

each of said light emitting diodes having a first cladding layer doped to said first conductivity type and provided on said substrate epitaxially with respect to said substrate, said first cladding layer having a first bandgap; an active layer of undoped semiconductor material provided on said first cladding layer epitaxially with respect to said first cladding layer, said active layer having a second bandgap smaller than said first bandgap; a second cladding layer doped to a second, opposite conductivity type and provided on said active layer epitaxialy with respect to said active layer, said second cladding layer having a third bandgap larger than said second bandgap; and a top electrode provided on said second cladding layer for injecting carriers of a first polarity thereto;

each of said light emitting diodes having a front edge facing a common, first direction perpendicular to a direction of a hypothetical normal drawn to said upper principal surface of said substrate and a rear edge opposing said front edge, each of said light emitting diodes emitting an optical beam at said front edge in said first direction in response to electric energization applied across said top electrode and said bottom electrode; and monitoring means provided on said upper principal surface of said second substrate for monitoring an optical power of said optical beams produced by said light emitting diodes forming said light emitting diode array, said monitoring means further including at least one monitoring-purpose light emitting diode having a front edge for emitting an optical beam therethrough, said at least one monitoring-purpose light emitting diode being disposed on said upper principal surface of said second substrate such that said front edge of said at least one monitoring-purpose light emitting diode faces a second direction perpendicular to said first direction so that said optical beam produced by said at least one monitoring-purpose light emitting diode is emitted in said second direction through said front edge of said at least one monitoring-purpose light emitting diode; and at least one photodiode associated with said at least one monitoring-purpose light emitting diode, said at least one photodiode having a front edge facing said front edge of said at least one monitoring-purpose light emitting diode for receiving said optical beam emitted from said at least one monitoring-purpose light emitting diode, said at least one photodiode producing an output signal indicative of an optical power of said optical beam produced by said at least one monitoring-purpose light emitting diode, said output signal being produced across said top electrode of said at least one photodiode and said bottom electrode; and means positioned within said case member for focusing and directing light emitted from said at least one light emitting diode chip to a recording surface.

24. An optical beam source for producing a plurality of optical beams, comprising:

a substrate having upper and lower major surfaces;

a plurality of light emitting diodes provided on said upper major surface of said substrate so as to align in a row in a first direction, each of said plurality of light emitting diodes having an edge surface facing a common, second direction substantially perpendicular to said first direction for emitting a first optical beam generally in said second direction, each of said light emitting diodes further having an upper principal surface for emitting a second optical beam therethrough generally in a third direction perpendicular to said upper principal surface of said light emitting diode;

an optical system for focusing said optical beams on a recording surface, said optical system comprising:

first reflection means for deflecting said first optical beams produced by said light emitting diodes in a fourth direction which is different from said second direction and which is generally perpendicular to said first direction;

second reflection means for deflecting said first optical beams deflected by said first reflection means in a fifth direction which is generally perpendicular to said first direction and which is generally opposite to said second direction, said second reflection means further deflecting said second optical beams in a sixth direction which is generally perpendicular to said first direction and which is generally opposite to said second direction;

third reflection means for causing first and second successive reflections in said first optical beams that have been deflected by said second reflection means, such that said first optical beams are deflected by substantially 90 degrees in each of said first and second reflections, such that said first optical beams travel in a seventh direction generally perpendicular to said first direction and generally opposite to said fifth direction, said third reflection means further causing third and fourth successive reflections in said second optical beams that have been deflected by said second reflection means, such that said second optical beams are deflected by substantially 90 degrees in each of said third and fourth reflections, such that said second optical beams travel in an eighth direction generally perpendicular to said first direction and generally opposite to said sixth direction;

a plurality of lenses aligned, with a predetermined pitch, in said first direction to form a lens array, said plurality of lenses being disposed in a path of said first and second optical beams traveling away from said third reflection means for focusing the same on an image plane; and fourth reflection means disposed in a path of said first optical beams passed through said lens array after reflection by said third reflection means, for deflecting said first optical beams in a ninth direction that is generally perpendicular to said first direction and pointing towards said image plane, such that said first optical beams are focused at respective, corresponding focal points of said second optical beams.

25. An optical beam source as claimed in claim 24, wherein said first reflection means and said fourth reflection means have respective mechanisms for adjusting a reflection angle of said first optical beams.

26. An optical beam source as claimed in claim 24, wherein each of said light emitting diodes carries a beam shaping mask on said edge surface, for reducing a width of said first optical beam emitted therefrom, such that each of said first optical beams produced by said light emitting diodes has a reduced width in said first direction.

27. An optical beam source as claimed in claim 24, wherein each of said light emitting diodes carries a beam shaping mask on said upper principal surface, for reducing a width of said second optical beam emitted therefrom, such that each of said second optical beams produced by said light emitting diodes has a reduced width in said first direction.

28. An optical beam source as claimed in claim 24, wherein said optical system comprises optical path modification means provided in a path of said first optical beams for modifying an optical path length.

29. An optical beam source as claimed in claim 28, wherein said optical path modification means comprises a cylindrical surface provided on said first reflection means for reflecting said first optical beams with a negative power.

30. An optical beam source as claimed in claim 28, wherein said optical path modification means comprises a convex lens provided on a path of said second optical beams for reducing the path length of said second optical beams.

31. An optical beam source as claimed in claim 28, wherein said optical system includes a moving mechanism for moving said optical path modification means for changing the optical path of said first optical beams with respect to the optical path of said second optical beams.

32. An optical beam source as claimed in claim 24, wherein said optical system includes optical shielding means for separating said first optical beams and said second optical beams from each other.

33. An optical beam source as claimed in claim 24, wherein said light emitting diodes are disposed on said substrate such that said upper principal surface of said light emitting diodes is oriented substantially perpendicularly to a path of said second optical beams passed through said lens array and traveling toward said image plane.

34. An optical beam source as claimed in claim 24, wherein each of said light emitting diodes carries a transparent electrode on said upper principal surface for injecting carriers therein.

35. An optical beam source as claimed in claim 24, wherein said optical system includes shutter means for selectively interrupting one of said first and second optical beams.

36. An optical beam source as claimed in claim 35, wherein said shutter means includes a concave lens such that said concave lens is inserted into the path of said first optical beams when said shutter means is activated to interrupt said second optical beams.

37. A light emitting diode for emitting optical beams in mutually different directions, comprising:

a substrate of a semiconductor material having upper and lower major surfaces and doped to a first conductivity type;

first cladding layer of a semiconductor material doped to said first conductivity type and having a first bandgap, said first cladding layer having upper and lower major surfaces and provided on said upper major surface of said substrate;

an active layer of an undoped semiconductor material having a second bandgap smaller than said first bandgap, said active layer having upper and lower major surfaces and provided on said upper major surface of said first cladding layer, said active layer producing optical radiation as a result of recombination of carriers taking place in said active layer;

second cladding layer of a semiconductor material doped to a second, opposite conductivity type and having a third bandgap larger than said second bandgap, said second cladding layer having upper and lower major surfaces and provided on said upper major surface of said active layer;

said first cladding layer and said second cladding layer forming, together with said active layer, a layered structure having an upper major surface and an edge surface extending substantially perpendicularly to said upper major surface of said substrate, said layered structure outputting a first optical beam from said active layer at said edge surface as a result of said optical radiation produced in said active layer;

lower electrode means provided on said lower major surface of said substrate for injecting carriers of a first polarity into said active layer; and upper electrode means provided on said upper major surface of said layered structure for injecting carriers of a second, opposite polarity into said active layer, said upper electrode means being substantially transparent to said optical radiation produced in said active layer for emitting a second optical beam therethrough in a direction generally perpendicular to said upper major surface of said layered structure.

38. A light emitting diode as claimed in claim 37, wherein said upper electrode means comprises a metal film having upper and lower major surfaces, said metal film having a thickness small enough to allow passage of said second optical beam therethrough.

39. A light emitting diode as claimed in claim 38, wherein said metal film has a thickness smaller than 200 Å.

40. A light emitting diode as claimed in claim 38, wherein said metal film is formed of a metal selected from a group consisting of Au, Al, Rh, Cu, Cr, Pt and Ag.

41. A light emitting diode as claimed in claim 38, wherein said upper electrode means further comprises first and second oxide films respectively having upper and lower major surfaces and sandwiching said metal film from below and above, said first oxide film being provided below said metal film and formed of an oxide selected from a group consisting of $Ga_2O_3$, $In_2O_3$, $Bi_2O_3$ and $TiO_2$, said second oxide film being provided above said metal film and formed of an oxide selected from a group consisting of $SiO_2$, $TiO_2$ and $Al_2O_3$.

42. A light emitting diode as claimed in claim 37, wherein said upper electrode means comprises an oxide having an n-type conductivity.

43. A light emitting diode as claimed in claim 42, wherein said upper electrode means comprises a layer of oxide selected from a group consisting of $SnO_2$, $In_2O_3$, CdO, $Cd_2SnO_4$ and a solid solution thereof.

44. A light emitting diode as claimed in claim 42, wherein said upper electrode means comprises an electrode layer having upper and lower major surfaces and formed of a material substantially transparent to said optical radiation formed in said active layer for contacting with an external lead pattern and a carrier diffusion layer having upper and lower major surfaces and provided between said electrode layer and said second cladding layer for causing a diffusion of carriers injected via said electrode layer, said carrier diffusion layer being doped to a carrier concentration level exceeding a carrier concentration level of said second cladding layer.

45. A light emitting diode as claimed in claim 37, wherein said light emitting diode further comprises a optical reflection layer having upper and lower major surface and provided between said substrate and said first cladding layer, said reflection layer having an alternate repetition of refractive index from said lower major surface to said upper major surface of said reflection layer for causing a Bragg reflection of said optical radiation produced in said active layer in a direction substantially perpendicularly to said optical reflection layer.

46. A light emitting diode as claimed in claim 45, wherein said optical reflection layer comprises an alternate repetition of a first layer and a second layer both having a composition represented as $Al_xGa_{1-x}As$ wherein the compositional parameter x is changed in said first and second layers in a range from zero to one.

* * * * *

UNITED STATES PATENT AND TRADEMARK OFFICE

CERTIFICATE OF CORRECTION

PATENT NO. : 5,684,523

DATED : Nov. 4, 1997

INVENTOR(S) : Shunichi Satoh, et al

It is certified that error appears in the above-identified patent and that said Letters Patent is hereby corrected as shown below:

Cover page, first column, Item [54], please change

"OPTICAL LINE PRINTHEAD AND AN LED CHIP USED THEREFOR" to

--OPTICAL LINE PRINTHEAD AND AN LED CHIP USED THEREFORE--

Signed and Sealed this

Twenty-fourth Day of March, 1998

*Attest:*

Bruce Lehman

BRUCE LEHMAN

*Attesting Officer*

*Commissioner of Patents and Trademarks*